US005747236A

United States Patent [19]

Farid et al.

[11] Patent Number: 5,747,236

[45] Date of Patent: May 5, 1998

[54] SILVER HALIDE LIGHT SENSITIVE EMULSION LAYER HAVING ENHANCED PHOTOGRAPHIC SENSITIVITY

[75] Inventors: Samir Y. Farid, Rochester; Jerome R. Lenhard, Fairport; Chin H. Chen, Mendon; Annabel A. Muenter, Rochester; Ian R. Gould, Pittsford; Stephen A. Godleski, Fairport; Paul A. Zielinski, Rochester; Charles H. Weidner, Ontario, all of N.Y.

[73] Assignee: Eastman Kodak Company, Rochester, N.Y.

[21] Appl. No.: 740,536

[22] Filed: Oct. 30, 1996

Related U.S. Application Data

[63] Continuation-in-part of Ser. No. 592,106, Jan. 26, 1996, abandoned.

[51] Int. Cl.[6] ..... G03C 1/08

[52] U.S. Cl. ..... 430/583; 430/584; 430/588; 430/595; 430/599; 430/600; 430/603; 430/607; 430/611

[58] Field of Search ..... 430/598, 599, 430/600, 603, 607, 611, 570, 572, 583, 584, 588, 595

[56] References Cited

U.S. PATENT DOCUMENTS

| | | | |
|---|---|---|---|
| 2,419,975 | 5/1947 | Trivelli et al. | 95/6 |
| 2,875,058 | 2/1959 | Carroll et al. | 96/104 |
| 2,937,089 | 5/1960 | Jones et al. | 96/100 |
| 3,457,078 | 7/1969 | Riester | 96/104 |
| 3,458,318 | 7/1969 | Brooks | 96/104 |
| 3,615,632 | 10/1971 | Shiba et al. | 96/122 |
| 3,695,888 | 10/1972 | Hiller et al. | 96/123 |
| 3,706,567 | 12/1972 | Hiller | 96/126 |
| 3,809,561 | 5/1974 | Ulbing et al. | 96/84 |
| 4,297,441 | 10/1981 | Kaneko et al. | 430/543 |
| 4,367,279 | 1/1983 | Herz et al. | 430/234 |
| 4,607,006 | 8/1986 | Hirano et al. | 430/572 |
| 4,719,174 | 1/1988 | Hirano et al. | 430/578 |
| 4,897,343 | 1/1990 | Ikeda et al. | 430/570 |
| 4,917,997 | 4/1990 | Ikeda | 430/572 |
| 4,971,890 | 11/1990 | Okada et al. | 430/264 |
| 4,985,351 | 1/1991 | Matejec et al. | 430/598 |
| 5,059,516 | 10/1991 | Sato et al. | 430/599 |
| 5,190,855 | 3/1993 | Toya et al. | 430/599 |
| 5,192,654 | 3/1993 | Hioki et al. | 430/576 |
| 5,212,056 | 5/1993 | Beltramini | 430/572 |
| 5,213,952 | 5/1993 | Kuwashima et al. | 430/378 |
| 5,244,779 | 9/1993 | Asami et al. | 430/503 |
| 5,298,383 | 3/1994 | Mihayashi et al. | 430/557 |
| 5,306,612 | 4/1994 | Philip, Jr. et al. | 430/572 |

FOREIGN PATENT DOCUMENTS

| | | |
|---|---|---|
| 0 554 856 A1 | 8/1993 | European Pat. Off. . |
| 0 652 470 A1 | 5/1995 | European Pat. Off. . |
| 4343622 A1 | 6/1994 | Germany . |
| 1 064 193 | 4/1967 | United Kingdom . |
| 1 255 084 | 11/1971 | United Kingdom . |

OTHER PUBLICATIONS

R. K. Ahrenkiel et a., "The Theory of the Photographic Process", 4th Edition, T. H. James Editor, pp. 265–266, Macmillan 1977.

Naoki Obi et al., "A New High Contrast System Using Pyridinium Salts", May 1994, pp. 322–325, IS&T's 47th Annual Conference/ICPS 1994.

Corwin Hansch et al., "A survey of Hammett Substituent Constants and Resonance and Field Parameters", American Chem. Society, 1991, pp. 165–196.

Roberts, John D. and Caserio Marjorie C. *Basic Principles of Organic Chemistry*, New York: W. A. Benjamin, Inc. 1965.

*Primary Examiner*—Janet C. Baxter
*Attorney, Agent, or Firm*—Edith A. Rice

[57] ABSTRACT

A photographic element comprises a support and at least one silver halide emulsion layer in which the silver halide is sensitized with a fragmentable electron donor of the formula X—Y, wherein X is an electron donor moiety and Y is a leaving group other than hydrogen, and wherein:

1) X—Y has an oxidation potential between 0 and about 1.4 V; and 2) the oxidized form of X—Y undergoes a bond cleavage reaction to give the radical $X^{\bullet}$ and the leaving fragment Y.

In a preferred embodiment of the invention, the radical $X^{\bullet}$ has an oxidation potential $\leqq -0.7$V.

23 Claims, No Drawings

SILVER HALIDE LIGHT SENSITIVE EMULSION LAYER HAVING ENHANCED PHOTOGRAPHIC SENSITIVITY

CROSS-REFERENCE TO RELATED APPLICATIONS

This is a continuation-in-part of application Ser. No. 08/592,106, filed Jan. 26, 1996, and now abandoned, entitled "Silver Halide Light Sensitive Emulsion Having Enhanced Photographic Sensitivity" by Samir Farid et al., the entire disclosures of which are incorporated herein by reference.

FIELD OF THE INVENTION

This invention relates to a photographic element comprising at least one light sensitive silver halide emulsion layer which has enhanced photographic sensitivity.

BACKGROUND OF THE INVENTION

A variety of techniques have been used to improve the light-sensitivity of photographic silver halide materials.

Chemical sensitizing agents have been used to enhance the intrinsic sensitivity of silver halide. Conventional chemical sensitizing agents include various sulfur, gold, and group VIII metal compounds.

Spectral sensitizing agents, such as cyanine and other polymethine dyes, have been used alone, or in combination, to impart spectral sensitivity to emulsions in specific wavelength regions. These sensitizing dyes function by absorbing long wavelength light that is essentially unabsorbed by the silver halide emulsion and using the energy of that light to cause latent image formation in the silver halide.

Many attempts have been made to further increase the spectral sensitivity of silver halide materials. One method is to increase the amount of light captured by the spectral sensitizing agent by increasing the amount of spectral sensitizing agent added to the emulsion. However, a pronounced decrease in photographic sensitivity is obtained if more than an optimum amount of dye is added to the emulsion. This phenomenon is known as dye desensitization and involves sensitivity loss in both the spectral region wherein the sensitizing dye absorbs light, and in the light sensitive region intrinsic to silver halide. Dye desensitization has been described in The Theory of the Photographic Process, Fourth Edition, T. H. James, Editor, pages 265–266, (Macmillan, 1977).

It is also known that the spectral sensitivity found for certain sensitizing dyes can be dramatically enhanced by the combination with a second, usually colorless organic compound that itself displays no spectral sensitization effect. This is known as the supersensitizing effect.

Examples of compounds which are conventionally known to enhance spectral sensitivity include sulfonic acid derivatives described in U.S. Pat. Nos. 2,937,089 and 3,706,567, triazine compounds described in U.S. Pat. Nos. 2,875,058 and 3,695,888, mercapto compounds described in U.S. Pat. No. 3,457,078, thiourea compounds described in U.S. Pat. No. 3,458,318, pyrimidine derivatives described in U.S. Pat. No. 3,615,632, dihydropyridine compounds described in U.S. Pat. No. 5,192,654, aminothiatriazoles as described in U.S. Pat. No. 5,306,612 and hydrazines as described in U.S. Pat. Nos. 2,419,975, 5,459,052 and 4,971,890 and European Patent Application No. 554,856A1. The sensitivity increases obtained with these compounds generally are small, and many of these compounds have the disadvantage that they have the undesirable effect of deteriorating the stability of the emulsion or increasing fog.

Various electron donating compounds have also been used to improve spectral sensitivity of silver halide materials. U.S. Pat. No. 3,695,588 discloses that the electron donor ascorbic acid can be used in combination with a specific tricarbocyanine dye to enhance sensitivity in the infrared region. The use of ascorbic acid to give spectral sensitivity improvements when used in combination with specific cyanine and merocyanine dyes is also described in U.S. Pat. No. 3,809,561, British Patent No. 1,255,084, and British Patent No. 1,064,193. U.S. Pat. No. 4,897,343 discloses an improvement that decreases dye desensitization by the use of the combination of ascorbic acid, a metal sulfite compound, and a spectral sensitizing dye.

Electron-donating compounds that are convalently attached to a sensitizing dye or a silver-halide adsorptive group have also been used as supersensitizing agents. U.S. Pat. Nos. 5,436,121 and 5,478,719 disclose sensitivity improvements with the use of compounds containing electron-donating styryl bases attached to monomethine dyes. Spectral sensitivity improvements are also described in U.S. Pat. No. 4,607,006 for compounds containing an electron-donative group derived from a phenothiazine, phenoxazine, carbazole, dibenzophenothiazine, ferrocene, tris(2,2'-bipyridyl)ruthenium, or a triarylamine skeleton which are connected to a silver halide adsorptive group. However, most of these latter compounds have no silver halide sensitizing effect of their own and provide only minus-blue sensitivity improvements when used in combination with a sensitizing dye.

PROBLEM TO BE SOLVED BY THE INVENTION

There is a continuing need for materials which, when added to photographic emulsions, increase their sensitivity. Ideally such materials should be useable with a wide range of emulsion types, their activity should be controllable and they should not increase fog beyond acceptable limits. This invention provides such materials.

SUMMARY OF THE INVENTION

In accordance with this invention, a silver halide emulsion layer of a photographic element is sensitized with a fragmentable electron donor that, upon donating an electron, undergoes a bond cleavage reaction other than deprotonation. The term "sensitization" is used in this patent application to mean an increase in the photographic response of the silver halide emulsion layer of a photographic element and the term "sensitizer" is used to mean a compound that provides sensitization when present in a silver halide emulsion layer.

One aspect of this invention comprises a photographic element comprising at least one silver halide emulsion layer in which the silver halide is sensitized with a compound of the formula X—Y, wherein X is an electron donor moiety and Y is a leaving group other than hydrogen, and wherein:

1) X—Y has an oxidation potential between 0 and about 1.4 V; and
2) the oxidized form of X—Y undergoes a bond cleavage reaction to give the radical $X^{\bullet}$ and the leaving fragment Y.

In this patent application, oxidation potentials are reported as "V" which represents "volts versus a saturated calomel reference electrode".

Another aspect of this invention comprises a photographic element comprising at least one silver halide emulsion layer in which the silver halide is sensitized with a compound of the formula X—Y, wherein X is an electron donor moiety and Y is a leaving group other than hydrogen, and wherein:

1) X—Y has an oxidation potential between 0 and about 1.4 V;
2) the oxidized form of X—Y undergoes a bond cleavage reaction to give the radical $X^{\cdot}$ and the leaving fragment Y; and
3) the radical $X^{\cdot}$ has an oxidation potential $\leqq -0.7$V (that is, equal to or more negative than about −0.7V).

Compounds which meet criteria (1) and (2) but not (3) are capable of donating one electron and are referred to herein as fragmentable one-electron donors. Compounds which meet all three criteria are capable of donating two electrons and are referred to herein as fragmentable two-electron donors.

The XY compounds utilized in the practice of this invention (unlike the compounds disclosed in commonly assigned U.S. patent application Ser. No. 08/592,826, filed concurrently herewith, now abandoned in favor of continuation-in-part application 08/739,921 typically do not contain a silver halide absorptive group. However, it is believed that the XY compounds disclosed herein may be weakly adsorbed to the silver halide.

ADVANTAGEOUS EFFECT OF THE INVENTION

This invention provides a silver halide photographic emulsion containing an organic electron donor capable of enhancing both the intrinsic sensitivity and, if a dye is present, the spectral sensitivity of the silver halide emulsion. The activity of these compounds can be easily varied with substituents to control their speed and fog effects in a manner appropriate to the particular silver halide emulsion in which they are used.

DETAILED DESCRIPTION OF THE INVENTION

The photographic element of this invention comprises a silver halide emulsion layer which contains a fragmentable electron donor of the formula X—Y, in which X is an electron donor moiety and Y is a leaving group. The fragmentable electron donor X—Y enhances the sensitivity of a silver halide emulsion.

The following represents the reactions believed to take place when the compound X—Y undergoes oxidation and fragmentation to produce a radical $X^{\cdot}$, which in a preferred embodiment undergoes further oxidation.

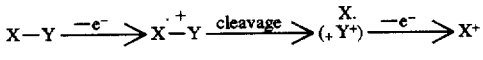

The structural features of the molecule X—Y are defined by the characteristics of the two parts, namely the fragment X and the fragment Y. The structural features of the fragment X determine the oxidation potential of the X—Y molecule and that of the radical $X^{\cdot}$, whereas both the X and Y fragments affect the fragmentation rate of the oxidized molecule $X—Y^{\cdot+}$.

Preferred X groups are of the general formula:

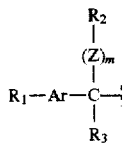

(I)

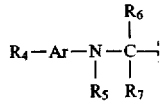

(II)

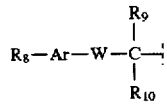

(III)

or

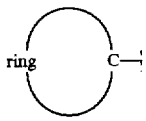

(IV)

The symbol "R" (that is R without a subscript) is used in all structural formulae in this patent application to represent a hydrogen atom or an unsubstituted or substituted alkyl group.

In structure (I)

m: 0, 1;

Z: O, S, Se, Te;

Ar: aryl group (e.g., phenyl, naphthyl, phenanthryl, anthryl); or heterocyclic group (e.g., pyridine, indole, benzimidazole, thiazole, benzothiazole, thiadiazole, etc.);

$R_1$: R, carboxyl, amide, sulfonamide, halogen, $NR_2$, $(OH)_n$, $(OR')_n$, or $(SR)_n$;

R': alkyl or substituted alkyl;

n: 1–3;

$R_2$: R, Ar';

$R_3$: R, Ar';

$R_2$ and $R_3$ together can form 5- to 8-membered ring;

$R_2$ and Ar: can be linked to form 5- to 8-membered ring;

$R_3$ and Ar: can be linked to form 5- to 8-membered ring;

Ar': aryl group such as phenyl, substituted phenyl, or heterocyclic group (e.g., pyridine, benzothiazole, etc.)

R: a hydrogen atom or an unsubstituted or substituted alkyl group.

In structure (II)

Ar: aryl group (e.g., phenyl, naphthyl, phenanthryl); or heterocyclic group (e.g., pyridine, benzothiazole, etc.);

$R_4$: a substituent having a Hammett sigma value of −1 to +1, preferably −0.7 to +0.7, e.g., R, OR, SR, halogen, CHO, C(O)R, COOR, $CONR_2$, $SO_3R$, $SO_2NR_2$, $SO_2R$, SOR, C(S)R, etc;

$R_5$: R, Ar'

$R_6$ and $R_7$: R, Ar'

$R_5$ and Ar: can be linked to form 5- to 8-membered ring;

$R_6$ and Ar: can be linked to form 5- to 8-membered ring (in which case, $R_6$ can be a hetero atom);

$R_5$ and $R_6$: can be linked to form 5- to 8-membered ring;

$R_6$ and $R_7$: can be linked to form 5- to 8-membered ring;

Ar': aryl group such as phenyl, substituted phenyl, heterocyclic group;

R: hydrogen atom or an unsubstituted or substituted alkyl group.

A discussion on Hammett sigma values can be found in C. Hansch and R. W. Taft *Chem. Rev.* Vol 91, (1991) p 165, the disclosure of which is incorporated herein by reference.

In structure (III):

W=O, S, Se;

Ar: aryl group (e.g., phenyl, naphthyl, phenanthryl, anthryl); or heterocyclic group (e.g., indole, benzimidazole, etc.)

$R_8$: R, carboxyl, $NR_2$, $(OR)_n$, or $(SR)_n$ (n=1–3);

$R_9$ and $R_{10}$: R, Ar';

$R_9$ and Ar: can be linked to form 5- to 8-membered ring;

Ar': aryl group such as phenyl substituted phenyl or heterocyclic group;

R: a hydrogen atom or an unsubstituted or substituted alkyl group.

In structure (IV)

"ring" represents a substituted or unsubstituted 5-, 6- or 7-membered unsaturated ring, preferrably a heterocyclic ring.

Since X is an electron donor moiety (i.e., an electron rich organic group), the substituents on the aromatic groups (Ar and/or Ar'), for any particular X group should be selected so that X remains electron rich. For example, if the aromatic group is highly electron rich, e.g. anthracene, electron withdrawing substituents can be used, providing the resulting X—Y compound has an oxidation potential of 0 to about 1.4 V. Conversely, if the aromatic group is not electron rich, electron donating substituents should be selected.

When reference in this application is made to a substituent "group" this means that the substituent may itself be substituted or unsubstituted (for example "alkyl group" refers to a substituted or unsubstituted alkyl). Generally, unless otherwise specifically stated, substituents on any "groups" referenced herein or where something is stated to be possibly substituted, include the possibility of any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo; alkoxy, particularly those with 1 to 12 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 12 carbon atoms; substituted and unsubstituted aryl, particularly those having from 6 to 20 carbon atoms (for example, phenyl); and substituted or unsubstituted heteroaryl, particularly those having a 5- or 6-membered ring containing 1 to 3 heteroatoms selected from N, O, S or Se (for example, pyridyl, thienyl, furyl, pyrrolyl and their corresponding benzo and naptho analogs); and others known in the art. Alkyl substituents preferably contain 1 to 12 carbon atoms and specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

The following are illustrative examples of the group X of the general structure I:

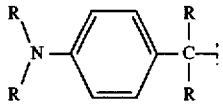

-continued

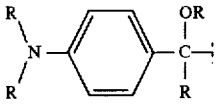

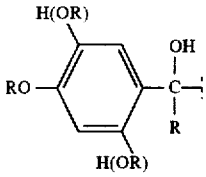

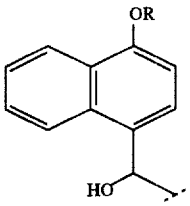

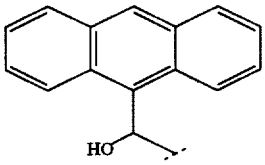

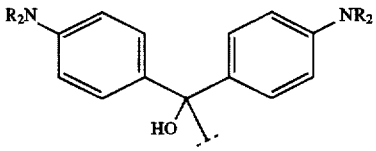

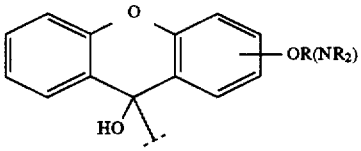

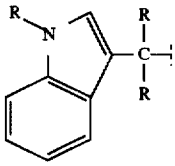

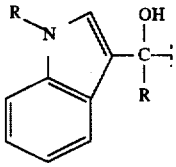

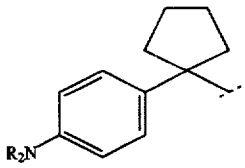

-continued

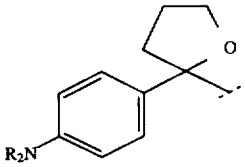

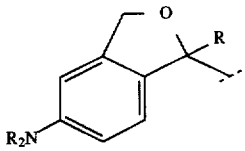

In the structures of this patent application a designation such as —OR($NR_2$) indicates that either —OR or —$NR_2$ can be present.

The following are illustrative examples of the group X of general structure II:

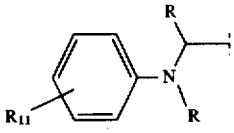

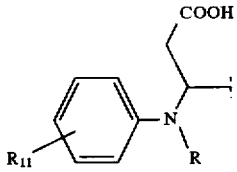

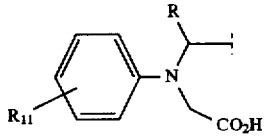

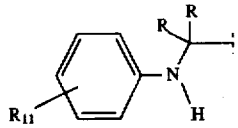

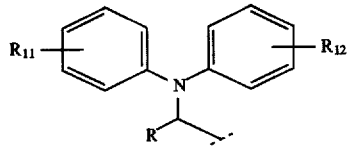

$R_{11}$ and $R_{12}$ = { H, alkyl, alkoxy, alkylthio, halo, carbamoyl, carboxyl, amido, formyl, sulfonyl, sulfonamido, nitrile }

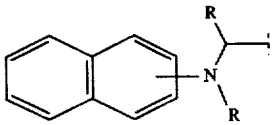

-continued

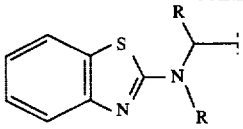

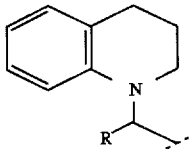

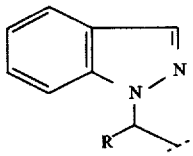

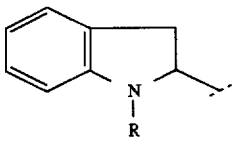

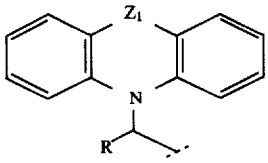

$Z_1$=a covalent bond, S, O, Se, NR, $CR_2$, CR=CR, or $CH_2CH_2$.

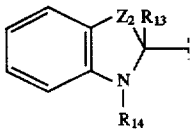

$Z_2$=S, O, Se, NR, $CR_2$, CR=CR, $R_{13}$, =alkyl, substituted alkyl or aryl, and $R_{14}$=H, alkyl substituted alkyl or aryl.

The following are illustrative examples of the group X of the general structure III:

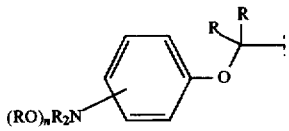

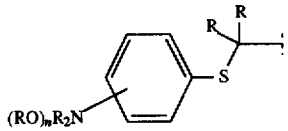

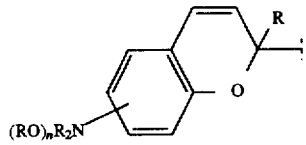

-continued

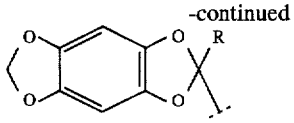

n = 1–3

The following are illustrative examples of the group X of the general structure IV:

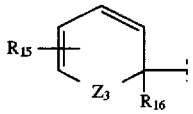

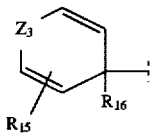

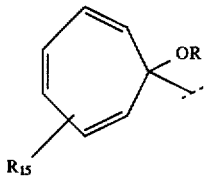

$Z_3$ = O, S, Se, NR
$R_{15}$ = R, OR, $NR_2$
$R_{16}$ = alkyl, substituted alkyl Preferred Y groups are:

(1) X', where X' is an X group as defined in structures I–IV and may be the same as or different from the X group to which it is attached (2)

$\vdash COO^-$ (3)

$\vdash M(R')_3$ where M=Si, Sn or Ge; and R'=alkyl or substituted alkyl (4)

$\vdash \bar{B}(Ar'')_3$ where Ar"=aryl or substituted aryl

In preferred embodiments of this invention Y is —$COO^-$ or —$Si(R')_3$ or —X'. Particularly preferred Y groups are —$COO^-$ or —$Si(R')_3$.

Preferred X—Y compounds are of the formula:

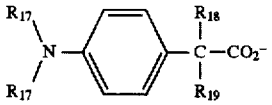

| Cpd. No. | $R_{17}$ | $R_{18}$ | $R_{19}$ |
|---|---|---|---|
| 1 | $CH_3$ | H | H |
| 2 | $C_2H_5$ | OH | H |

-continued

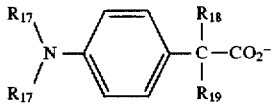

| Cpd. No. | $R_{17}$ | $R_{18}$ | $R_{19}$ |
|---|---|---|---|
| 3 | $CH_3$ | OH | H |
| 4 | $C_2H_5$ | OH | $CH_3$ |
| 5 | $CH_3$ | OH | $CH_3$ |
| 6 | $C_2H_5$ | $OCH_3$ | $CH_3$ |
| 7 | $CH_3$ | $OCH_3$ | $CH_3$ |
| 8 | $C_2H_5$ | $OCH_3$ | H |

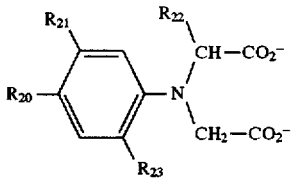

| Cpd. No. | $R_{20}$ | $R_{21}$ | $R_{22}$ | $R_{23}$ |
|---|---|---|---|---|
| 9 | $OCH_2CO_2^-$ | H | H | H |
| 10 | $OCH_3$ | H | H | H |
| 11 | $CH_3$ | H | H | H |
| 12 | Cl | H | H | H |
| 13 | H | H | H | H |
| 14 | H | H | $CH_3$ | H |
| 15 | $OCH_3$ | H | $CH_3$ | H |
| 16 | $CH(CH_3)C_2H_5$ | H | $CH_3$ | H |
| 17 | CHO | H | $CH_3$ | H |
| 18 | $SO_3^-$ | H | $CH_3$ | H |
| 19 | $SO_2N(C_2H_5)_2$ | H | $CH_3$ | H |
| 20 | $CH_3$ | H | $CH_3$ | H |
| 21 | $OCH_3$ | $OCH_3$ | H | H |
| 22 | H | H | H | $OCH_2CO_2^-$ |

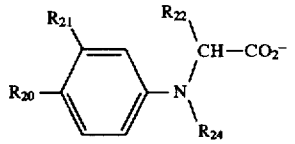

| Cpd. No. | $R_{20}$ | $R_{22}$ | $R_{24}$ | $R_{21}$ |
|---|---|---|---|---|
| 23 | $OCH_3$ | $CH_3$ | H | H |
| 24 | H | $CH_3$ | H | H |
| 25 | $CO_2^-$ | $CH_3$ | H | H |
| 26 | Cl | $CH_3$ | H | H |
| 27 | $CONH_2$ | $CH_3$ | H | H |
| 28 | $CO_2C_2H_5$ | $CH_3$ | H | H |
| 29 | $CH_3$ | $CH_2CO_2^-$ | H | H |
| 30 | H | $CH_2CO_2^-$ | H | H |
| 31 | $CO_2^-$ | $CH_2CO_2^-$ | H | H |
| 32 | H | $CH_3$ | H | $CONH_2$ |
| 33 | $CO_2^-$ | $CH_3$ | $CH_3$ | H |
| 34 | H | $CH_3$ | $C_2H_5$ | $CONH_2$ |
| 35 | $CH_3$ | $CH_3$ | $(CH_2)_3CH_3$ | H |
| 36 | $OCH_3$ | $CH_3$ | $(CH_2)_3CH_3$ | H |
| 37 | H | $CH_3$ | $(CH_2)_3CH_3$ | H |
| 38 | $CO_2^-$ | $CH_3$ | $(CH_2)_3CH_3$ | H |
| 39 | Cl | $CH_3$ | $(CH_2)_3CH_3$ | H |
| 40 | $CH_3$ | $CH_2CO_2^-$ | $(CH_2)_3CH_3$ | H |
| 41 | H | $CH_2CO_2^-$ | $(CH_2)_3CH_3$ | H |

-continued
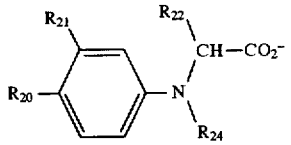
| Cpd. No. | $R_{20}$ | $R_{22}$ | $R_{24}$ | $R_{21}$ |
|---|---|---|---|---|
| Cpd. 42 | 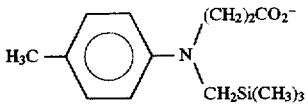 | | | |
| Cpd. 43 | 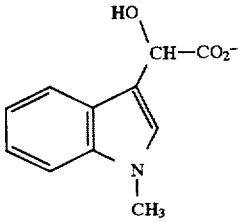 | | | |
| Cpd. 44 | 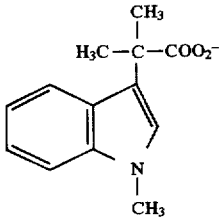 | | | |
| Cpd. 45 | 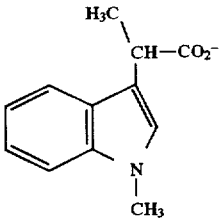 | | | |
| Cpd. 46 | 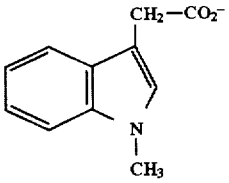 | | | |
| Cpd. 47 | 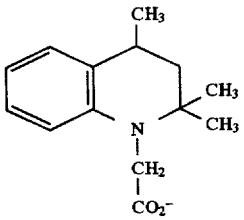 | | | |
| Cpd. 48 | 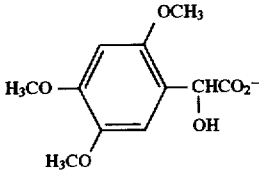 | | | |
-continued
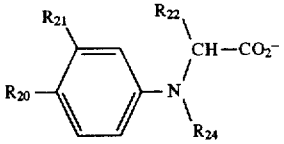
| Cpd. No. | $R_{20}$ | $R_{22}$ | $R_{24}$ | $R_{21}$ |
|---|---|---|---|---|
| Cpd. 49 | 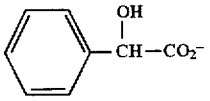 | | | |
| Cpd. 50 | 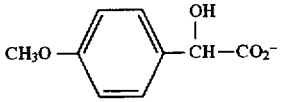 | | | |
| Cpd. 51 | 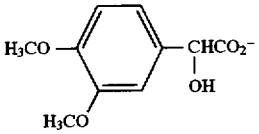 | | | |
| Cpd. 52 | 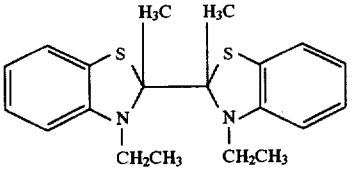 | | | |
| Cpd. 53 | 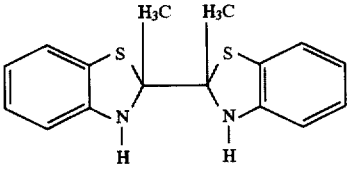 | | | |
| Cpd. 54 | 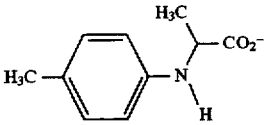 | | | |
| Cpd. 55 | 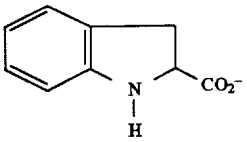 | | | |
| Cpd. 56 | 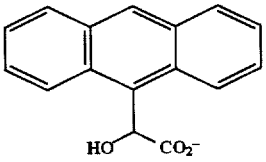 | | | |
| Cpd. 57 | 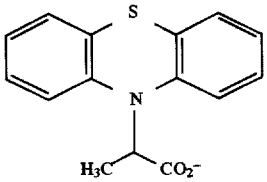 | | | |

-continued

| Cpd. No. | $R_{20}$ | $R_{22}$ | $R_{24}$ | $R_{21}$ |
|---|---|---|---|---|
| | 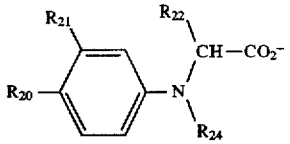 | | | |
| Cpd. 58 | 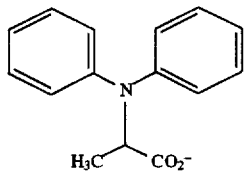 | | | |
| Cpd. 59 | 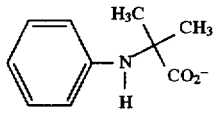 | | | |
| Cpd. 60 | 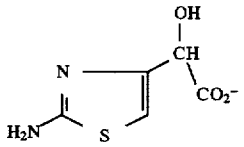 | | | |
| Cpd. 61 | 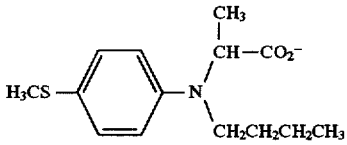 | | | |

In the above formulae, counterion(s) required to balance the charge of an X—Y compound are not shown, as any counterion can be utilized. Common counterions that can be used include sodium, potassium, triethylammonium ($TEA^+$), tetramethylguanidinium ($TMG^+$), diisopropylammonium ($DIPA^+$), and tetrabutylammonium ($TBA^+$).

Preferred embodiments of the invention comprise photographic elements in which the X—Y compound is of structure V, VI or VII as set forth below:

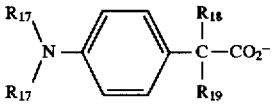

(V)

where $R_{17}$ is alkyl, $R_{18}$ is H, OH or alkoxy and $R_{19}$ is H or alkyl;

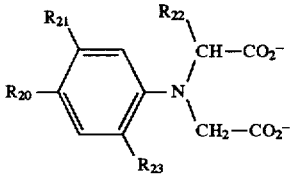

(VI)

where $R_{20}$ and $R_{21}$ are each independently H, alkyl, alkoxy, alkylthio, halo, carbamoyl, carboxy, amide, formyl, sulfonyl, sulfonamide or nitrile; $R_{22}$ is H, alkyl or $CH_2CO_2$— and $R_{23}$ is H or $OCH_2CO_2$—; or

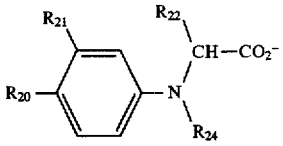

(VII)

where $R_{20}$ and $R_{21}$ are each independently H, alkyl, alkoxy, alkylthio, halo, carbamoyl, carboxy, amide, formyl, sulfonyl, sulfonamide or nitrile; $R_{22}$ is H, alkyl, or $CH_2CO_2$—; $R_{24}$ is H, alkyl or substituted alkyl.

Fragmentable electron donors X—Y can be fragmentable one-electron donors which meet the first two criteria set forth below or fragmentable two-electron donors which meet all three criteria set forth below. The first criterion relates to the oxidation potential of X—Y ($E_1$). $E_1$ is preferably no higher than about 1.4 V and preferably less than about 1.0 V. The oxidation potential is preferably greater than 0, more preferably greater than about 0.3 V. $E_1$ is preferably in the range of about 0 to about 1.4 V, and more preferably from about 0.3 V to about 1.0 V.

Oxidation potentials are well known and can be found, for example, in "Encyclopedia of Electrochemistry of the Elements", Organic Section, Volumes XI–XV, A. Bard and H. Lund (Editors) Marcel Dekkar Inc., N.Y. (1984). $E_1$ can be measured by the technique of cyclic voltammetry. In this technique, the electron donor is dissolved in a solution of 80%/20% by volume acetonitrile to water containing 0.1M lithium perchlorate. Oxygen is removed from the solution by passing nitrogen gas through the solution for 10 minutes prior to measurement. A glassy carbon disk is used for the working electrode, a platinum wire is used for the counter electrode, and a saturated calomel electrode (SCE) is used for the reference electrode. Measurement is conducted at 25° C. using a potential sweep rate of 0.1 V/sec. The oxidation potential vs. SCE is taken as the peak potential of the cyclic voltammetric wave. $E_1$ values for typical X—Y compounds useful in accordance with this invention are given in Table A.

TABLE A

Oxidation Potential of X—Y

| Compound | $E_1$ (V vs SCE) | Compound | $E_1$ (V vs SCE) |
|---|---|---|---|
| 1 | 0.53 | 30 | 0.60 |
| 2 | 0.50 | 26 | 0.51 |
| 5 | 0.51 | 27 | 0.62 |
| 4 | 0.49 | 38 | 0.48 |
| 7 | 0.52 | 39 | 0.40 |
| 6 | 0.51 | 41 | 0.48 |
| 8 | 0.49 | 34 | 0.52 |
| 48 | 0.70 | 28 | 0.61 |
| 51 | 0.91 | 17 | 0.74 |
| 49 | ~1.2 | 18 | 0.70 |
| 50 | ~1.05 | 19 | 0.68 |
| 43 | 0.61 | 31 | 0.61 |
| 44 | 0.64 | 22 | 0.65 |
| 45 | 0.64 | 59 | 0.53 |
| 46 | 0.68 | 56 | 0.65 |
| 42 | 0.30 | 57 | 0.49 |
| 9 | 0.38 | 58 | 0.49 |
| 10 | 0.38 | 52 | 0.07 |
| 11 | 0.46 | | |
| 23 | 0.37 | | |
| 20 | 0.46 | 54 | 0.44 |
| 14 | 0.50 | | |
| 15 | 0.36 | | |
| 16 | 0.47 | | |
| 36 | 0.22 | | |
| 29 | 0.52 | | |

TABLE A-continued

| Compound | Oxidation Potential of X—Y $E_1$ (V vs SCE) | Compound | $E_1$ (V vs SCE) |
|---|---|---|---|
| 40 | 0.38 | | |
| 35 | 0.34 | | |
| 25 | 0.62 | | |
| 33 | 0.54 | | |
| 13 | 0.54 | | |
| 12 | 0.58 | | |
| 21 | 0.36 | | |
| 24 | 0.52 | | |
| 37 | 0.43 | | |
| 32 | 0.58 | | |
| 60 | 0.80 | | |

The second criterion defining the compounds useful in accordance with our invention is the requirement that the oxidized form of X—Y, that is the radical cation $X—Y^{+\bullet}$, undergoes a bond cleavage reaction, other than deprotonation, to give the radical $X^{\bullet}$ and the neutral fragment $Y^{+}$ (or in the case of an anionic compound the radical $X^{\bullet}$ and the fragment Y). This bond cleavage reaction is also referred to herein as "fragmentation". It is widely known that radical species, and in particular radical cations, formed by a one-electron oxidation reaction may undergo a multitude of reactions, some of which are dependent upon their concentration and on the specific environment wherein they are produced. As described in "Kinetics and Mechanisms of Reactions of Organic Cation Radicals in Solution", Advances in Physical Organic Chemistry, vol 20, 1984, pp 55–180, and "Formation, Properties and Reactions of Cation Radicals in Solution", Advances in Physical Organic Chemistry, vol 13, 1976, pp 156–264, V. Gold Editor, 1984, published by Academic Press, N.Y., the range of reactions available to such radical species includes: dimerization, deprotonation, nucleophilic substitution, disproportionation, and bond cleavage. With compounds useful in accordance with our invention, the oxidized form of X—Y undergoes a bond cleavage reaction.

The kinetics of the bond cleavage or fragmentation reaction can be measured by conventional laser flash photolysis. The general technique of laser flash photolysis as a method to study properties of transient species is well known (see, for example, "Absorption Spectroscopy of Transient Species" W. Herkstroeter and I. R. Gould in Physical Methods of Chemistry Series, second Edition, Volume 8, page 225, edited by B. Rossiter and R. Baetzold, John Wiley & Sons, New York, 1993). The specific experimental apparatus we used to measure fragmentation rate constants and radical oxidation potentials is described in detail below. The rate constant of fragmentation in compounds useful in accordance with this invention is preferably faster than about 0.1 per second (i.e., 0.1 $s^{-1}$ or faster, or, in other words, the lifetime of the radical cation $X—Y^{+\bullet}$ should be 10 sec or less). The fragmentation rate constants can be considerably higher than this, namely in the $10^2$ to $10^{13}$ $s^{-1}$ range. The fragmentation rate constant is preferably about 0.1 $sec^{-1}$ to about $10^{13}$ $s^{-1}$, more preferably about $10^2$ to about $10^{11}$ $s^{-1}$. Fragmentation rate constants $k_{fr}$ ($s^{-1}$) for typical compounds useful in accordance with our invention are given in Table B.

TABLE B

Rate Constants for Decarboxylation of Radical Cations in $CH_3CN/H_2O$ (4:1)

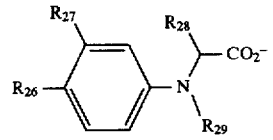

| COMP'D | $R_{26}$ | $R_{27}$ | $R_{28}$ | $R_{29}$ | $k_{fr}$ ($s^{-1}$) |
|---|---|---|---|---|---|
| 14 | H | H | Me | $CH_2CO_2^-$ | $>2.0 \times 10^7$ |
| 13 | H | H | H | $CH_2CO_2^-$ | $1.7 \times 10^7$ |
| 20 | Me | H | Me | $CH_2CO_2^-$ | $8.1 \times 10^6$ |
| 11 | Me | H | H | $CH_2CO_2^-$ | $1.6 \times 10^6$ |
| 15 | OMe | H | Me | $CH_2CO_2^-$ | $9.0 \times 10^4$ |
| 10 | OMe | H | H | $CH_2CO_2^-$ | $9.3 \times 10^3$ |
| 21 | OMe | OMe | H | $CH_2CO_2^-$ | $1 \times 10^3$ |
| 36 | OMe | H | Me | n-Bu | $1.1 \times 10^6$ |
| 40 | Me | H | $CH_2CO_2^-$ | n-Bu | $1.3 \times 10^7$ |
| 29 | Me | H | $CH_2CO_2^-$ | H | $5.4 \times 10^6$ |
| 54 | Me | H | Me | H | $1.4 \times 10^7$ |

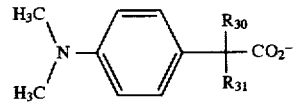

| COMPOUND | $R_{30}$ | $R_{31}$ | $k_{fr}$ ($s^{-1}$) |
|---|---|---|---|
| 3 | OH | Me | $5.5 \times 10^5$ |
| 1 | H | H | $\sim 3.0 \times 10^5$ |

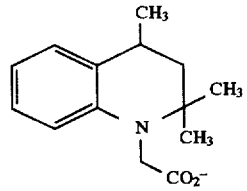

| COMPOUND | $k_{fr}$ ($s^{-1}$) |
|---|---|
| 47 | $>10^7$ |

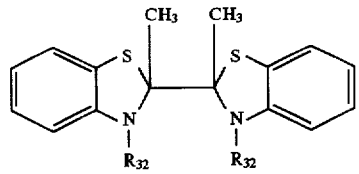

| COMPOUND | $R_{32}$ | $k_{fr}$ ($s^{-1}$) |
|---|---|---|
| 52 | H | $>10^9$ |
| 53 | Et | $>10^9$ |

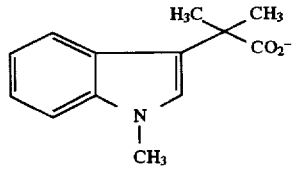

| COMPOUND | $k_{fr}$ ($s^{-1}$) |
|---|---|
| 44 | $5.3 \times 10^5$ |

TABLE B-continued

Rate Constants for Decarboxylation of Radical Cations in $CH_3CN/H_2O$ (4:1)

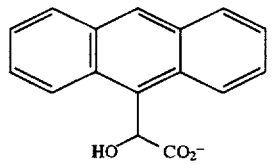

| COMPOUND | $k_{fr}$ ($s^{-1}$) |
|---|---|
| 56 | $1.2 \times 10^5$ |

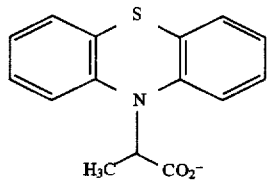

| COMPOUND | $k_{fr}$ ($s^{-1}$) |
|---|---|
| 57 | ca. $1 \times 10^5$ |

In a preferred embodiment of the invention, the X—Y compound is a fragmentable two-electron donor and meets a third criterion, that the radical $X^{\bullet}$ resulting from the bond cleavage reaction has an oxidation potential equal to or more negative than −0.7V, preferably more negative than about −0.9 V. This oxidation potential is preferably in the range of from about −0.7 to about −2 V, more preferably from about −0.8 to about −2 V and most preferably from about −0.9 to about −1.6 V.

The oxidation potential of many radicals have been measured by transient electrochemical and pulse radiolysis techniques as reported by Wayner, D. D.; McPhee, D. J.; Griller, D. in *J. Am. Chem. Soc.* 1988, 110, 132; Rao, P. S.; Hayon, E. *J. Am. Chem. Soc.* 1974, 96, 1287 and Rao, P. S.; Hayon, E. *J. Am. Chem. Soc.* 1974, 96, 1295. The data demonstrate that the oxidation potentials of tertiary radicals are less positive (i.e., the radicals are stronger reducing agents) than those of the corresponding secondary radicals, which in turn are more negative than those of the corresponding primary radicals. For example, the oxidation potential of benzyl radical decreases from 0.73V to 0.37 V to 0.16 V upon replacement of one or both hydrogen atoms by methyl groups.

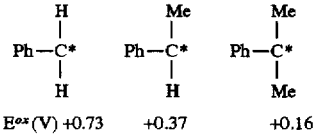

| | | |
|---|---|---|
| $E^{ox}$(V) +0.73 | +0.37 | +0.16 |

A considerable decrease in the oxidation potential of the radicals is achieved by α hydroxy or alkoxy substituents. For example the oxidation potential of the benzyl radical (+0.73 V) decreases to −0.44 when one of the α hydrogen atoms is replaced by a methoxy group.

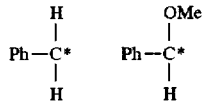

| | |
|---|---|
| $E^{ox}$(V) +0.73 | −0.44 |

An α-amino substituent decreases the oxidation potential of the radical to values of about −1 V.

In accordance with our invention we have discovered that compounds which provide a radical $X^{\bullet}$ having an oxidation potential more negative than −0.7 are particularly advantageous for use in sensitizing silver halide emulsions. As set forth in the above-noted articles, the substitution at the α carbon atom influences the oxidation potential of the radical. We have found that substitution of the phenyl moiety with at least one-electron donating substituent or replacement of the phenyl with an electron donating aryl or heterocyclic group also influences the oxidation potential of $X^{\bullet}$. Illustrative examples of $X^{\bullet}$ having an oxidation potential more negative than −0.7 are given below in Table C. The oxidation potential of the transient species $X^{\bullet}$, can be determined using a laser flash photolysis technique as described in greater detail below.

In this technique, the compound X—Y is oxidized by an electron transfer reaction initiated by a short laser pulse. The oxidized form of X—Y then undergoes the bond cleavage reaction to give the radical $X^{\bullet}$. $X^{\bullet}$ is then allowed to interact with various electron acceptor compounds of known reduction potential. The ability of $X^{\bullet}$ to reduce a given electron acceptor compound indicates that the oxidation potential of $X^{\bullet}$ is nearly equal to or more negative than the reduction potential of that electron acceptor compound. The experimental details are set forth more fully below. The oxidation potentials ($E_2$) for radicals $X^{\bullet}$ for typical compounds useful in accordance with our invention are given in Table C. Where only limits on potentials could be determined, the following notation is used: <−0.90 V should be read as "more negative than −0.90 V" and >−0.40 V should be read as "less negative than −0.40 V".

Illustrative $X^{\bullet}$ radicals useful in accordance with the third criterion of our invention are those given below having an oxidation potential $E_2$ more negative than −0.7 V. Some comparative examples with $E_2$ less negative than −0.7 V are also included.

TABLE C

Oxidation Potentials of Radicals ($X^*$), $E_2$

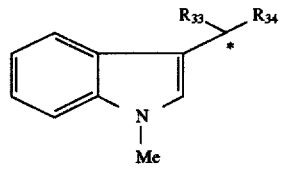

| Parent X—Y compound | $R_{33}$ | $R_{34}$ | $E_2$ |
|---|---|---|---|
| 46 | H | H | −0.34 |
| 45 | Me | H | −0.56 |
| 44 | Me | Me | −0.81 |
| 43 | OH | H | −0.89 |

TABLE C-continued

Oxidation Potentials of Radicals (X*), $E_2$

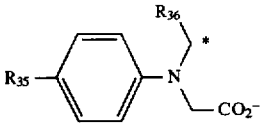

| Parent X—Y compound | $R_{35}$ | $R_{36}$ | $E_2$ |
|---|---|---|---|
| 13 | H | H | —0.85 |
| 14 | H | Me | <–0.9 |
| 11 | Me | H | —0.9 |
| 16 | i-Bu | H | —0.9 |
| 20 | Me | Me | <–0.9 |
| 10 | OMe | H | <–0.9 |
| 15 | OMe | Me | <–0.9 |

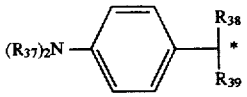

| Parent X—Y compound | $R_{37}$ | $R_{38}$ | $R_{39}$ | $E_2$ |
|---|---|---|---|---|
| 8 | Et | H | OMe | —0.85 |
| 2 | Et | H | OH | <–0.9 |
| 7 | Me | Me | OMe | <–0.9 |
| 5 | Me | Me | OH | <–0.9 |
| 1 | Me | H | H | >–0.5 |

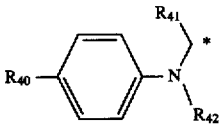

| Parent X—Y compound | $R_{40}$ | $R_{41}$ | $R_{42}$ | $E_2$ |
|---|---|---|---|---|
| 36 | OMe | Me | n-Bu | <–0.9 |
| 33 | $CO_2^-$ | Me | Me | <–0.9 |

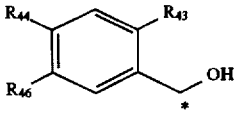

| Parent X—Y compound | $R_{44}$ | $R_{43}$ | $R_{46}$ | $E_2$ |
|---|---|---|---|---|
| 48 | OMe | OMe | OMe | <–0.9 |
| 51 | OMe | H | OMe | <–0.9 |
| 49 | H | H | H | –0.75 |
| 50 | OMe | H | H | <–0.9 |

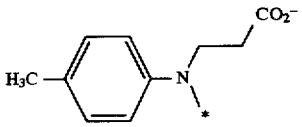

| Parent X—Y compound | $E_2$ |
|---|---|
| 42 | —0.9 |

TABLE C-continued

Oxidation Potentials of Radicals (X*), $E_2$

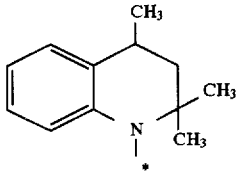

| Parent X—Y compound | $E_2$ |
|---|---|
| 47 | <–0.9 |

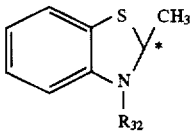

| Parent X—Y compound | $R_{32}$ | $E_2$ |
|---|---|---|
| 52 | H | <–0.9 |
| 53 | Et | <–0.9 |

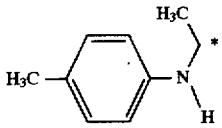

| Parent X—Y compound | $E_2$ |
|---|---|
| 54 | <–0.9 |

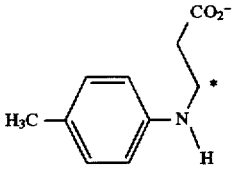

| Parent X—Y compound | $E_2$ |
|---|---|
| 29 | <–0.9 |

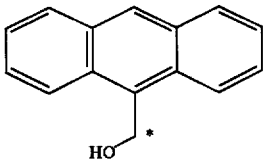

| Parent X—Y compound | $E_2$ |
|---|---|
| 56 | <–0.9 |

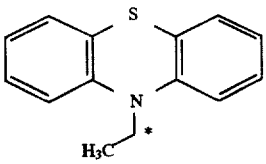

TABLE C-continued

| Oxidation Potentials of Radicals (X*), $E_2$ | |
|---|---|
| Parent X—Y compound | $E_2$ |
| 57 | <–0.9 |

Table D combines electrochemical and laser flash photolysis data for selected fragmentable electron donors. Specifically, this Table contains data for $E_1$, the oxidation potential of the parent fragmentable electron donor X—Y; $k_{fr}$, the fragmentation rate constant of the oxidized X—Y (i.e., $X—Y^{\cdot+}$); and $E_2$, the oxidation potential of the radical $X^{\cdot}$. The data in Table D illustrate X—Y compounds useful in this invention which are fragmentable two-electron donors and meet all the three criteria set forth above as well as fragmentable one-electron donor compounds useful in this invention which meet the first two criteria, but produce a radical $X^{\cdot}$ having an oxidation potential $E_2$ less negative than –0.7 V.

TABLE D

| Compound | $E_1$ (V) | $k_{fr}$ ($s^{-1}$) | $E_2$ (V) |
|---|---|---|---|
| 5 | .55 | $5.5 \times 10^5$ | <–0.9 |
| 44 | .64 | $5.3 \times 10^5$ | –0.81 |
| 43 | .61 | $>2 \times 10^5$ | –0.9 |
| 22 | .65 | $4.0 \times 10^5$ | <–0.9 |
| 13 | .58 | $1.7 \times 10^7$ | —0.85 |
| 14 | ~.54 | $>2.0 \times 10^7$ | <–0.9 |
| 11 | .50 | $1.6 \times 10^6$ | —0.9 |
| 20 | .50 | $8.1 \times 10^6$ | <–0.9 |
| 10 | .42 | $9.3 \times 10^3$ | <–0.9 |
| 15 | .40 | $9.0 \times 10^4$ | <–0.9 |
| 36 | .26 | $1.1 \times 10^6$ | <–0.9 |
| 52 | 0.07 | $>10^9$ | <–0.9 |
| 48 | 0.70 | $>2 \times 10^5$ | <–0.9 |
| 49 | 1.2 | $>10^7$ | –0.75 |
| 50 | 1.05 | $>10^7$ | <–0.9 |
| 42 | .34 | $8 \times 10^4$ | —0.9 |
| 54 | 0.44 | $1.4 \times 10^7$ | <–0.9 |
| 29 | 0.52 | $5.4 \times 10^6$ | <–0.9 |
| 56 | 0.65 | $1.2 \times 10^5$ | <–0.9 |
| 57 | 0.49 | $1 \times 10^5$ | <–0.9 |
| 58 | 0.49 | $>10^7$ | <–0.9 |
| 1 | 0.57 | $\sim 3 \times 10^5$ | >–0.5 |
| 45 | 0.64 | $>2 \times 10^5$ | –0.56 |
| 46 | 0.67 | $>2 \times 10^5$ | —0.34 |

The following Table D(a) sets forth several comparative compounds (designated Comp-1 through Comp-6) which are similar in structure to compounds listed in Table D, but which do not fragment.

TABLE D(a)

| No. | Structure | $E_1$ (v) | $k_{fr}$ ($S^{-1}$) | $E_2$ (v) |
|---|---|---|---|---|
| Comp-1 | 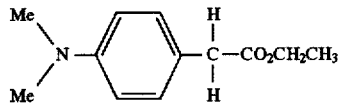 | 0.75 | does not fragment | — |
| Comp-2 | 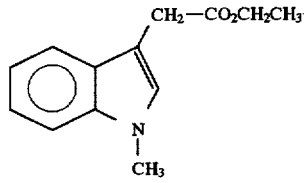 | 1.02 | does not fragment | — |
| Comp-3 | 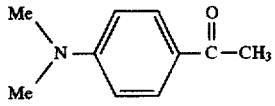 | 0.98 | does not fragment | — |
| Comp-4 | 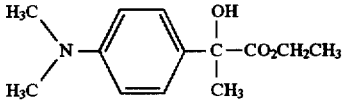 | 0.78 | does not fragment | — |
| Comp-5 | 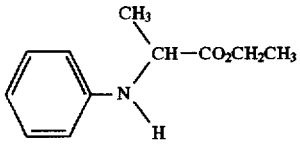 | 0.90 | does not fragment | — |

TABLE D(a)-continued

| No. | Structure | $E_1$ (v) | $k_f$ ($S^{-1}$) | $E_2$ (v) |
|---|---|---|---|---|
| Comp-6 | 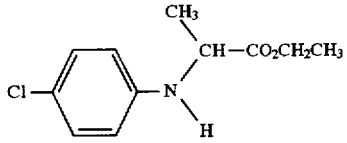 | 0.97 | does not fragment | — |

The fragmentable electron donors useful in this invention are vastly different from the silver halide adsorptive (one)-electron donating compounds described in U.S. Pat. No. 4,607,006. The electron donating moieties described therein, for example phenothiazine, phenoxazine, carbazole, dibenzophenothiazine, ferrocene, tris(2,2'-bipyridyl) ruthenium, or a triarylamine are well known for forming extremely stable, i.e., non-fragmentable, radical cations as noted in the following references: J. Heterocyclic Chem., vol. 12, 1975, pp 397–399, J. Org. Chem., vol 42, 1977, pp 983–988, "The Encyclopedia of Electrochemistry of the Elements", Vol XIII, pp 25–33, A. J. Bard Editor, published by Marcel Dekker Inc., Advances in Physical Organic Chemistry, vol 20 , pp 55–180, V. Gold Editor, 1984, published by Academic Press, N.Y. Also, the electron donating adsorptive compounds of U.S. Pat. No. 4,607,006 donate only one electron per molecule upon oxidation. In a preferred embodiment of the present invention, the fragmentable electron donors are capable of donating two electrons.

The fragmentable electron donors of the present invention also differ from other known photographically active compounds such as R-typing agents, nucleators, and stabilizers. Known R-typing agents, such as Sn complexes, thiourea dioxide, borohydride, ascorbic acid, and amine boranes are very strong reducing agents. These agents typically undergo multi-electron oxidations but have oxidation potentials more negative than 0 V vs SCE. For example the oxidation potential for $SnCl_2$ is reported in CRC Handbook of Chemistry and Physics, 55th edition, CRC Press Inc., Cleveland Ohio 1975, pp D122 to be —0.10 V and that for borohydride is reported in J. Electrochem. Soc., 1992, vol. 139, pp 2212–2217 to be –0.48 V vs SCE. These redox characteristics allow for an uncontrolled reduction of silver halide when added to silver halide emulsions, and thus the obtained sensitivity improvements are very often accompanied by undesirable levels of fog. Conventional nucleator compounds such as hydrazines and hydrazides differ from the fragmentable electron donors described herein in that nucleators are usually added to photographic emulsions in an inactive form. Nucleators are transformed into photographically active compounds only when activated in a strongly basic solution, such as a developer solution, wherein the nucleator compound undergoes a deprotonation or hydrolysis reaction to afford a strong reducing agent. In further contrast to the fragmentable electron donors, the oxidation of traditional R-typing agents and nucleator compounds is generally accompanied by a deprotonation reaction or a hydroylsis reaction, as opposed to a bond cleavage reaction.

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1994, Number 365, Item 36544, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds which may be useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t >8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers (μm). The tabular grains can be of any thickness compatible with achieving an aim average aspect ratio and/or average tabularity of the tabular grain emulsion. Preferably the tabular grains satisfying projected area requirements are those having thicknesses of <0.3 μm, thin (<0.2 μm) tabular grains being specifically preferred and ultrathin (<0.07 μm) tabular grains being contemplated for maximum tabular grain performance enhancements. When the native blue absorption of iodohalide tabular grains is relied upon for blue speed, thicker tabular grains, typically up to 0.5 μm in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B. (3) (page 503).

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc. at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure*, Item 36544, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Discolosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30° to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process*, 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972, Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

The fragmentable electron donors of the present invention can be included in a silver halide emulsion by direct dispersion in the emulsion, or they may be dissolved in a solvent such as water, methanol or ethanol for example, or in a mixture of such solvents, and the resulting solution can be added to the emulsion. The compounds of the present invention may also be added from solutions containing a base and/or surfactants, or may be incorporated into aqueous slurries or gelatin dispersions and then added to the emulsion. The fragmentable electron donor may be used as the sole sensitizer in the emulsion. However, in preferred embodiments of the invention a sensitizing dye is also added to the emulsion. The compounds can be added before, during or after the addition of the sensitizing dye. The amount of electron donor which is employed in this invention may range from as little as $1\times10^{-8}$ mole per mole of silver in the emulsion to as much as about 0.1 mole per mole of silver, preferably from about $5\times10^{-7}$ to about 0.05 mole per mole of silver. Where the fragmentable two-electron donor has a relatively lower potential it is more active, and relatively less agent need be employed. Conversely, where the fragmentable two-electron donor has a relatively higher first oxidation potential a larger amount thereof, per mole of silver, is employed. For fragmentable one-electron donors relatively larger amounts per mole of silver are also employed. Although it is preferred that the fragmentable electron donor be added to the silver halide emulsion prior to manufacture of the coating, in certain instances, the electron donor can also be incorporated into the emulsion after exposure by way of a pre-developer bath or by way of the developer bath itself.

Spectral sensitizing dyes can be used together with the fragmentable electron donor of this invention. Preferred sensitizing dyes that can be used are cyanine, merocyanine, styryl, hemicyanine, or complex cyanine dyes.

Illustrative sensitizing dyes that can be used are dyes of the following general structures (VIII) through (XII):

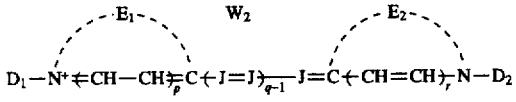

(VIII)

wherein:

$E_1$ and $E_2$ represent the atoms necessary to form a substituted or unsubstituted hetero ring and may be the same or different, each J independently represents a substituted or unsubstituted methine group, q is a positive integer of from 1 to 4, p and r each independently represents 0 or 1, $D_1$ and $D_2$ each independently represents substituted or unsubstituted alkyl or unsubstituted aryl, and $W_2$ is a counterion as necessary to balance the charge;

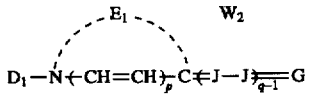

(IX)

wherein $E_1$, $D_1$, J, p, q and $W_2$ are as defined above for formula (VIII) and G represents

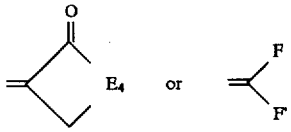

wherein $E_4$ represents the atoms necessary to complete a substituted or unsubstituted heterocyclic nucleus, and F and F' each independently represents a cyano radical, an ester radical, an acyl radical, a carbamoyl radical or an alkylsulfonyl radical;

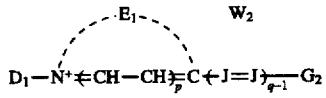

(X)

wherein $D_1$, $E_1$, J, p, q and $W_2$ are as defined above for formula (VIII), and $G_2$ represents a substituted or unsubstituted amino radical or a substituted or unsubstituted aryl radical;

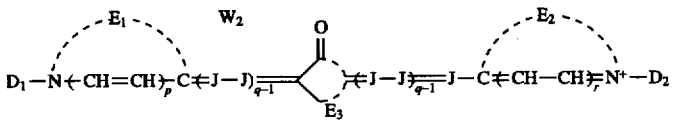

(XI)

wherein $D_1$, $E_1$, $D_2$, $E_1$, J, p, q, r and $W_2$ are as defined for formula (VIII) above, and $E_3$ is defined the same as $E_4$ for formula (IX) above;

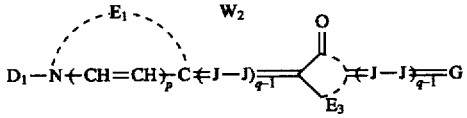

(XII)

wherein $D_1$, $E_1$, J, G, p, q, r and $W_2$ are as defined above for formula (VIII) above and $E_3$ is as defined for formula (XI) above.

In the above formulas, $E_1$ and $E_2$ each independently represents the atoms necessary to complete a substituted or unsubstituted 5- or 6-membered heterocyclic nucleus. These include a substituted or unsubstituted: thiazole nucleus, oxazole nucleus, selenazole nucleus, quinoline nucleus, tellurazole nucleus, pyridine nucleus, thiazoline nucleus, indoline nucleus, oxadiazole nucleus, thiadiazole nucleus, or imidazole nucleus. This nucleus may be substituted with known substituents, such as halogen (e.g., chloro, fluoro, bromo), alkoxy (e.g., methoxy, ethoxy), substituted or unsubstituted alkyl (e.g., methyl, trifluoromethyl), substituted or unsubstituted aryl, substituted or unsubstituted aralkyl, sulfonate, and others known in the art.

In one embodiment of the invention, when dyes according to formula (VIII) are used $E_1$ and $E_2$ each independently represent the atoms necessary to complete a substituted or unsubstituted thiazole nucleus, a substituted or unsubstituted selenazole nucleus, a substituted or unsubstituted imidazole nucleus, or a substituted or unsubstituted oxazole nucleus.

Examples of useful nuclei for $E_1$ and $E_2$ include: a thiazole nucleus, e.g., thiazole, 4-methylthiazole, 4-phenylthiazole, 5-methylthiazole, 5-phenylthiazole, 4,5-dimethyl-thiazole, 4,5-diphenylthiazole, 4-(2-thienyl) thiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-phenylbenzothiazole, 6-phenylbenzothiazole, 4-methoxybenzothiazole, 5-methoxybenzothiazole, 6-methoxybenzothiazole, 4-ethoxybenzothiazole, 5-ethoxybenzothiazole, tetrahydrobenzothiazole, 5,6-dimethoxybenzothiazole, 5,6-dioxymethylbenzothiazole, 5-hydroxybenzothiazole, 6-5-hydroxybenzothiazole, naphtho[2,1-d]thiazole, 5-ethoxynaphtho[2,3-d]thiazole, 8-methoxynaphtho[2,3-d]thiazole, 7-methoxynaphtho[2,3-d]thiazole, 4'-methoxythianaphtheno-7', 6'-4,5-thiazole, etc.; an oxazole nucleus, e.g., 4-methyloxazole, 5-methyloxazole, 4-phenyloxazole, 4,5-diphenyloxazole, 4-ethyloxazole, 4,5-dimethyloxazole, 5-phenyloxazole, benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole, 5-ethoxybenzoxazole, 5-chlorobenzoxazole, 6-methoxybenzoxazole, 5-hydroxybenzoxazole, 6-hydroxybenzoxazole, naphtho[2,1-d]oxazole, naphtho[1,2-d]oxazole, etc.; a selenazole nucleus, e.g., 4-methylselenazole, 4-phenylselenazole, benzoselenazole, 5-chlorobenzoselenazole, 5-methoxybenzoselenazole, 5-hydroxybenzoselenazole, tetrahydrobenzoselenazole, naphtho[2,1-d]selenazole, naphtho[1,2-d]selenazole, etc.; a pyridine nucleus, e.g., 2-pyridine, 5-methyl-2-pyridine, 4-pyridine, 3-methyl-4-pyridine, 3-methyl-4-pyridine, etc.; a quinoline nucleus, e.g., 2-quinoline, 3-methyl-2-quinoline, 5-ethyl-2-quinoline, 6-chloro-2-quinoline, 8-chloro-2-quinoline, 6-methoxy-2-quinoline, 8-ethoxy-2-quinoline, 8-hydroxy-2-quinoline, 4-quinoline, 6-methoxy-4-quinoline, 7-methyl-4-quinoline, 8-chloro-4-quinoline, etc.; a tellurazole nucleus, e.g., benzotellurazole, naphtho[1,2-d] benzotellurazole, 5,6-dimethoxybenzotellurazole, 5-methoxybenzotellurazole, 5-methylbenzotellurazole; a thiazoline nucleus, e.g.,thiazoline, 4-methylthiazoline, etc.; a benzimidazole nucleus, e.g., benzimidazole, 5-trifluoromethylbenzimidazole, 5,6-dichlorobenzimidazole; and indole nucleus, 3,3-dimethylindole, 3,3-diethylindole, 3,3,5-trimethylindole; or a diazole nucleus, e.g., 5-phenyl-1,3,4-oxadiazole, 5-methyl-1,3,4-thiadiazole.

F and F' are each a cyano radical, an ester radical such as ethoxy carbonyl, methoxycarbonyl, etc., an acyl radical, a carbamoyl radical, or an alkylsulfonyl radical such as ethylsulfonyl, methylsulfonyl, etc. Examples of useful nuclei for $E_4$ include a 2-thio-2,4-oxazolidinedione nucleus (i.e., those of the 2-thio-2,4-(3H,5H)-oxaazolidinone series) (e.g., 3-ethyl-2-thio-2,4 oxazolidinedione, 3-(2-sulfoethyl)-2-thio-2,4 oxazolidinedione, 3-(4-sulfobutyl)-2-thio-2,4 oxazolidinedione, 3-(3-carboxypropyl)-2-thio-2,4 oxazolidinedione, etc.; a thianaphthenone nucleus (e.g., 2-(2H)-thianaphthenone, etc.), a 2-thio-2,5-thiazolidinedione nucleus (i.e., the 2-thio-2,5-(3H,4H)-thiazoledeione series) (e.g., 3-ethyl-2-thio-2,5-thiazolidinedione, etc.); a 2,4-thiazolidinedione nucleus (e.g., 2,4-thiazolidinedione, 3-ethyl-2,4-thiazolidinedione, 3-phenyl-2,4-thiazolidinedione, 3-u-naphthyl-2,4-thiazolidinedione, etc.); a thiazolidinone nucleus (e.g., 4-thiazolidinone, 3-ethyl-4-thiazolidinone, 3-phenyl-4-thiazolidinone, 3-α-naphthyl-4-thiazolidinone, etc.); a 2-thiazolin-4-one series (e.g., 2-ethylmercapto-2-thiazolin-4-one, 2-alkylphenyamino-2-thiazolin-4-one, 2-diphenylamino-2-thiazolin-4-one, etc.) a 2-imino-4-oxazolidinone (i.e., pseudohydantoin) series (e.g., 2,4-imidazolidinedione (hydantoin) series (e.g., 2,4-imidazolidinedione, 3-ethyl-2,4-imidazolidinedione, 3-phenyl-2,4-imidazolidinedione, 3-α-naphthyl-2,4-imidazolidinedione, 1,3-diethyl-2,4-imidazolidinedione, 1-ethyl-3-phenyl-2,4-imidazolidinedione, 1-ethyl-2-α-naphthyl-2,4-imidazolidinedione, 1,3-diphenyl-2,4-imidazolidinedione, etc.); a 2-thio-2,4-imidazolidinedione (i.e., 2-thiohydantoin) nucleus (e.g., 2-thio-2,4-imidazolidinedione, 3-ethyl-2-thio-2,4-imidazolidinedione, 3-(2-carboxyethyl)-2-thio-2,4-imidazolidinedione, 3-phenyl-2-thio-2,4-imidazolidinedione, 1,3-diethyl-2-thio-2,4-imidazolidinedione, 1-ethyl-3-phenyl-2-thio-2,4-imidazolidinedione, 1-ethyl-3-naphthyl-2-thio-2,4-imidazolidinedione, 1,3-diphenyl-2-thio-2,4-imidazolidinedione, etc.); a 2-imidazolin-5-one nucleus.

$G_2$ represents a substituted or unsubstituted amino radical (e.g., primary amino, anilino), or a substituted or unsubstituted aryl radical (e.g., phenyl, naphthyl, dialkylaminophenyl, tolyl, chlorophenyl, nitrophenyl).

According to the formulas (VIII)–(XII), each J represents a substituted or unsubstituted methine group. Examples of substituents for the methine groups include alkyl (preferably of from 1 to 6 carbon atoms, e.g., methyl, ethyl, etc.) and aryl (e.g., phenyl). Additionally, substituents on the methine groups may form bridged linkages.

$W_2$ represents a counterion as necessary to balance the charge of the dye molecule. Such counterions include cations and anions for example sodium, potassium, triethylammonium, tetramethylguanidinium, diisopropylammonium, tetrabutylammonium, chloride, bromide, iodide, paratoluene sulfonate and the like.

$D_1$ and $D_2$ are each independently substituted or unsubstituted aryl (preferably of 6 to 15 carbon atoms), or more preferably, substituted or unsubstituted alkyl (preferably of from 1 to 6 carbon atoms). Examples of aryl include phenyl, tolyl, p-chlorophenyl, and p-methoxyphenyl. Examples of alkyl include methyl, ethyl, propyl, isopropyl, butyl, hexyl, cyclohexyl, decyl, dodecyl, etc., and substituted alkyl groups (preferably a substituted lower alkyl containing from 1 to 6 carbon atoms), such as a hydroxyalkyl group, e.g., 2-hydroxyethyl, 4-hydroxybutyl, etc., a carboxyalkyl group, e.g., 2-carboxyethyl, 4-carboxybutyl, etc., a sulfoalkyl group, e.g., 2-sulfoethyl, 3-sulfobutyl, 4-sulfobutyl, etc., a sulfatoalkyl group, etc., an acyloxyalkyl group, e.g., 2-acetoxyethyl, 3-acetoxypropyl, 4-butyroxybutyl, etc., an alkoxycarbonlyalkyl group, e.g., 2-methoxycarbonlyethyl, 4-ethoxycarbonylbutyl, etc., or an aralkyl group, e.g., benzyl, phenethyl, etc., The alkyl or aryl group may be substituted by one or more of the substituents on the above-described substituted alkyl groups.

Particularly preferred dyes are:

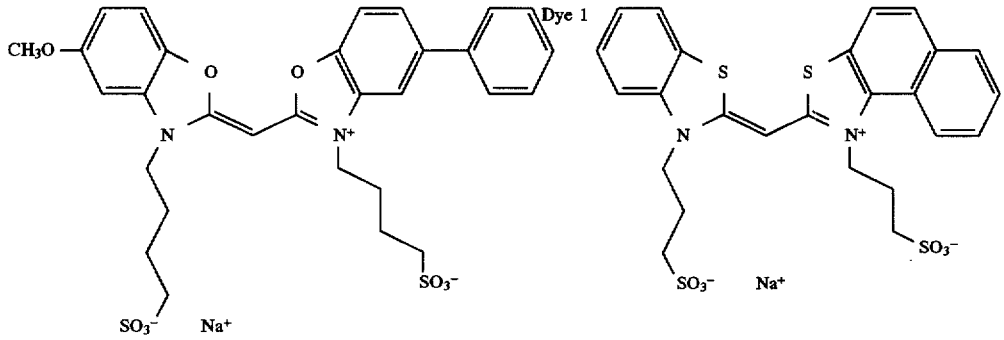

-continued
Dye 3
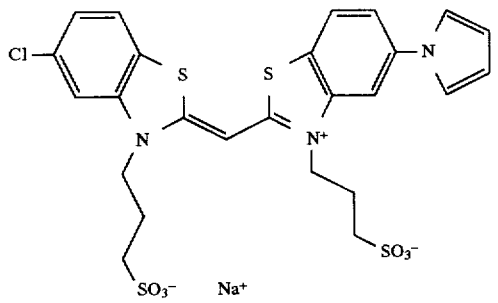
Dye 4
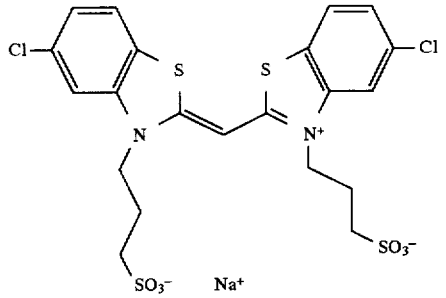
Dye 5
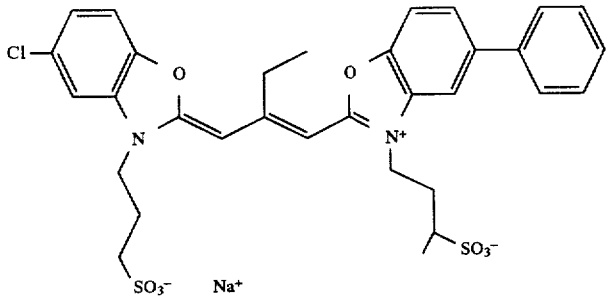
Dye 6
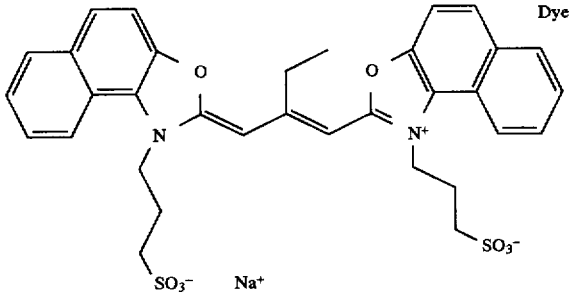
Dye 7
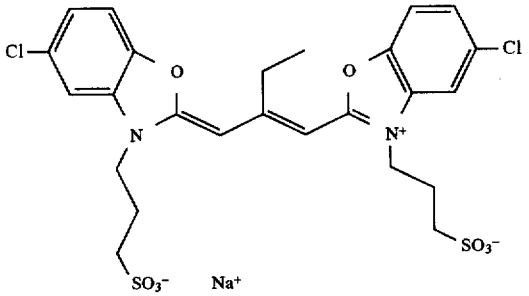
Dye 8
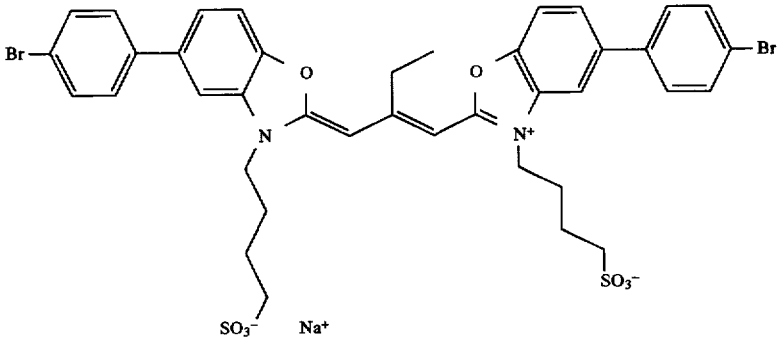
Dye 9
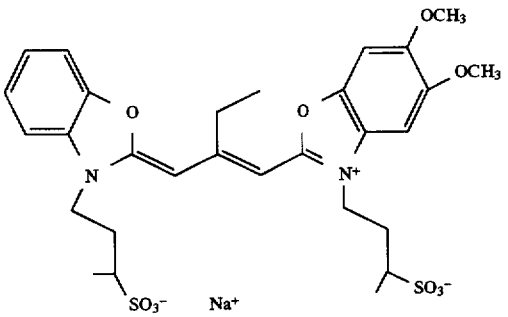

-continued
Dye 10
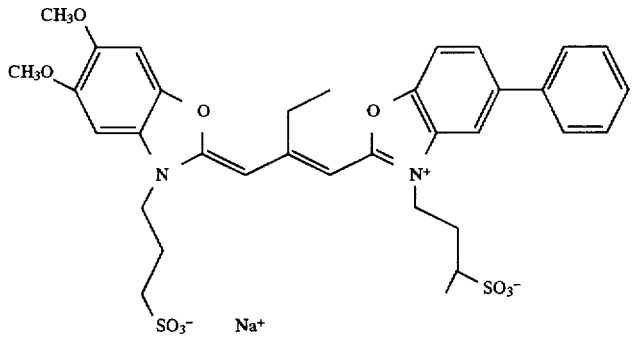
Dye 11
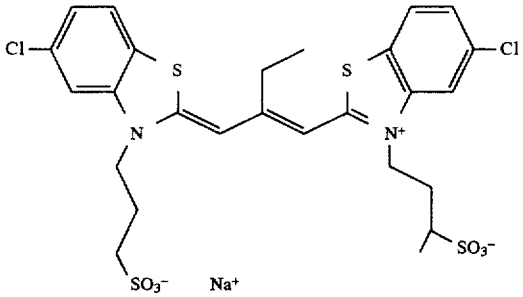
Dye 12
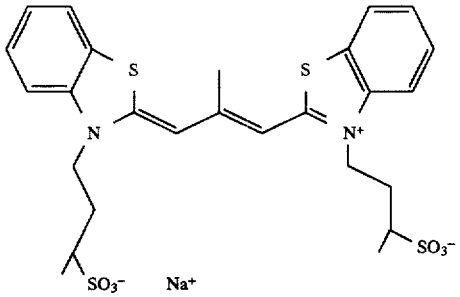
Dye 13
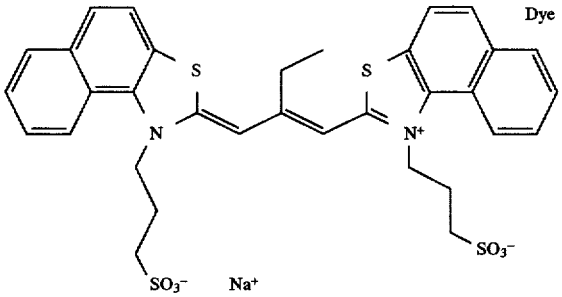
Dye 14
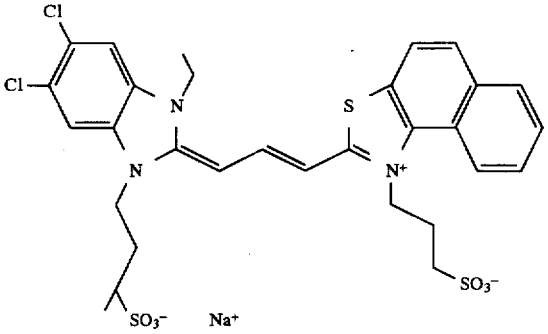
Dye 15
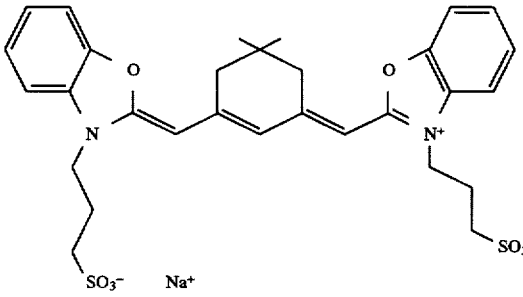
Dye 16
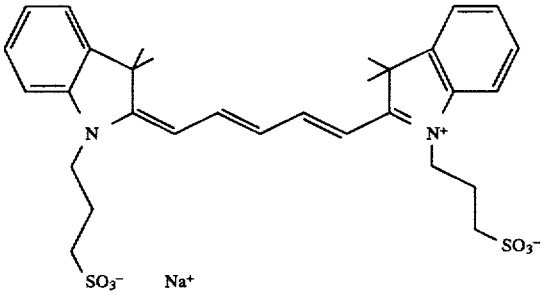
Dye 17
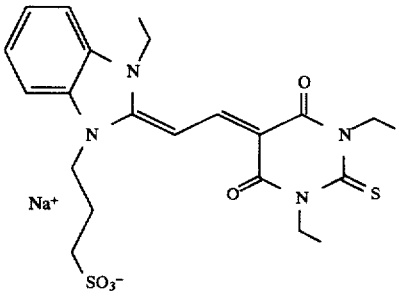
Dye 18
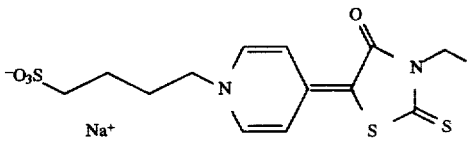
and -continued Dye 19

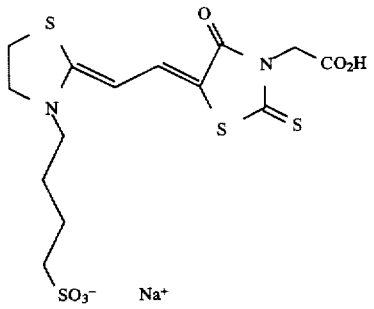

Various compounds may be added to the photographic material of the present invention for the purpose of lowering the fogging of the material during manufacture, storage, or processing. Typical antifoggants are discussed in Section VI of Research Disclosure I, for example tetraazaindenes, mercaptotetrazoles, polyhydroxybenzenes, combinations of a thiosulfonate and a sulfinate, and the like.

For this invention, polyhydroxybenzene and hydroxyaminobenzene compounds (hereinafter "hydroxybenzene compounds") are preferred as they are effective for lowering fog without decreasing the emulsion sensitvity. Examples of hydroxybenzene compounds are:

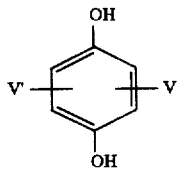

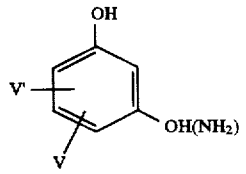

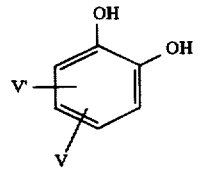

In these formulae, V and V' each independently represent —H, —OH, a halogen atom, —OM (M is alkali metal ion), an alkyl group, a phenyl group, an amino group, a carbonyl group, a sulfone group, a sulfonated phenyl group, a sulfonated alkyl group, a sulfonated amino group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

More preferably, they each independently represent —H, —OH, —Cl, —Br, —COOH, —$CH_2CH_2COOH$, —$CH_3$, —$CH_2CH_3$, —$C(CH_3)_3$, —$OCH_3$, —CHO, —$SO_3K$, —$SO_3Na$, -$SO_3H$, —$SCH_3$, or -phenyl.

Especially preferred hydroxybenzene compounds follow:

HB1

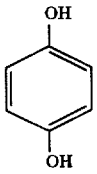

HB2

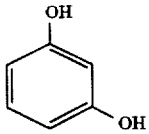

HB3

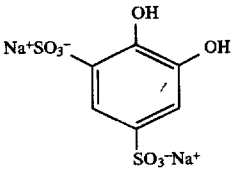

HB4

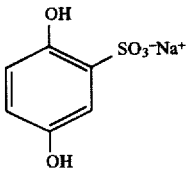

HB5

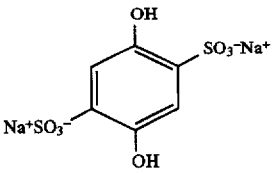

HB6

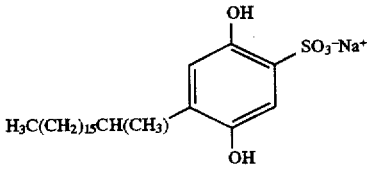

HB7

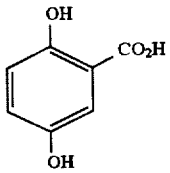

-continued

HB8

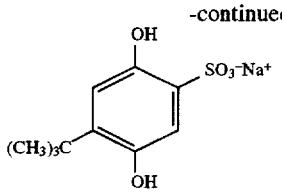

HB9

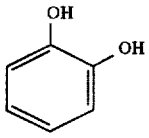

HB10

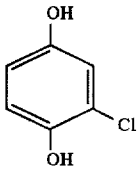

HB11

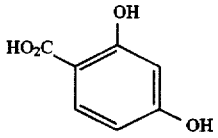

HB12

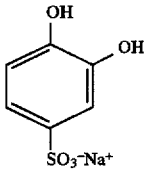

HB13

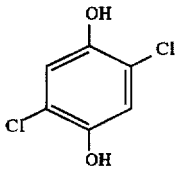

HB14

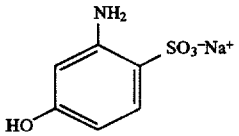

HB15

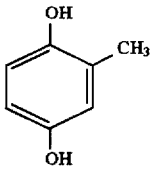

Hydroxybenzene compounds may be added to the emulsion layers or any other layers constituting the photographic material of the present invention. The preferred amount added is from $1\times10^{-3}$ to $1\times10^{-1}$ mol, and more preferred is $1\times10^{-3}$ to $2\times10^{-2}$ mol, per mol of silver halide.

Laser Flash Photolysis Method (a) Oxidation Potential of Radical $X^{\bullet}$

The laser flash photolysis measurements were performed using a nanosecond pulsed excimer (Questek model 2620, 308 nm, ca. 20 ns, ca. 100 mJ) pumped dye laser (Lambda Physik model FL 3002). The laser dye was DPS (commercially available from Exciton Co.) in p-dioxane (410 nm, ca. 20 ns, ca. 10 mJ). The analyzing light source was a pulsed 150 W xenon arc lamp (Osram XBO 150/W). The arc lamp power supply was a PRA model 302 and the pulser was a PRA model M-306. The pulser increased the light output by ca. 100 fold, for a time period of ca. 2–3 ms. The analyzing light was focussed through a small aperture (ca. 1.5 mm) in a cell holder designed to hold 1 $cm^2$ cuvettes. The laser and analyzing beams irradiated the cell from opposite directions and crossed at a narrow angle (ca. 15°). After leaving the cell, the analyzing light was collimated and focussed onto the slit (1 mm, 4 nm bandpass) of an ISA H-20 monochromator. The light was detected using 5 dynodes of a Hamamatsu model R446 photomultiplier. The output of the photomultiplier tube was terminated into 50 ohm, and captured using a Tektronix DSA-602 digital oscilloscope. The entire experiment is controlled from a personal computer.

The experiments were performed either in acetonitrile, or a mixture of 80% acetonitrile and 20% water. The first singlet excited state of a cyanoanthracene (A), which acted as the electron acceptor, was produced using the nanosecond laser pulse at 410 nm. Quenching of this excited state by electron transfer from the relatively high oxidation potential donor biphenyl (B), resulted in efficient formation of separated, "free", radical ions in solution, $A^{\bullet-}+B^{\bullet+}$. Secondary electron transfer then occurred between $B^{\bullet+}$ and the lower oxidation potential electron donor X—Y, to generate $X—Y^{\bullet+}$ in high yield. For the investigations of the oxidation potentials of the radicals $X^{\bullet}$, typically the cyanoanthrancene concentration was ca. $2\times10^{-5}$M to $10^{-4}$M, the biphenyl concentration was ca. 1.0M. The concentration of the X—Y donor was ca. $10^{-3}$M. The rates of the electron transfer reactions are determined by the concentrations of the substrates. The concentrations used ensured that the $A^{\bullet-}$ and the $X—Y^{\bullet+}$ were generated within 100 ns of the laser pulse. The radical ions could be observed directly by means of -their visible absorption spectra. The kinetics of the photogenerated radical ions were monitored by observation of the changes in optical density at the appropriate wavelengths.

The reduction potential ($E_{red}$) of 9,10-dicyanoanthracene (DCA) is −0.91 V. In a typical experiment, DCA is excited and the initial photoinduced electron transfer from the biphenyl (B) to the DCA forms a $DCA^{\bullet-}$, which is observed at its characteristic absorption maximum ($\lambda_{obs}$=705 nm), within ca. 20 ns of the laser pulse. Rapid secondary electron transfer occurs from X—Y to $B^{\bullet+}$ to generate $X—Y^{\bullet+}$, which fragments to give $X^{\bullet}$. A growth in absorption is then observed at 705 nm with a time constant of ca. 1 microsecond, due to reduction of a second DCA by the $X^{\bullet}$. The absorption signal with the microsecond growth time is equal to the size of the absorption signal formed within 20 ns. If reduction of two DCA was observed in such an experiment, this indicates that the oxidation potential of the $X^{\bullet}$ is more negative than −0.9 V.

If the oxidation potential of $X^{\bullet}$ is not sufficiently negative to reduce DCA, an estimate of its oxidation potential was obtained by using other cyanoanthracenes as acceptors. Experiments were performed in an identical manner to that described above except that 2,9,10-tricyanoanthracene (TriCA, $E_{red}$ −0.67 V, $\lambda_{obs}$=710 nm) or tetracyanoanthracene (TCA, $E_{red}$−0.44 V, $\lambda_{obs}$=715 nm) were used as the electron acceptors. The oxidation potential of the $X^{\bullet}$ was taken to be more negative than −0.7 if reduction of two TriCA was observed, and more negative than −0.5 V if reduction of two TCA was observed. Occasionally the size of the signal from the second reduced acceptor was smaller than that of the first. This was taken to indicate that electron transfer from the $X^{\bullet}$ to the acceptor was barely exothermic, i.e. the oxidation potential of the radical was essentially the same as the reduction potential of the acceptor.

To estimate the oxidation potentials of $X^{\bullet}$ with values less negative than −0.5 V, i.e. not low enough to reduce even tetracyanoanthracene, a slightly different approach was used. In the presence of low concentrations of an additional acceptor, Q, that has a less negative reduction potential than the primary acceptor, A (DCA, for example), secondary electron transfer from $A^{\bullet-}$ to Q will take place. If the reduction potential of Q is also less negative than the oxidation potential of the $X^{\bullet}$, then Q will also be reduced by the radical, and the magnitude of the $Q^{\bullet-}$ absorption signal will be doubled. In this case, both the first and the second electron transfer reactions are diffusion controlled and occur at the same rate. Consequently, the second reduction cannot be time resolved from the first. Therefore, to determine whether two electron reduction actually takes place, the $Q^{\bullet-}$ signal size must be compared with an analogous system for which it is known that reduction of only a single Q occurs. For example, a reactive $X—Y^{\bullet+}$ which might give a reducing $X^{\bullet}$ can be compared with a nonreactive $X—Y^{\bullet+}$. Useful secondary electron acceptors (Q) that have been used are chlorobenzoquinone ($E_{red}$ −0.34 V, $\lambda_{obs}$=450 nm), 2,5-dichlorobenzoquinone ($E_{red}$ −0.18 V, $\lambda_{obs}$=455 nm) and 2,3,5,6-tetrachlorobenzoquinone ($E_{red}$ 0.00 V, $\lambda_{obs}$=460 nm).

(b) Fragmentation Rate Constant Determination

The laser flash photolysis technique was also used to determine fragmentation rate constants for examples of the oxidized donors X—Y. The radical cations of the X—Y donors absorb in the visible region of the spectrum. Spectra of related compounds can be found in "Electron Absorption Spectra of Radical Ions" by T. Shida, Elsevier, New York, 1988. These absorptions were used to determine the kinetics of the fragmentation reactions of the radical cations of the X—Y. Excitation of 9,10-dicyanoanthracene (DCA) in the presence of biphenyl and the X—Y donor, as described above, results in the formation of the $DCA^{\bullet-}$ and the $X—Y^{\bullet+}$. By using a concentration of X—Y of ca. $10^{-2}$M, the $X—Y^{\bullet+}$ can be formed within ca. 20 ns of the laser pulse. With the monitoring wavelength set within an absorption band of the $X—Y^{\bullet+}$, a decay in absorbance as a function of time is observed due to the fragmentation reaction. The monitoring wavelengths used were somewhat different for the different donors, but were mostly around 470–530 nm. In general the $DCA^{\bullet-}$ also absorbed at the monitoring wavelengths, however, the signal due to the radical anion was generally much weaker than that due to the radical cation, and on the timescale of the experiment the $A^{\bullet-}$ did not decay, and so did not contribute to the observed kinetics. As the $X—Y^{\bullet+}$ decayed, the radical $X^{\bullet}$ was formed, which in most cases reacted with the cyanoanthracene to form a second $A^{\bullet-}$. To make sure that this "grow-in" of absorbance due to $A^{\bullet-}$ did not interfere with the time-resolved decay measurements, the concentration of the cyanoanthracene was maintained below ca. $2\times10^{-5}$M. At this concentration the second reduction reaction occurred on a much slower timescale than the $X—Y^{\bullet+}$ decay. Alternatively, when the decay rate of the $X—Y^{\bullet+}$ was less than $10^{6}$ $s^{-1}$, the solutions were purged with oxygen. Under these conditions the $DCA^{\bullet-}$ reacted with the oxygen to form $O_2^{\bullet-}$ within 100 ns, so that its absorbance did not interfere with that of the $X—Y^{\bullet+}$ on the timescale of its decay.

The experiments measuring the fragmentation rate constants were performed in acetonitrile with the addition of 20% water, so that all of the salts could be easily solubilized. Most experiments were performed at room temperature. In some cases the fragmentation rate was either too fast or too slow to be easily determined at room tempareture. When this happened, the fragmentation rate constants were measured as a function of temperature, and the rate constant at room temperature determined by extrapolation.

Synthesis of Representative X—Y Compounds

The following examples illustrate the synthesis of typical compounds represented by formulae 1-58. Other compounds can also be synthesized by analogy using appropriately selected known starting materials.

1. Preparation of ethyl N,N-diethylanilinyl-α-hydroxy-p-acetate

To a solution of 12.2 gm (0.0519 mole) of ethyl N,N-diethylanilinyl-p-acetate in 40 mL of dry tetrahydrofuran cooled to −78° C. under nitrogen was syringed 60 mL of lithium hexamethyldisilizane (1M in tetrahydrofuran). The carbanion solution was stirred for 45 min before the addition of 12 gm (1 equivalent) of camphorsulfonyloxaziridine in tetrahydrofuran as a slurry. The reaction mixture was allowed to equilibrate to room temperature. Addition of aqueous ammonium chloride (150 mL) produced a yellow solid. The mixture was extracted twice with ether (150 mL) and the ether extracts were combined, dried over magnesium sulfate, and evaporated to give 18 gm of brown oil. The oil was purified by silica gel chromatography to give the desired compound.

2. Preparation of sodium N,N-diethylanilinyl-α-hydroxy-p-acetate, Compound No. 2

To 0.45 g of ethyl N,N-diethylanilinyl-α-hydroxy-p-acetate was added 4 mL of methanol and 1 mL of 2N sodium hydroxide. The mixture was allowed to react for several hours at room temperature. The solution was evaporated to dryness and the residue was dissolved in 5 mL of methylene chloride and was subjected to silica gel chromatography using a developing solution of acetonitrile/methanol (3/1 by volume). 0.36 g of the desired product was obtained as a yellow oil which solidified on storage under vacuum.

3. Preparation of potassium N,N-diethylanilinyl-α-methoxy-p-acetate Compound No. 8

A finely divided suspension of powdered potassium hydroxide (3 g) in 40 mL of dried dimethylsulfoxide was prepared and to this was added a solution of 1 g of ethyl N,N-diethylanilinyl-α-hydroxy-p-acetate in 3 mL of dimethylsulfoxide. 3 mL of methyl iodide was then added. The mixture was allowed to react for 15 min and then was quenched by the addition of ice water. The mixture was extracted with ether. The ether extracts were dried by addition of magnesium sulfate and rotavaporated to give 0.71 g of a mixture of methyl and ethyl N,N-diethylanilinyl-α-methoxy-p-acetate. The crude esters were saponified with 2N potassium hydroxide (10 mL) in ethanol (10 mL) at room temperature. After 1 h, the entire mixture was rotavaporated. The oily residue was washed with ether to remove neutral impurities. The residue was sonicated in 50 mL of acetonitrile. The insoluble potassium hydroxide was removed by decantation. The supernatant that contained the product was further purified by flash chromatography over silica gel (32–63 micron) using methanol and acetonitrile (1:4 v/v) as the mobile phase. Pure fractions were combined and rotavaporated. The residue was washed out with ethyl acetate to give 275 mg of pure potassium N,N-diethylanilinyl-α-methoxy-p-acetate.

4. Preparation of ethyl N,N-dimethylanilinyl-α-hydroxy-α-methyl-p-acetate

To 5.4 g (0.22 mole) of magnesium turnings in 100 mL of dry tetrahydrofuran containing a small amount of iodine was added 44.5 g (0.22 mole) of p-bromo-N,N-dimethylaniline in 100 mL of tetrahydrofuran under a nitrogen atmosphere. The rate of addition was controlled to maintain a steady reflux in the mixture for 2 hours. After cooling to room temperature, the mixture was added quickly to a solution of 27.7 g of ethyl pyruvate in 70 mL of tetrahydrofuran which was cooled with dry ice. The mixture was held at room temperature for 12 hours, then 200 mL of aqueous ammonium chloride was added and the mixture was extracted with ether. Magnesium sulfate was added to the ether extract and the solution was evaporated to give 20 g of a brown oil.

5. Preparation of Compound No. 7

3.0 g of ethyl N,N-dimethylanilinyl-α-hydroxy-α-methyl-p-acetate was dissolved in 25 mL of dimethylformamide and cooled to 0° C. under a nitrogen atmosphere. 0.7 g of sodium hydride was added in small portions. The mixture was stirred for 1 hour, then a solution of 2.5 g of methyl iodide in 5 mL of dimethylformamide was added. The solution was allowed to warm to room temperature over an 18 hour period. 200 mL of ethylacetate was added, then 100 mL of saturated aqueous sodium chloride solution was added. The organic portion of the mixture was separated off and excess sodium sulfate was added. The solution was evaporated to a yellow oil. The oil was subjected to silica gel chromatography using a developing solution of heptane/tetrahydrofuran (2/1 by volume) to give 2.9 g of a colorless oil. The oil was treated with 10 mL of 2N potassium hydroxide in ethanol and the mixture was allowed to react at room temperature for 1 hour. The entire mixture was then evaporated and the oily residue was washed with diethyl ether. The residue was subjected to silica gel chromatography using a developing solution of methanol. 0.20 g of the desired product was obtained.

6. Preparation of Compound No. 5

To 16.3 g of ethyl N,N-dimethylanilinyl-α-hydroxy-α-methyl-p-acetate in 100 mL of tetrahydrofuran was added 2 g of sodium hydride under nitrogen at room temperature. Hydrogen evolution occured, and as the gas evolution subsided a solid precipitated. After stirring the mixture for 12 hours, the mixture was filtered and the solid was washed repeatedly with ether. The light brown solid was dried in a vacuum oven, and then taken up in 150 mL of ethyl acetate and filtered again. The solid was then rinsed with acetonitrile to give 14 g of compound no. 5.

7. Preparation of methyl 2-(1-methyl-3-indolyl)acetate

To a solution of 20 g of 1-methyl-3-indole acetic acid in 120 mL of methanol was added 0.5 mL of concentrated sulfuric acid and the mixture was stirred at room temperature for 18 hours. The mixture was concentrated by evaporation and the residue was dissolved in dichloromethane, and then poured into a solution of aqueous saturated sodium bicarbonate. The mixture was then extracted with dichloromethane and excess magnesium sulfate was added to the extract. The product was purified by distillation to give 25 g of yellow oil.

8. Preparation of methyl 2-methyl-2-(1-methyl-3-indolyl) acetate

To a solution of lithium diisopropyl amide, LDA, (5.5 millimole) in 10 mL of dry tetrahydrofuran at −78° C. was added dropwise a solution of methyl 2-(1-methyl-3-indolyl) acetate (1.02 g) in 3 mL of dry tetrahydrofuran. This mixture was stirred for one hour, then 1.42 g of methyl iodide was added and the mixture was warmed to room temperature and stirred for an additional 30 minutes. The mixture was poured into a solution of aqueous saturated ammonium chloride and then extracted with diethyl ether. The ether extract was dried over magnesium sulfate and concentrated to an oil by evaporation. The residue was subjected to silica gel chromatography using a developing solution of hexanes/ethyl acetate (6:1 by volume) to give 1.04 g of the product.

9. Preparation of 2-methyl-2-(1-methyl-3-indolyl)acetic acid, Compound No. 45

A solution of 0.55 g methyl 2-methyl-2-(1-methyl-3-indolyl)acetate in 5 mL of 10% aqueous methanol was treated with 0.35 g of potassium hydroxide and the mixture was stirred at room temperature for 18 hours. The mixture was poured into 5% hydrochloric acid and then extracted with diethyl ether. The ether extract was dried with magnesium sulfate and concentrated to a solid. The crude product was recrystallized from methanol/water (9:1 by volume) to give 0.36 g of a white solid.

10. Preparation of methyl 2,2-dimethyl-2-(1-methyl-3-indolyl)acetate

To a solution of 7.59 millimole of LDA in 12 mL of dry tetrahydrofuran at −78° C. was added dropwise a solution of 1.40 g of methyl 2-(1-methyl-3-indolyl)acetate in 5 mL of dry tetrahyrofruan. The mixture was stirred for 45 minutes. 1.14 g of methyl iodide was then added and the mixture was warmed to room temperature and stirred for 30 min, whereupon it was recooled to −78° C. and treated with a second portion of LDA (7.59 millimole). The mixture was stirred for 45 minutes at −78° C., a second portion (1.14 g) of methyl iodide was added, and the mixture was allowed to come to room temperature. After stirring the mixture for 30 minutes, it was poured over a solution of saturated aqueous ammonium chloride, and then extracted with diethyl ether. The ether extract was treated with magnesium sulfate and concentrated by evaporation to give crude product. The crude material was recrystallized from methanol to give a white solid.

11. Preparation of Compound No. 44

To a solution of 1.8 g of methyl 2,2-dimethyl-2-(1-methyl-3-indolyl)acetate in 30 mL of 10% aqueous methanol was added 1.8 g of potassium hydroxide and the mixture was refluxed for 12 hours. The mixture was poured into a solution of saturated aqueous ammonium chloride, and then extracted once with 20 mL of diethyl ether. The aqueous portion was then acidified with concentrated hydrochloric acid to give a solid precipitate which was filtered and dried. The product was recrystallized from methanol/water to provide 1.4 g of a white solid.

12. Preparation of methyl 2-hydroxy-2-(1-methyl-3-indolyl) acetate

To a solution of 2.87 millimole of LDA in 5 mL of dry tetrahydrofuran at −78° C. was added dropwise a solution of 0.53 g of methyl 2-(1-methyl-3-indolyl)acetate in 5 mL of dry tetrahyrofruan. The mixture was stirred for 30 minutes at −78° C., and then 0.9 g of (+)-(2R,8aS)-(camphorsulfonyl)oxaziridine was added. The mixture was warmed to room temperature and stirred for 2 hours. Then the mixture was poured into a solution of saturated aqueous ammonium chloride, and then extracted with diethyl ether. The ether extract was dried with magnesium sulfate and concentrated by evaporation. The residue was subjected to silica gel chromatography using a developing solution of dichloromethane/ethyl acetate (98:2 by volume) to give 0.38 g of an oily product.

13. Preparation of sodium 2-hydroxy-2-(1-methyl-3-indolyl)acetate, Compound No. 43

0.35 g of sodium hydroxide was added to a solution of 1.74 g of methyl 2-hydroxy-2-(1-methyl-3-indolyl)acetate in 10 mL of methanol containing 4–5 drops of water. The mixture was allowed to react at room temperature for 24 hours. The solid that precipitated was filterd, washed with water, and dried to give 1.07 g of a white solid.

14. Preparation of glycine, N-(4-methoxyphenyl), ethyl ester

To a stirred suspension of 33.5 g of p-anisidine and 82.5 g of anhydrous potassium carbonate in 300 mL of acetonitrile under a nitrogen atmosphere was added 100 g of ethylbromoacetate. The reaction mixture was refluxed under nitrogen for 2 days, the solution was cooled, and the salt was filtered out. The filtrate was poured into dichloromethane and washed with aqueous sodium bicarbonate solution, then washed with water. Anhydrous sodium sulfate was added and then the dichloromethane solution was filtered. The filtrate was concentrated by evaporation, and then distilled under vacuum to give 63.2 g of the desired product (a colorless oil).

15. Preparation of Compound No. 10

A mixture of 63.2 g of glycine, N-(4-methoxyphenyl), ethyl ester, 18 g of sodium hydroxide, 60 mL of $H_2O$, 60 mL of ethanol, and 80 mL of tetrahydrofuran was refluxed for 15 hours, cooled , and the precipitated salt was collected. The solid was recrystallized from ethanol to give 59.3 g of the desired product.

16. Preparation of glycine, N-(4-methylyphenyl), ethyl ester

This compound was prepared in a manner analogous to the process described in synthesis example 14, except using 13.6 g of p-toluidine and 46.7 g of ethylbromoacetate. The product was purified by distillation to give 19.6 g of the desired product.

17. Preparation of Compound No. 11

In a manner analogous to the process described in synthesis example 15, except using 19.6 g of glycine, N-(4-methylyphenyl), ethyl ester and 6.2 g of sodium hydroxide. The product was crystallized from ethanol to give 14.0 g of the desired product.

18. Preparation of glycine, N-(4-sec-butylyphenyl), ethyl ester

In a manner analogous to the process described in synthesis example 14, except using 20.0 g of 4-sec-butylaniline and 47.0 g of ethylbromoacetate. The product was purified by distillation to give 37.3 g of the desired product.

19. Preparation of Compound No. 16

In a manner analogous to the process described in synthesis example 15, except using 35.6 g of glycine, N-(4-sec-butylyphenyl), ethyl ester and 8.6 g of sodium hydroxide. The product was crystallized from ethanol to give 14.0 g of the desired product.

20. Preparation of alanine, N-(4-methoxyphenyl), ethyl ester

This compound was prepared in a manner analogous to the process described in synthesis example 14, except using 28.4 g of p-anisidine and 50 g of ethyl 2-bromoproprionate, 4.6 g of potassium iodide, and 70.0 g of potassium carbonate. The product was purified by distillation under vacuum to give 44.3 g of the desired product.

21. Preparation of Compound No. 15

This compound was made in a manner analogous to the process described in synthesis example 15, except using 33.1 g of alanine, N-(4-methoxyphenyl), ethyl ester and 8.6 g of sodium hydroxide. The product was crystallized from ethanol to give 25.0 g of the desired product.

22. Preparation of alanine, N-(4-methylphenyl), ethyl ester

This compound was prepared in a manner analogous to the process described in synthesis example 20, except using 77.5 g of p-toluidine and 111 g of ethyl-2-bromoproprionate, 15 g of potassium iodide, and 1.55 g of potassium carbonate. 17.1 g of the desired end product was obtained.

23. Preparation of Compound No. 20

This compound was made in a manner analogous to the process described in synthesis example 15, except using 15.6 g of alanine, N-(4-methylphenyl), ethyl ester and 4.3 g of sodium hydroxide. 11.5 g of the desired end product was obtained.

24. Preparation of alanine, N-phenyl, ethyl ester

This compound was prepared in a manner analogous to the process described in synthesis example 20, except using 21.4 g of aniline and 50 g of ethyl-2-bromoproprionate, and 4.6 g of potassium iodide. 20.8 g of the desired end product was obtained.

25. Preparation of Compound No. 14

This compound was made in a manner analogous to the process described in synthesis example 15, except using 11.4 g of alanine, N-phenyl, ethyl ester and 3.3 g of sodium hydroxide. 7.5 g of the desired end product was obtained.

26. Preparation of Compound No. 52

N-ethyl-2-methylbenzothiazolium iodide was prepared by the alkylation 2-methylbenzothiazole by conventional procedures. 0.55 gm of N-ethyl-2-methylbenzothiazolium iodide and 0.37 gm of lithium perchlorate were dissolved in 35 ml of acetonitrile. 0.25 gm of anhydrous calcium carbonate was added and the resulting slurry was placed in a three-compartment electrolysis cell containing a mechanical stirrer, a mercury pool working electrode, a platinum gauze counter electrode, and a SCE reference electrode. The slurry was stirred and deaerated by bubbling nitrogen through for 20 min. Controlled potential electrolysis was then conducted at an applied potential of −1.25 V vs SCE until the current decreased to a very low, steady value. The slurry was then decanted to remove the calcium carbonate, and the supernate was transferred to a 100 ml flask. Water (35 ml) was added, and flask was stored in a refrigerator until the precipitation of the light-brown, oily product was complete. The oil was isolated and washed with water to remove traces of lithium perchlorate.

27. Preparation of N-(4-Carboxyethylphenyl)alanine ethyl ester

This compound was prepared in a manner analagous to the process described in synthesis example 14, except using ethyl-4-aminobenzoate and ethyl 2-bromoproprionate.

28. Preparation of N-(4-Carboxyethylphenyl)-N-(n-butyl) alanine ethyl ester

N-(4-Carboxyethylphenyl)alanine ethyl ester (2.6 g, 0.01 mol), n-butyl iodide (1.8 g, 0.01 mol) and 2,6-lutidine (1.5 g, 0.04 g) were sealed in a glass tube. The contents of the tube were heated at 135° C. for 48 h. The tube was then cooled and the contents were partitioned between 200 mL ethyl acetate and 200 mL brine. The organic layer was separated, dried over anhyd. sodium sulfate and concentrated at reduced pressure. The resulting oil was charged onto a silica gel column, and eluted with heptane:THF (4:1). The desired ester was isolated as a light yellow oil (0.5 g, 16%).

29. Preparation of Compound No. 38

N-(4-Carboxyethylphenyl)-N-(n-butyl)alanine ethyl ester (0.5 g, 1.56 mmol) was dissolved in 50 mL MeOH and 5 mL of water. The sodium hydroxide (0.12 g, 3.1 mmol) was dissolved in a minimum amount of water and added to the aqueous methanol solution. The mixture was stirred 18 h at rt, and then concentrated at reduced pressure. The resulting white solid, N-(4-carboxyphenyl)-N-(n-butyl)alanine, disodium salt Compound 38, (0.49 g, 100%) was used without further purification.

30. Preparation of N-(4-Chlorophenyl)alanine ethyl ester

This compound was prepared in a manner analagous to the process described in synthesis example 14, except using 4-chloroaniline and ethyl 2-bromoproprionate.

31. Preparation of N-(4-Chlorophenyl)-N-(n-butyl)alanine ethyl ester

N-(4-Chlorophenyl)alanine ethyl ester (4.5 g, 0.02 mol), n-butyl iodide (3.6 g, 0.02 mol) and 2,6-lutidine (2.5 g, 0.025 mol) were sealed in a glass tube and the contents were heated at 135° C. for 48 h. The tube was then cooled, and the contents were partitioned between 250 mL ethyl acetate and 200 mL brine. The organic layer was separated, dried over anhyd. sodium sulfate, and concentrated at reduced pressure. The resulting oil was chromatographed on silica gel using heptane:THF (4:1) as the eluant. The ester was isolated as a colorless oil (2.5 g, 45%).

32. Preparation of Compound No. 39

N-(4-Chlorophenyl)-N-(n-butyl)alanine ethyl ester (2.5 g, 8.8 mmol) was dissolved in 200 mL MeOH and 15 mL water. The sodium hydroxide (0.35 g, 8.8 mmol) was dissolved in a minimum amount of water and added to the aqueous methanol solution. The solution was stirred 18 h at rt, and then concentrated at reduced pressure. The resulting white solid, N-(4-chlorophenyl)-N-(n-butyl)alanine, sodium salt Compound 39, (2.4 g, 100%) was used without further purification.

33. Preparation of Ethyl 3-N-(4'-methylphenyl)-N-(trifluoroacetamido)-proprionate p-Toluidine trifluoroacetamide (18.9 g, 0.1 mole), ethylbromoacetate (20.0 g, 0.11 mole) and potassium carbonate (15.0 g, 0.11 mole) were added to 150 mL acetonitrile and the mixture was heated at reflux for 24 h. The reaction mixture was then cooled and partitioned between 500 mL ethyl acetate and 200 mL brine. The organic layer was separated, dried over anhyd. sodium sulfate and concentrated at reduced pressure. The resulting oil was charged onto a silica gel column and eluted with heptane:THF 5:1. The desired ester was isolated as an oil (18.0 g, 57%).

34. Preparation of Ethyl 3-N-(4'-methylphenyl)-propionate

Ethyl 3-N-(4'-methylphenyl)-N-(trifluoroacetamido)-proprionate (1.0 g, 3.3 mmol) was dissolved in 10 mL methanol and 1 mL water. 50% Aq. NaOH (0.26 g, 3.3 mmol) was then added and the mixture was stirred at rt for 18 h. The reaction mixture was then partitioned between 50 mL ethyl acetate and 20 mL brine. The organic layer was separated, dried over anhyd. sodium sulfate and concentrated at reduced pressure. The residue (0.6 g, 88%) was used without further purification.

35. Preparation of Ethyl 3-N-(4'-methylphenyl)-N-(trimethylsilylmethyl)-proprionate Ethyl 3-N-(4'-methylphenyl)-proprionate (1.9 g, 9.3 mmol), trimethylsilylmethyl triflate (2.2 g, 9.3 mmol) and $K_2CO_3$ (1.28 g, 9.3 mmol) were added to 50 mL of acetonitrile and the mixture was heated at reflux for 18 h. The reaction mixture was then cooled and partitioned between 100 mL of ethyl acetate and 100 mL of brine. The organic layer was separated, dried over anhyd. $Na_2SO_4$ and concentrated at reduced pressure. The resulting oil was charged onto an alumina column and eluted with heptane:THF (9:1). The desired silyl-ester was isolated as a light yellow oil (2.0 g, 73%).

$^1$H NMR ($CDCl_3$): 7.0 (d, 2H); 6.6 (d, 2H); 4.15 (q, 2H); 3.6 (t, 2H); 2.75 (s, 2H); 2.55 (t, 2H); 2.2 (s, 3H); 1.25 (t, 3H); 0.5 (s, 9H). MS(m/e): 293 $M^+$

36. Preparation of 3-N-(4-Methylphenyl)-N-(trimethylsilylmethyl)-proprionic acid sodium salt, Compound No. 42

The silyl ester (2.0 g, 6.8 mmol) and sodium hydroxide (0.27 g, 6.8 mmol) were added to 50 mL of ethanol and 2 mL of water. The mixture was stirred at rt for 18 h, and then the solvent was removed at reduced pressure. The desired carboxylate salt was isolated as a white solid and used without further purification.

$^1$H NMR($D_2O$): 6.85 (d, 2H); 6.45 (d, 2H); 3.4 (m, 3H); 2.75 (s, 2H); 2.1 (m, 5H); 0.0 (s, 9H).

MS(m/e): +ions 266 $M^-$ 2 $H^+$, 268 $M^-$ $H^+$ $Na^+$, 310 $M^-$ $2Na^+$

37. Preparation of Compound No. 56

To a solution of 26.4 g anthracene in 200 mL nitromethane, cooled to −5° C. 22.5 g aluminum chloride was added, after 15 minutes 20.3 g of ethyl oxalyl chloride were added dropwise. The reaction mixture was warmed to room temperature and stirred over night. The reaction mixture was poured into cold water and extracted with dichloromethane, washed with diluted HCl, then with water and dried over sodium sulfate. The product was purified by chromatography over silica gel to give 7.4 g which were dissolved in 150 mL ethanol and reacted with 3.6 g sodium borohydride at 0° C. for 2 hours. The reaction mixture was treated with diluted HCl and extracted with dichloromethane. The reduced product was then hydrolyzed with an equimolar amount of NaOH in ca. 1:1 methanol/water for an hour at reflux temperature. Distillation of the solvent and digestion of the residue with acetonitrile yielded Compound No. 56 as light yellow crystaline material.

38. Preparation of Compound No. 57

To a solution of 10.5 g sodium hydride in 30 mL dry DMF in an ice bath, 44.1 g phenothiazine in 120 mL dry DMF was added. The solution was allowed to warm to room temperature, and was stirred over night. 44.4 g ethyl 1-bromopropionate were added and was stirred over night. The alkylation product was chromatographed over silica gel using dichloromethane/heptane mixture, which yielded 9.5 g of the ethyl ester. Hydrolysis of the ester with NaOH in ca. 1:1 methanol/water for an hour at reflux temperature, followed by distillation of the solvents and digestion with ether gave 6.8 g of Compound No. 57.

39. Preparation of Compound No. 58

A solution of 25 g diphenylamine in 80 mL dry DMF was added to 7 g sodium hydride in 20 mL DMF. After 3 hours stirring at room temperature, the solution was cooled to 50° C. and 28.4 g ethyl 1-bromopropionate were added, then warmed up to room temperature. The reaction mixture was diluted with 600 mL water and extracted with ethyl acetate, dried over magnesium sulfate, and distilled. The residue was purified by vacuum distillation to remove unreacted starting materials followed by the desired alkylation product, which was obtained in ca 10 g yield. Hydrolysis of this compound with NaOH in ca. 1:1 methanol/water for an hour at reflux temperature, followed by distillation of the solvents and washing with acetonitrile gave 5.2 g of Compound No. 58.

40. Preparation of Compound No. 61

N-(4-Methylthiophenyl)-N-(n-butyl)alanine ethyl ester (3.0 g, 10.1 mmol) was dissolved in 50 mL methanol and 5 mL of water was added. Sodium hydroxide (0.41 g, 10.1 mmol) was dissolved in a minimum amount of water, and added to the aqueous methanol solution. The mixture was stirred 18 h at room temperature, and then the solvent was removed at reduced pressure. The resulting white solid was used without purification.

The following examples illustrate the beneficial use of fragmentable electron donors in silver halide emulsions.

EXAMPLE 1

An AgBrI tabular silver halide emulsion (Emulsion T-1) was prepared containing 4.05% total I distributed such that the central portion of the emulsion grains contained 1.5% I and the perimeter area contained substantially higher I, as described by Chang et al, U.S. Pat. No. 5,314,793. The emulsion grains had an average thickness of 0.123 μm and average circular diameter of 1.23 μm. The emulsion was sulfur sensitized by adding $1.2\times10^{-5}$ mole /Ag mole of (1,3-dicarboxymethyl-1,3-dimethyl-2-thiourea) at 40° C., the temperature was then raised to 60° C. at a rate of 5° C./3 min and the emulsion held for 20 min before cooling to 40° C. This chemically sensitized emulsion was then used to prepare the experimental coating variations indicated in Table I. Electron donors as indicated in Table I were added from an aqueous potassium bromide solution before additional water, gelatin, and surfactant were added to the emulsion melts. At the time of donor addition, the emulsion melts had a VAg of 85–90 mV and a pH of 6.0. After 5 min at 40° C., an additional volume of 4.3% gelatin was then added to give a final emulsion melt that contained 216 grams of gel per mole of silver. These emulsion melts were coated onto an acetate film base at 1.61 g/m$^2$ of Ag with gelatin at 3.22 g/m$^2$. The coatings were prepared with a protective overcoat which contained gelatin at 1.08 g/m$^2$, coating surfactants, and a bisvinyl sulfonyl methyl ether as a gelatin hardening agent.

For photographic evaluation, each of the coating strips was exposed for 0.1 sec to a 365 nm emission line of a Hg lamp filtered through a Kodak Wratten filter number 18A and a step wedge ranging in density from 0 to 4 density units in 0.2 density steps. The exposed film strips were developed for 6 min in Kodak Rapid X-ray Developer (KRX). $S_{365}$, relative sensitivity at 365 nm, was evaluated at a density of 0.2 units above fog.

The data in Table I compare the fragmentable electron donor Compound No. 2, to ascorbic acid (Compound A-1), and phenidone (Compound A-2), electron donors which have previously been used as addenda in photographic emulsions. The Table shows that the optimum concentrations of Compound No. 2 give a factor of 1.7 speed gain with only an 0.01 density unit increase in fog. The comparison compound phenidone, which is an example of a one electron donor that does not fragment, gives at best a factor of 1.1 speed increase. The comparison compound ascorbic acid, which is an example of reduction sensitization agent with a low one-electron oxidation potential, gives at best a factor of 1.2 speed increase with a significant fog increase of 0.13 units.

TABLE I

Comparison of Speed and Fog results for an aniline acetic acid compound to other electron donor compounds

| Compound | Amount mmole/mole Ag | $S_{365}$ | Fog |
|---|---|---|---|
| none | none | 100 | 0.10 |
| A-1 | 12 | 100 | 0.18 |
| A-1 | 30 | 107 | 0.17 |
| A-1 | 61 | 118 | 0.19 |
| A-1 | 92 | 120 | 0.23 |
| A-2 | 1 | 110 | 0.06 |
| A-2 | 10 | 102 | 0.07 |
| A-2 | 21 | 102 | 0.09 |
| A-2 | 44 | 91 | 0.09 |
| 2 | 0.5 | 159 | 0.14 |
| 2 | 1.0 | 170 | 0.11 |

TABLE I-continued

Comparison of Speed and Fog results for an aniline acetic acid compound to other electron donor compounds

| Compound | Amount mmole/mole Ag | $S_{365}$ | Fog |
|---|---|---|---|
| 2 | 5.2 | 170 | 0.11 |
| 2 | 26 | 118 | 0.07 |

EXAMPLE 2

The chemically sensitized emulsion T-1 as described in Example 1 was used to prepare coatings containing a group of electron donors closely related to the fragmentable electron donor Compound No. 2.

As indicated in Table II, some of the experimental coating variations contained the hydroxybenzene, 2,4-disulfocatechol (HB3) at a concentration of 13 mmole/mole Ag, added to the melt before any further addenda. Where present, the red sensitizing dye D-II was added from methanol solution to the emulsion at 40° C. after the chemical sensitization and disulfocatechol addition. The concentration of dye used was 0.82 mmole/mole Ag. The electron donors were then added to the emulsion and coatings prepared and tested as described in Example 1. The concentration of electron donors used in Example 2 was 0.44 mmole/mole Ag.

Dye II is a red spectral sensitizing dye of the formula:

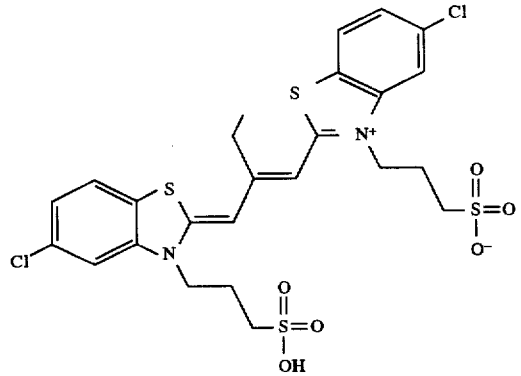

The data in Table II show that for the undyed or red dyed emulsion with HB3 added, all of the compounds gave sensitivity increases for the 365 nm exposure. Compound 1 is a fragmentable one electron donor meeting the first two criteria set forth herein. All other compounds are fragmentable two electron donors meeting all three criteria. The data reported in Table II indicate that Compound 1 gives a speed increase that is less than the speed increase obtained when the fragmentable two electron donors are used. Large fog increases were obtained for some of the fragmentable two electron donors, particularly when the red sensitizing dye D-II was present. As disclosed in Table II, it has been found that the fog increases can be inhibited by the addition of HB3 to the melt.

TABLE II

Speed (365 nm) and Fog Results for Aniline Acetic Acid Compounds on a AgBrI Emulsion

| Compound | $E_1$ (V) | $E_2$ (V) | No HB3 Undyed $S_{365}$/fog | No HB3 D-II dyed $S_{365}$/fog | With HB3 Undyed $S_{365}$/fog | With HB3 D-II dyed $S_{365}$/fog |
|---|---|---|---|---|---|---|
| None | | | 100/0.06 | 73/0.11 | 107/0.06 | 85/0.11 |
| 1 | 0.53 | >−0.5 | 120/0.06 | 83/0.11 | 118/0.06 | 85/0.11 |
| 2 | 0.50 | <−0.9 | 145/0.16 | 141/0.36 | 155/0.06 | 159/0.18 |
| 8 | 0.49 | −0.85 | 132/0.07 | — | — | — |
| 5 | 0.51 | <−0.9 | —/0.89 | —/1.02 | 162/0.08 | 132/0.44 |
| 4 | 0.49 | <−0.9 | 155/0.20 | 129/0.52 | 170/0.07 | 159/0.27 |
| 7 | 0.52 | <−0.9 | —/0.61 | —/0.95 | 159/0.07 | 102/0.40 |
| 6 | 0.51 | <−0.9 | 159/0.19 | 126/0.52 | 166/0.07 | 162/0.20 |

EXAMPLE 3

An AgBrI tabular silver halide emulsion (Emulsion T-2) was prepared containing 4.05% total I distributed such that the central portion of the emulsion grains contained 1.5% I and the perimeter area contained substantially higher I. (see Chang et al. U.S. Pat. No. 5,314,793). The emulsion grains had an average thickness of 0.116 μm and average circular diameter of 1.21 μm. In addition, the following tabular emulsions were prepared each having a uniform halide distribution: Emulsion T-3, an AgBrI tabular emulsion with 1.5% total iodide, having an average thickness of 0.095 μm and an average circular diameter of 1.27 μm; emulsion T-4, an AgBrI tabular emulsion with 3.0% total iodide, having an average thickness of 0.097 μm and an average circular diamenter of 1.14 μm; and emulsion T-5, an AgBr tabular emulsion having an average thickness of 0.084 μm and an average circular diameter of 1.40 μm. Emulsions T-2 through T-5 were all precipitated using deionized gelatin. The emulsions were sulfur sensitized by adding 1,3-dicarboxymethyl-1,3-dimethyl-2-thiourea at 40° C.; the temperature was then raised to 60° C. at a rate of 5° C./3 min and the emulsions held for 20 min. before cooling to 40° C. The amounts of the sulfur sensitizing compound used were $8.5\times10^{-6}$ mole/mole Ag for emulsion T-2, $1.05\times10^{-5}$ mole/mole Ag for emulsion T-3, $1.5\times10^{-5}$ mole/mole Ag for emulsion T-4 and $1.6\times10^{-5}$ mole/mole Ag for emulsion T-5. These chemically sensitized emulsions were then used to prepare the experimental coating variations indicated in Table III.

TABLE III

Speed and Fog Results for Various Emulsions Containing Compound No. 5; Black & White Format

| Test No. | Emulsion Type | Type of Sensitizing Dye | Amount of Dye (mmole/mole Ag) | Amount of Comp'd No. 5 (mmole/mole Ag) | $S_{365}$ | $S_{365/2B}$ D-I | $S_{365/2B}$ D-II | Fog |
|---|---|---|---|---|---|---|---|---|
| 1 | T-2 | — | 0 | 0 | 100 | — | | 0.06 |
| 2 | T-2 | — | 0 | 0.44 | 145 | — | | 0.15 |
| 3 | T-2 | I | 0.91 | 0 | 102 | 100 | | 0.07 |
| 4 | T-2 | I | 0.91 | 0.44 | 151 | 155 | | 0.09 |
| 5 | T-2 | II | 0.43 | 0 | 76 | | 100 | 0.09 |
| 6 | T-2 | II | 0.43 | 0.44 | 91 | | 141 | 0.45 |
| 7 | T-2 | II | 0.86 | 0 | 62 | | 120 | 0.11 |
| 8 | T-2 | II | 0.86 | 0.44 | 112 | | 209 | 0.3 |
| 9 | T-3 | — | 0 | 0 | 100 | — | | 0.07 |
| 10 | T-3 | — | 0 | 0.44 | 151 | — | | 0.07 |
| 11 | T-3 | I | 1.10 | 0 | 55 | 100 | | 0.07 |
| 12 | T-3 | I | 1.10 | 0.44 | 97 | 182 | | 0.07 |
| 13 | T-3 | II | 0.52 | 0 | 28 | | 100 | 0.1 |
| 14 | T-3 | II | 0.52 | 0.44 | 46 | | 159 | 0.11 |
| 15 | T-3 | II | 1.04 | 0 | 3 | | 14 | 0.12 |
| 16 | T-3 | II | 1.04 | 0.44 | 5 | | 25 | 0.13 |
| 17 | T-4 | — | 0 | 0 | 100 | — | | 0.07 |
| 18 | T-4 | — | 0 | 0.44 | 214 | — | | 0.07 |
| 19 | T-4 | I | 1.10 | 0 | 82 | 100 | | 0.07 |
| 20 | T-4 | I | 1.10 | 0.44 | 178 | 214 | | 0.08 |
| 21 | T-4 | II | 0.52 | 0 | 53 | | 100 | 0.1 |
| 22 | T-4 | II | 0.52 | 0.44 | 91 | | 182 | 0.12 |
| 23 | T-5 | — | 0 | 0 | 100 | — | | 0.07 |
| 24 | T-5 | — | 0 | 0.44 | 178 | — | | 0.07 |
| 25 | T-5 | I | 1.26 | 0 | 46 | 100 | | 0.06 |
| 26 | T-5 | I | 1.26 | 0.44 | 107 | 234 | | 0.06 |
| 27 | T-5 | II | 0.60 | 0 | 30 | | 100 | 0.1 |
| 28 | T-5 | II | 0.60 | 0.44 | 52 | | 170 | 0.11 |

Dye I is a blue spectral sensitizing dye of the formula:

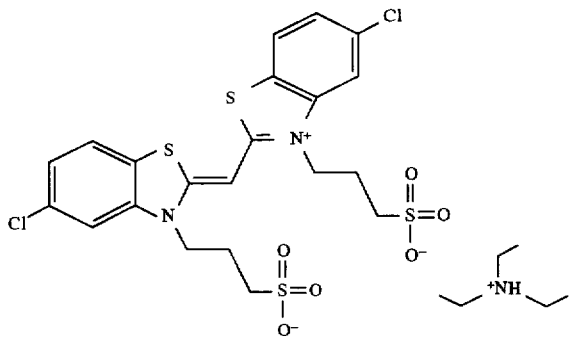

All of the experimental coating variations in Table III contained the hydroxybenzene, 2,4-disulfocatechol (HB3) at a concentration of 13 mmole/mole Ag, added to the melt before any further addenda. Where present, the blue sensitizing dye D-I or the red sensitizing dye D-II were added from methanol solution to the emulsion at 40° C. after the chemical sensitization and disulfocatechol addition. The fragmentable electron donor Compound No. 5 was then added to the emulsion and coatings prepared and tested as described in Example I, except that the additional gelatin used to prepare the coatings described in Table III was deionized gelatin. The coatings were tested for their sensitivity to a 365 nm exposure as described in Example I. For this exposure, relative sensitivity was set equal to 100 for each of the control emulsion coatings with no dye or electron donor added.

Additional testing was carried out to determine the response of the coatings described in Table III to a spectral exposure. Each of the coating strips was exposed for 0.1 sec to a high pressure Xe lamp filtered through a Kodak Wratten filter number 2B and a step wedge ranging in density from 0 to 3 density units in 0.3 density steps. This filter passes only light of wavelengths longer than 400 nm, thus giving light absorbed mainly by any sensitizing dyes present. The exposed film strips were developed for 6 min in Kodak Rapid X-ray Developer (KRX). $S_{WR2B}$, relative sensitivity for this Kodak Wratten filter 2B exposure, was evaluated at a density of 0.15 units above fog. For this exposure, for each emulsion and dye combination, the relative sensitivity was set equal to 100 for the control coating with no electron donor added and the lowest concentration of dye.

The data in Table III show that the fragmentable electron donor Compound No. 5 gave speed gains and little or no fog increase for a 365 nm exposure for all four of these tabular grain emulsions when no sensitizing dye was present. When the emulsions were dyed with the blue or red sensitizing dyes, some loss of sensitivity for a 365 nm exposure was generally observed, indicating dye desensitization. This desensitization was particularly severe for the red sensitizing dye on emulsions T-3, T-4, and T-5. Addition of Compound No. 5 to the dyed emulsions significantly increased the 365 nm speed for all of the dyed emulsions, which indicates that the fragmentable electron donor is effective in ameliorating the dye desensitization. In such a case, it is expected that the spectral speed of the dyed coatings should also be increased by addition of the Compound No. 5. The data in Table III for the sensitivity of the dyed coatings to a Kodak Wratten 2B filter exposure indicate that this expected speed gain was also observed.

EXAMPLE 4

Two cubic emulsions with uniform halide composition were precipitated using deionized gelatin. Emulsion C-1 was a AgBrI emulsion with a 3% I content and a cubic edge length of 0.47 μm and emulsion C-2 was an AgBr emulsion with a cubic edge length of 0.52 μm. The emulsions were sulfur sensitized by adding 1,3-dicarboxymethyl-1,3-dimethyl-2-thiourea at 40° C.; the temperature was then raised to 60° C. at a rate of 5° C./3 min and the emulsions held for 20 min before cooling to 40° C. The amounts of the sulfur sensitizing compound used were $1.0\times10^{-5}$ mole/mole Ag for emulsion C-1, and $6.0\times10^{-6}$ mole/mole Ag for emulsion C-2. These chemically sensitized emulsions were then used to prepare the experimental coating variations indicated in Table IV.

All of the experimental coating variations in Table IV contained hydroxybenzene, 2,4-disulfocatechol (HB3) at a concentration of 13 mmole/mole Ag, added to the melt before any further addenda. Where present, the red sensitizing dye D-II was added from methanol solution to the emulsion at 40° C. after the chemical sensitization and disulfocatechol addition. The fragmentable electron donor Compound No. 5 was then added to the emulsion and coatings prepared and tested as described in Example I, except that the additional gelatin used to prepare the coatings described in Table IV was deionized gelatin. The coatings were tested for their sensitivity to a 365 nm exposure as described in Example I. For this exposure, relative sensitivity was set equal to 100 for each of the control emulsion coatings with no dye or fragmentable electron donor added.

Additional testing was carried out to determine the response of the coatings described in Table IV to a spectral exposure. Each of the coating strips was exposed for 0.1 sec on a wedge spectrographic instrument that covers the wavelength range from 400 to 750 nm. The instrument contains a tungsten light source and a step tablet ranging in density from 0 to 3 density units in 0.3 density steps. After developing exposed strips for 6 min in Kodak Rapid X-ray Developer (KRX), speed was read at 10 nm wavelength intervals at a density of 0.3 above fog. Correction for the instrument's variation in spectral irradiance with wavelength was done with a computer and a plot of relative sensitivity vs. wavelength was generated. The relative sensitivity $S_\lambda$ at the wavelength of maximum spectral sensitivity is reported in Table IV. For this exposure, for each emulsion and dye combination, the relative sensitivity was set equal to 100 for the control coating with no fragmentable electron donor added.

TABLE IV

Speed and Fog Results for Compound 5 on AgBr and AgBrI Cubic Emulsions with Sulfur Sensitization

| Emulsion Type | Type of Sensitizing Dye | Amount of Dye | Amount of Compound 5 | $S_{365}$ | $S_\lambda$ | Fog |
|---|---|---|---|---|---|---|
| C-1 | none | none | none | 100 | — | 0.06 |
| C-1 | none | none | 0.44 | 234 | — | 0.06 |
| C-1 | none | none | 1.42 | 269 | — | 0.06 |
| C-1 | II | 0.44 | none | 118 | 100 | 0.09 |
| C-1 | II | 0.44 | 0.44 | 209 | 182 | 0.10 |
| C-1 | II | 0.44 | 1.42 | 214 | 191 | 0.10 |
| C-2 | none | none | none | 100 | — | 0.05 |
| C-2 | none | none | 0.44 | 178 | — | 0.05 |
| C-2 | none | none | 1.42 | 214 | — | 0.05 |
| C-2 | II | 0.40 | none | 59 | 100 | 0.07 |
| C-2 | II | 0.40 | 0.44 | 97 | 174 | 0.08 |
| C-2 | II | 0.40 | 1.42 | 100 | 174 | 0.08 |

The data in Table IV show that the fragmentable electron donor Compound No. 5 gave speed gains and no fog increase for a 365 nm exposure for both of these cubic emulsions when no sensitizing dye was present. When the AgBrI cubic emulsion C-1 was dyed with the red sensitizing dye D-II, speed gains with minimal fog increase were observed for both the 365 nm exposure and the exposure at the wavelength of maximum sensitivity, λ=660 nm. When the AgBr cubic emulsion C-2 was dyed with the red sensitizing dye, some loss of sensitivity for a 365 nm exposure was observed, indicating dye desensitization. Addition of Compound No. 5 to the red dyed emulsion C-2 significantly improved the 365 nm speed, again indicating that the fragmentable electron donor is effective in ameliorating dye desensitization. As expected, a parallel increase in the speed at the wavelength of maximum spectral sensitivity for the red dyed emulsion C-2 was also observed.

EXAMPLE 5

Two chloride-containing cubic emulsions with uniform halide composition were precipitated using deionized gelatin. Emulsion C-5 was an AgClI emulsion with a 1.5% I content and a cubic edge length of 0.36 μm and emulsion C-6 was an AgCl emulsion with a cubic edge length of 0.37 μm. These two emulsions and the AgBr and AgBrI emulsions described in Example 4 were used without any deliberate chemical sensitization to prepare the experimental coating variations indicated in Table V. The fragmentable electron donor Compound No. 5 was added to the emulsions and coatings prepared and tested as described in Example I, except that the additional gelatin used to prepare the coatings described in Table V was deionized gelatin. For the 365 nm exposure reported in Table 5, relative sensitivity was set equal to 100 for each of the control emulsion coatings with no fragmentable electron donor added.

The data in Table V show that the fragmentable electron donor Compound No. 5 gave increases in sensitivity for a 365 nm exposure for all of these cubic emulsions, regardless of halide composition. No fog increases were observed for these unsensitized emulsions when Compound No. 5 was added.

TABLE V

Speed and Fog Results for Compound 5 on AgBr, AgBrI, AgCl, and AgClI Emulsions with no deliberate Chemical Sensitization.

| Emulsion Type | Amount of Compound 5 | $S_{365}$ | Fog |
|---|---|---|---|
| C-1 | none | 100 | 0.05 |
| C-1 | 1.42 | 347 | 0.05 |
| C-1 | 4.4 | 355 | 0.05 |
| C-2 | none | 100 | 0.04 |
| C-2 | 1.42 | 145 | 0.04 |
| C-2 | 4.4 | 141 | 0.04 |
| C-5 | none | 100 | 0.04 |
| C-5 | 1.42 | 148 | 0.04 |
| C-5 | 4.4 | 132 | 0.04 |
| C-6 | none | 100 | 0.05 |
| C-6 | 1.42 | 120 | 0.05 |
| C-6 | 4.4 | 118 | 0.05 |

EXAMPLE 6

An AgBrI tabular silver halide emulsion (Emulsion T-6) was prepared containing 4.05% total I distributed such that the central portion of the emulsion grains contained 1.5% I and the perimeter area contained substantially higher I, as described by Chang et al., U.S. Pat. No. 5,314,793, the disclosure of which is incorporated herein by reference. The emulsion was doped with low levels of $IrCl_6$ and KSeCN, as described by Johnson and Wightman, U.S. Pat. No. 5,164,293, the disclosure of which is incorporated herein by reference. The emulsion grains had an average thickness of 0.115 μm and average circular 20 diameter of 1.37 μm. The emulsion was optimally chemically and spectrally sensitized by adding NaSCN, 1.07 mmole of the blue sensitizing dye D-I per mole of silver, $Na_3Au(S_2O_3)_2.2H_2O$, $Na_2S_2O_3.5H_2O$, and a benzothiazolium finish modifier and then subjecting the emulsion to a heat cycle to 65° C. This chemically sensitized emulsion was then used to prepare the experimental coating variations given in Table VI.

Where present, the hydroxybenzene, 2,4-disulfocatechol (HB3) was added to the emulsion melt before any further addenda. Where present, the antifoggant and stabilizer tetraazaindene (TAI) was added as the next melt component. The fragmentable electron donors listed in Table VI were then added to the emulsion melt. The melts were then prepared for coating by adding additional water, deionized gelatin, and coating surfactants. Coatings were prepared by combining the emulsion melts with a melt containing deionized gelatin and an aqueous dispersion of the cyan-forming color coupler CC-1 (having the structure shown below), and coating the resulting mixture on acetate support. The final coatings contained Ag at 0.81 g/m$^2$, coupler at 1.61 g/m$^2$, and gelatin at 3.23 g/m$^2$. The coatings were overcoated with a protective layer containing gelatin at 1.08 g/m$^2$, coating surfactants, and bisvinyl sulfonyl methyl ether as a gelatin hardening agent.

For photographic evaluation, each of the coating strips was exposed for 0.01 sec to a 3000 K color temperature tungsten lamp filtered to give an effective color temperature of 5500 K and further filtered through a Kodak Wratten filter number 2B, a 0.15 density neutral density filter, and a step wedge ranging in density from 0 to 3 density units in 0.15 density steps. This exposure gives light absorbed mainly by the blue sensitizing dye. The exposed film strips were developed for 3¼ minutes in Kodak C-41 color developer. $S_{WR2}B$, relative sensitivity for this filtered exposure, was evaluated at a cyan density of 0.2 units above fog. For this exposure, relative sensitivity was set equal to 100 for the control coating with no HB3, TAI, or fragmentable electron donor added.

The data in Table VI show that all four of the fragmentable electron donors tested in this optimally sensitized, blue-dyed emulsion in color format gave significant spectral speed gains with some fog increases. The best combination of speed gain with minimal fog increase was seen for the coatings which also contained the HB3 and TAI as addenda.

CC-1

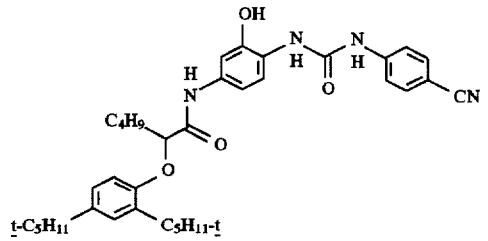

TABLE VI

Speed and Fog Results for Aniline Acetic Acid Compounds in a Blue Sensitized AgBrI T-grain Color Format.

| Compound | Amount added ($10^{-3}$ mole/mole Ag) | Amount of TAI added (gm/mole Ag) | Amount of HB added ($10^{-3}$ mole/mole Ag) | $S_{WR2B}$ | Fog |
|---|---|---|---|---|---|
| None | 0 | 0 | 0 | 100 | 0.16 |
| | 0 | 1.75 | 0 | 110 | 0.15 |
| | 0 | 0 | 13 | 102 | 0.15 |
| | 0 | 1.75 | 13 | 110 | 0.15 |
| 5 | 0.44 | 0 | 0 | 186 | 0.34 |
| 5 | 0.44 | 1.75 | 0 | 155 | 0.23 |
| 5 | 0.44 | 0 | 13 | 191 | 0.44 |
| 5 | 0.44 | 1.75 | 13 | 159 | 0.19 |
| 4 | 0.44 | 0 | 0 | 141 | 0.19 |
| 4 | 0.44 | 1.75 | 0 | 141 | 0.17 |
| 4 | 0.44 | 0 | 13 | 141 | 0.22 |
| 4 | 0.44 | 1.75 | 13 | 138 | 0.17 |
| 7 | 0.44 | 0 | 0 | 174 | 0.32 |
| 7 | 0.44 | 1.75 | 0 | 155 | 0.22 |
| 7 | 0.44 | 0 | 13 | 178 | 0.33 |
| 7 | 0.44 | 1.75 | 13 | 159 | 0.18 |
| 6 | 0.44 | 0 | 0 | 141 | 0.19 |
| 6 | 0.44 | 1.75 | 0 | 141 | 0.18 |
| 6 | 0.44 | 0 | 13 | 141 | 0.19 |
| 6 | 0.44 | 1.75 | 13 | 141 | 0.16 |

EXAMPLE 7

The sulfur sensitized AgBrI tabular emulsion T-1 described in Example 1 was used to prepare the experimental coating variations listed in Table VII, comparing various structurally related fragmentable electron donors varying in first oxidation potential $E_1$. Where present, the red sensitizing dye D-II was added from methanol solution to the emulsion at 40° C. after the chemical sensitization. The fragmentable electron donors were then added to the emulsion and coatings prepared and tested as described in Example 1.

The data in Table VII show that, for the undyed emulsion, all of the fragmentable electron donors gave speed gains with little or no fog increase. At the constant concentration of fragmentable electron donor used, the largest speed increases were observed for the compounds with the lowest values of $E_1$. When the emulsion was dyed with the red sensitizing dye D-II, some loss of sensitivity for a 365 nm exposure was observed, indicating dye desensitization. Addition of Compound No. 11, Compound No. 20, and Compound No. 15 to the red dyed emulsion significantly improved the 365 nm speed to better than or equal to the undyed speed, again indicating that the fragmentable electron donors are effective in ameliorating dye desensitization. However, when Compound No. 40, Compound No. 35, and Compound No. 36, were added to the red dyed emulsion T-1, significant increases in fog were observed. These compounds were generally observed to have lower values of $E_1$ than the Compound No. 11, Compound No. 20, and Compound No. 15, which gave speed increases for the red dyed emulsion without large fog increases.

TABLE VII

Speed and Fog Results for X—Y Compounds on a AgBrI T-grain (Emulsion T-1).

| Compound | $E_1$ | $E_2$ | Amount of Compound Used ($10^{-3}$ mole/mole Ag) | Amount of Sensitizing Dye II ($10^{-3}$ mole/mole Ag) | $S_{365}$ | Fog |
|---|---|---|---|---|---|---|
| None | — | — | 0 | 0 | 100 | 0.06 |
| | | | 0 | 0.82 | 69 | 0.11 |
| 11 | 0.46 | —0.9 | 0.44 | 0 | 135 | 0.07 |
| | | | 0.44 | 0.82 | 105 | 0.16 |
| 20 | 0.46 | <–0.9 | 0.44 | 0 | 132 | 0.07 |
| | | | 0.44 | 0.82 | 112 | 0.17 |
| 15 | 0.36 | <–0.9 | 0.44 | 0 | 138 | 0.06 |
| | | | 0.44 | 0.82 | 115 | 0.13 |
| 40 | 0.38 | <–0.9 | 0.44 | 0 | 159 | 0.06 |
| | | | 0.44 | 0.82 | — | 0.75 |
| 35 | 0.34 | <–0.9 | 0.44 | 0 | 170 | 0.09 |
| | | | 0.44 | 0.82 | — | 1.06 |
| 36 | 0.22 | <–0.9 | 0.44 | 0 | 159 | 0.20 |
| | | | 0.44 | 0.82 | — | 0.77 |

EXAMPLE 8

The chemically sensitized AgBrI tabular emulsion T-2 as described in Example 3 was used to prepare the experimental coating variations listed in Table VIII, further comparing various structurally related fragmentable electron donors varying in first oxidation potential $E_1$. Where present, the sensitizing dyes D-I, D-II, or D-III were added from methanol solution to the emulsion at 40° C. after the chemical sensitization. The fragmentable electron donors were then added to the emulsion and coatings prepared as described in Example 1, except that the additional gelatin used to prepare the coatings described in Table VIII was deionized gelatin. The coatings were tested for their response to a 365 nm exposure as described in Example 1. The coatings were also tested for their response to a spectral exposure using a wedge spectrographic exposure as described in Example 4. For this exposure, for each dye, the relative sensitivity was set equal to 100 for the control coating with no fragmentable electron donor added.

The data in Table VIII show that all of the fragmentable electron donors increased the 365 nm sensitivity of the undyed emulsion and that this sensitivity gain generally increased with increasing concentration of the fragmentable electron donors. Very little or no fog increase was observed for these compounds used with the undyed T-2 emulsion. When the emulsion T-2 was dyed with the blue, green, or red sensitizing dye, a small decrease in 365 nm sensitivity was observed, indicating some dye desensitization. When the fragmentable electron donors were added to the dyed emulsions at optimum concentrations, the 365 nm sensitivity of the emulsions was increased to values equivalent to the 365 nm sensitivity of the undyed emulsion with the fragmentable electron donor present. These data indicate that, under optimum conditions, these fragmentable electron donors can not only ameliorate dye desensitization but also enhance the inherent sensitivity of the emulsion in a manner similar to the sensitivity enhancement imparted to the undyed emulsion by these compounds. The data in Table VIII for $S_\lambda$, the sensitivity at the wavelength of maximum spectral sensitivity, also indicate that the sensitivity increases obtained at 365 nm by use of the fragmentable electron donors were paralleled by increases in spectral sensitivity. These sensitivity enhancements for the dyed emulsions were obtained with minimal increases in fog.

These data together with the data from Example 7 illustrate that the activity of these fragmentable electron donors can be easily varied with substituents to control their speed and fog effects in a manner appropriate to the particular silver halide emulsion in which they are used.

TABLE VIII

Speed and Fog Results for X—Y Compounds on Emulsion T-2

| Compound | $E_1$ | $E_2$ | Amount of Compound ($10^{-3}$ mole/mole Ag) | Type of Sensitizing Dye | Amount of Sensitizing Dye ($10^{-3}$ mole/mole Ag) | $S_{365}$ | $S_\lambda$ | Fog |
|---|---|---|---|---|---|---|---|---|
| None | — | — | 0 | none | 0 | 100 | — | 0.04 |
| 20 | 0.46 | <-0.9 | 0.44 | none | 0 | 120 | — | 0.04 |
| 20 | 0.46 | <-0.9 | 1.4 | none | 0 | 141 | — | 0.05 |
| 20 | 0.46 | <-0.9 | 4.4 | none | 0 | 166 | — | 0.06 |
| 14 | 0.50 | <-0.9 | 0.44 | none | 0 | 120 | — | 0.04 |
| 14 | 0.50 | <-0.9 | 4.4 | none | 0 | 155 | — | 0.05 |
| 14 | 0.50 | <-0.9 | 44 | none | 0 | 159 | — | 0.06 |
| 13 | 0.54 | <-0.9 | 4.4 | none | 0 | 162 | — | 0.04 |
| 13 | 0.54 | <-0.9 | 44 | none | 0 | 170 | — | 0.05 |
| 33 | 0.54 | <-0.9 | 4.4 | none | 0 | 182 | — | 0.06 |
| 33 | 0.54 | <-0.9 | 44 | none | 0 | 186 | — | 0.08 |
| none | — | — | 0 | I | 0.91 | 85 | 100 | 0.04 |
| 20 | 0.46 | <-0.9 | 0.44 | I | 0.91 | 123 | — | 0.04 |
| 20 | 0.46 | <-0.9 | 1.4 | I | 0.91 | 138 | 145 | 0.05 |
| 20 | 0.46 | <-0.9 | 4.4 | I | 0.91 | 151 | 159 | 0.06 |
| 14 | 0.50 | <-0.9 | 0.44 | I | 0.91 | 107 | 120 | 0.05 |
| 14 | 0.50 | <-0.9 | 4.4 | I | 0.91 | 126 | 135 | 0.05 |
| 14 | 0.50 | <-0.9 | 44 | I | 0.91 | 151 | 145 | 0.05 |
| none | — | — | 0 | II | 0.86 | 78 | 100 | 0.09 |
| 20 | 0.46 | <-0.9 | 1.4 | II | 0.86 | 176 | 182 | 0.11 |
| 14 | 0.50 | <-0.9 | 4.4 | II | 0.86 | 126 | 159 | 0.1 |
| 14 | 0.50 | <-0.9 | 44 | II | 0.86 | 155 | 170 | 0.12 |
| 13 | 0.54 | <-0.9 | 4.4 | II | 0.86 | 105 | 132 | 0.10 |
| 13 | 0.54 | <-0.9 | 44 | II | 0.86 | 102 | 126 | 0.10 |
| 33 | 0.54 | <-0.9 | 4.4 | II | 0.86 | 120 | 155 | 0.11 |
| 33 | 0.54 | <-0.9 | 44 | II | 0.86 | 145 | 170 | 0.14 |
| none | — | — | 0 | III | 0.86 | 87 | 100 | 0.08 |
| 20 | 0.46 | <-0.9 | 1.4 | III | 0.86 | 159 | 166 | 0.11 |
| 14 | 0.50 | <-0.9 | 4.4 | III | 0.86 | 151 | 162 | 0.09 |
| 14 | 0.50 | <-0.9 | 44 | III | 0.86 | 178 | 191 | 0.11 |

Dye III is a green spectral sensitizing dye of the formula:

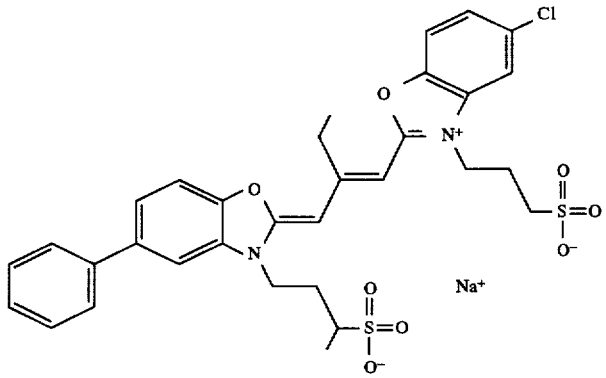

EXAMPLE 9

The chemically sensitized emulsion T-1 as described in Example 1 was used to prepare coatings containing the fragmentable electron donor Si-2, as described in Table IX. In this compound, the first one electron oxidation step is followed by cleavage of the C—Si bond to give a highly reducing radical. The coatings described in Table IX all contain the hydroxybenzene, 2,4-disulfocatechol (HB3) at a concentration of 13 mmole/mole Ag, added to the melt before any further addenda. The electron donor was then added to the emulsion and coatings prepared and tested as described in Example 1.

The data in Table IX demonstrate that this fragmentable electron donor with bond cleavage chemistry differing from that of previous examples was also able to give speed increases on the undyed emulsion T-1. At the optimum concentration of the compound, this speed increase occurred with only a small fog increase.

TABLE IX

Speed and fog results for Si compound with an AgBrI T-grain T (Emulsion T-1)

| Compound | Amount of Compound ($10^{-3}$ mole/mole Ag) | $S_{365}$ | Fog |
|---|---|---|---|
| None | — | 100 | 0.07 |
| 42 | 0.44 | 115 | 0.08 |
| 42 | 1.00 | 135 | 0.11 |
| 42 | 2.00 | 105 | 0.43 |

EXAMPLE 10

The chemically sensitized emulsion T-1 as described in Example 1 was used to prepare coatings containing the fragmentable electron donors Compound Nos. 43 and 44 (fragmentable two electron donors) and Compound Nos. 45 and 46 (fragmentable one electron donors), as described in Table X. These electron donors were added to the emulsion and coatings prepared and tested as described in Example 1, except that the concentrations of electron donor varied from $0.44\times10^{-3}$ mole per silver mole to $4.40\times10^{-3}$ mole per mole of silver.

The data in Table X demonstrate that the fragmentable two-electron donors Compound Nos. 43 and 44 gave large speed increases with little or no fog increase for the undyed emulsion T-1 for each of the donor concentrations examined. In contrast, the fragmentable one electron donors Compound Nos. 45 and 46 gave smaller speed increases when examined at equivalent concentrations.

TABLE X

Speed and Fog Results for X—Y Compounds on Emulsion T-1 (NO HB3)

| Compound | $E_1$ | $E_2$ | Amount of Compound ($10^{-3}$ mole/mole Ag) | $S_{365}$ | Fog |
|---|---|---|---|---|---|
| None | — | — | 0 | 100 | 0.06 |
| 43 | 0.61 | −0.89 | 0.44 | 138 | 0.06 |
| | | | 1.40 | 159 | 0.06 |
| | | | 4.40 | 182 | 0.07 |
| 44 | 0.64 | −0.81 | 0.44 | 120 | 0.06 |
| | | | 1.40 | 132 | 0.06 |
| | | | 4.40 | 138 | 0.07 |
| 45 | 0.64 | −0.56 | 0.44 | 107 | 0.07 |
| | | | 1.40 | 120 | 0.07 |
| | | | 4.40 | 129 | 0.08 |
| 46 | 0.68 | −0.34 | 0.44 | 100 | 0.07 |
| | | | 1.40 | 112 | 0.06 |
| | | | 4.40 | 123 | 0.07 |

EXAMPLE 11

The chemically sensitized emulsion T-2 as described in Example 3 was used to prepare coatings containing the fragmentable two-electron donors Compound No. 5, Compound No. 24 and Compound No. 26, and the comparative compounds Comp-4, Comp-5, and Comp-6, as described in Table XI. Compound No. 5, Compound No. 24 and Compound No. 26 are in the carboxylate form, which fragments after oxidation, and satisfy all three criteria for a fragmentable two-electron donor. The comparison compounds Comp-4, Comp-5, and Comp-6 are similarly structured compounds except that they are the corresponding ethyl esters related to Compound No. 5, Compound No. 24, and Compound No. 26. Because the comparison compounds are ethyl esters and not carboxylates, they do not fragment after oxidation. The comparison compounds thus satisfy only the first criterion regarding $E_1$. The fragmentable two-electron donors and comparative compounds were dissolved in water or methanol solution and then added to the emulsion and coatings prepared and tested as described in Example 1.

The data in Table XI illustrate that the fragmentable two-electron donors Compound No. 5, Compound No. 24, and Compound No. 26 gave large sensitivity increases, of a factor of about 1.6 to about 1.8, relative to the undyed control coating that did not contain these compounds. These sensitivity gains could be obtained with only minor increases in fog levels. In contrast, the corresponding esters, Comp-4, Comp-5, and Comp-6 gave little or no sensitivity increase, illustrating the relative inactivity of these compounds. The data of Table XI illustrate that the ability to fragment upon oxidation is a critical feature of fragmentable two-electron donors.

TABLE XI

Invention vs Comparative compounds

| Test No. | Comp'd | Type | $E_1$ | $E_2$ | Amount of compound added ($10^{-3}$ mole/mole Ag) | $S_{365}$ | Fog | Remarks |
|---|---|---|---|---|---|---|---|---|
| 1 | None | control | — | — | 0 | 100 | 0.06 | control |
| 2 | 5 | "carboxylate form" | 0.51 | <−0.9 | 0.44 | 162 | 0.18 | invention |

TABLE XI-continued

Invention vs Comparative compounds

| Test No. | Comp'd | Type | $E_1$ | $E_2$ | Amount of compound added ($10^{-3}$ mole/mole Ag) | $S_{365}$ | Fog | Remarks |
|---|---|---|---|---|---|---|---|---|
| 3 | Comp-4 | "ester form" | 0.78 | none | 0.44 | 112 | 0.08 | comparison |
| 4 | 24 | "carboxylate form" | 0.52 | <-0.9 | 1.4 | 170 | 0.11 | invention |
| 5 | 24 | "carboxylate form" | " | " | 4.4 | 178 | 0.22 | invention |
| 6 | Comp-5 | "ester form" | 0.90 | none | 1.4 | 107 | 0.06 | comparison |
| 7 | Comp-5 | " | | " | 4.4 | 102 | 0.06 | comparison |
| 8 | 26 | "carboxylate form" | 0.51 | <-0.9 | 4.4 | 174 | 0.12 | invention |
| 9 | 26 | "carboxylate form" | " | " | 14 | 178 | 0.12 | invention |
| 10 | Comp-6 | "ester form" | 0.97 | none | 4.4 | 100 | 0.06 | comparison |
| 11 | Comp-6 | " | " | " | 14 | 100 | 0.05 | comparison |

EXAMPLE 12

The sulfur sensitized AgBrI tabular emulsion T-2 as described in Example 3 was used to prepare the experimental coating variations listed in Table XII, further comparing various structurally related fragmentable two-electron donors varying in first oxidation potential $E_1$. Where present, the sensitizing dye D-II was added from methanol solution to the emulsion at 40° C. after the chemical sensitization. The two-fragmentable electron donors were then added to the emulsion and coatings prepared as described in Example 1, except that the additional gelatin used to prepare the coatings described in Table XII was deionized gelatin. The coatings were tested for their response to a 365 nm exposure as described in Example 1.

In the manner of Example 8, the data in Table XII show that all of the two-fragmentable electron donors used in this example increased the 365 nm sensitivity of the undyed emulsion and that this sensitivity gain generally increased with increasing concentration of the fragmentable two-electron donors. Depending on the concentration used, very little or no fog increase was observed for these compounds used with the undyed T-2 emulsion. When the emulsion T-2 was dyed with the red sensitizing dye, a small decrease in 365 nm sensitivity was observed, indicating some dye desensitization. When the two-fragmentable electron donors were added to the dyed emulsions at optimum concentrations, the 365 nm sensitivity of the emulsions was increased to values equivalent to, and in a few cases slightly greater than, the 365 nm sensitivity of the undyed emulsion with the fragmentable two-electron donor absent. These data indicate that, under optimum conditions, these fragmentable two-electron donors can ameliorate dye desensitization.

The data of Table XII also show that the optimum level of fragmentable two-electron donor that gives the highest 365 nm sensitivity and lowest emulsion fog depends on the value of the oxidation potential $E_1$. Fragmentable two-electron donors that have a relatively low oxidation potential $E_1$ are more active and are more prone to causing both an increase in emulsion speed and emulsion fog. Thus for the lower oxidation potential fragmentable two-electron donors relatively less compound need be employed. As shown in Table XII for the emulsion with no added sensitizing dye, the low oxidation potential Compound No. 39 and Compound No. 37 exhibit optimum usage levels of about $0.44\times10^{-3}$ mole/mole Ag. In comparison, compounds with higher values of $E_1$, such as Compound Nos. 42 and 34 are somewhat less active and less prone to causing a fog increase. Compound Nos. 34 and 42 exhibit optimum levels that are threefold higher than Compound Nos. 39 and 37, at $1.4\times10^{-3}$ mole/mole Ag. Correspondingly larger amounts of fragmentable two-electron donor can be employed for those with even higher oxidation potential $E_1$. Table XII shows for example, that for Compound Nos. 27 and 25 levels as a high as $44\times10^{-3}$ mole/mole Ag can be used to obtain the optimum emulsion speed with little or no fog increase.

The data of Table XII indicate a similar relationship between optimum usage level and oxidation potential $E_1$ for the emulsion containing sensitizing dye. Because the emulsion containing sensitizing dye II is somewhat more prone to fog, the optimum usage level of a given fragmentable two-electron-donor in the dyed emulsion is lower than that when no spectral sensitizer is present. Nevertheless, levels as high as $44\times10^{-3}$ mole/mole Ag can be used with the higher $E_1$ Compound Nos. 27 and 25 on the dyed emulsion with very minimal fog increase.

TABLE XII

Speed and Fog Results for X—Y Compounds on Emulsion T-2:

| Comp'd | $E_1$ | $E_2$ | Amount of Compound ($10^{-3}$ mole/mole Ag) | Type of Sensitizing Dye | Amount of Sensitizing Dye ($10^{-3}$ mole/mole Ag) | $S_{365}$ | Fog |
|---|---|---|---|---|---|---|---|
| None | — | — | 0 | none | 0 | 100 | 0.05 |
| " | | | 0 | II | 0.86 | 65 | 0.09 |
| 39 | 0.40 | <-0.9 | 0.44 | none | 0 | 141 | 0.08 |
| " | | | 1.4 | none | 0 | 166 | 0.16 |
| " | | | 4.4 | none | 0 | 141 | 0.40 |
| " | | | 0.14 | II | 0.86 | — | 0.87 |
| " | | | 0.44 | II | 0.86 | — | 1.24 |
| " | | | 1.4 | II | 0.86 | — | 1.50 |
| 37 | 0.43 | <-0.9 | 0.44 | none | 0 | 162 | 0.07 |
| " | | | 4.4 | none | 0 | 151 | 0.42 |
| " | | | 0.14 | II | 0.86 | 110 | 0.41 |
| " | | | 0.44 | II | 0.86 | — | 0.85 |
| 38 | 0.48 | <-0.9 | 1.4 | none | 0 | 145 | 0.06 |
| " | | | 4.4 | none | 0 | 170 | 0.07 |
| " | | | 14 | none | 0 | 186 | 0.08 |
| " | | | 0.44 | II | 0.86 | 80 | 0.11 |
| " | | | 1.4 | II | 0.86 | 100 | 0.12 |
| " | | | 4.4 | II | 0.86 | 112 | 0.17 |
| 41 | 0.48 | <-0.9 | 1.4 | none | 0 | 178 | 0.06 |
| " | | | 4.4 | none | 0 | 200 | 0.08 |
| " | | | 14 | none | 0 | 200 | 0.10 |
| " | | | 0.44 | II | 0.86 | 110 | 0.12 |
| " | | | 1.4 | II | 0.86 | 129 | 0.17 |
| " | | | 4.4 | II | 0.86 | 135 | 0.22 |
| 34 | 0.52 | <-0.9 | 1.4 | none | 0 | 178 | 0.08 |
| " | | | 4.4 | none | 0 | 191 | 0.11 |
| " | | | 14 | none | 0 | 178 | 0.18 |
| " | | | 0.44 | II | 0.86 | 118 | 0.22 |
| " | | | 1.4 | II | 0.86 | 107 | 0.44 |
| " | | | 4.4 | II | 0.86 | — | 0.88 |
| 24 | 0.52 | <-0.9 | 0.44 | none | 0 | 151 | 0.09 |
| " | | | 1.4 | none | 0 | 174 | 0.10 |
| " | | | 4.4 | none | 0 | 182 | 0.17 |
| " | | | 0.44 | II | 0.86 | 100 | 0.16 |
| " | | | 1.4 | II | 0.86 | 129 | 0.26 |
| " | | | 4.4 | II | 0.86 | 100 | 0.50 |
| 26 | 0.51 | <-0.9 | 4.4 | none | 0 | 191 | 0.12 |
| " | | | 14 | none | 0 | 186 | 0.20 |
| " | | | 44 | none | 0 | 186 | 0.24 |
| " | | | 4.4 | II | 0.86 | 115 | 0.30 |
| " | | | 14 | II | 0.86 | 94 | 0.53 |
| " | | | 44 | II | 0.86 | 89 | 0.52 |
| 32 | 0.58 | <-0.9 | 4.4 | none | 0 | 162 | 0.06 |
| " | | | 44 | none | 0 | 191 | 0.06 |
| " | | | 4.4 | II | 0.86 | 110 | 0.11 |
| " | | | 44 | II | 0.86 | 138 | 0.13 |
| 30 | 0.60 | <-0.9 | 1.4 | none | 0 | 159 | 0.05 |
| " | | | 4.4 | none | 0 | 191 | 0.08 |
| " | | | 14 | none | 0 | 214 | 0.21 |
| " | | | 4.4 | II | 0.86 | 115 | 0.12 |
| 27 | 0.62 | <-0.9 | 4.4 | none | 0 | 166 | 0.05 |
| " | | | 44 | none | 0 | 195 | 0.05 |
| " | | | 4.4 | II | 0.86 | 97 | 0.10 |
| " | | | 44 | II | 0.86 | 123 | 0.10 |
| 25 | 0.62 | <-0.9 | 4.4 | none | 0 | 170 | 0.05 |
| " | | | 14 | none | 0 | 195 | 0.05 |
| " | | | 44 | none | 0 | 195 | 0.06 |
| " | | | 4.4 | II | 0.86 | 105 | 0.11 |
| " | | | 14 | II | 0.86 | 120 | 0.13 |
| | | | 44 | II | 0.86 | 135 | 0.16 |

EXAMPLE 13

The chemically sensitized emulsion T-2 as described in Example 3 was used to prepare coatings containing the fragmentable two-electron donor Compound No. 48, as described in Table XIII. In this example, the electron donor is derived from a class of compounds X—Y wherein the fragment X is an alkoxy-substituted benzyl group. The neutral radical formed from the oxidation and decarboxylation of Compound No. 48 is highly reducing as indicated in Table C. The experimental coatings prepared with Compound No. 48 were tested for their response to a 365 nm exposure as described in Example 1. Where present, the sensitizing dye D-II was added from methanol solution to the emulsion at 40° C. after the chemical sensitization.

The data in Table XIII demonstrate that this fragmentable two-electron donor containing the trialkoxybenzyl fragment gave speed increases on the undyed emulsion T-2. Because this fragmentable two-electron donor has a relatively high oxidation potential $E_1$, relatively high levels, up to $44\times10^{-3}$ mole or more of the fragmentable two-electron donor per mole of Ag, can be utilized in the emulsion layer to achieve a maximum gain in speed with no increase in fog.

Speed gains are also observed on the emulsion dyed with D-II. When the compound Compound No. 48 was added to the dyed emulsion the 365 nm sensitivity of the emulsion was increased to values equivalent to, and in a few cases slightly greater than, the 365 nm sensitivity of the undyed emulsion with the Compound No. 48 compound absent. These data indicate that this fragmentable two-electron donor can ameliorate dye desensitization. Furthermore, the data of Table XIII show that at the optimum concentration of the compound Compound No. 48, this speed increase occurred with only a small fog increase.

TABLE XIII

Speed and Fog Results for Compound No. 48 on Emulsion T-2 no HB3

| Comp'd | $E_1$ | $E_2$ | Amount of Compound ($10^{-3}$ mole/mole Ag) | Type of Sensitizing Dye | Amount of Sensitizing Dye ($10^{-3}$ mole/mole Ag) | $S_{365}$ | Fog |
|---|---|---|---|---|---|---|---|
| None | — | — | 0 | none | 0 | 100 | 0.05 |
| " | | | 0 | II | 0.86 | 60 | 0.10 |
| 48 | 0.70 | <-0.9 | 1.4 | none | 0 | 126 | 0.05 |
| " | | | 4.4 | none | 0 | 132 | 0.05 |
| " | | | 44 | none | 0 | 151 | 0.05 |
| " | | | 1.4 | II | 0.86 | 135 | 0.15 |
| | | | 4.4 | II | 0.86 | 118 | 0.15 |
| " | | | 44 | II | 0.86 | 138 | 0.20 |

EXAMPLE 14

The AgBrI tabular silver halide emulsion T-2 as described in Example 2 was optimally chemically and spectrally sensitized by adding NaSCN, the green sensitizing dye D-III, $Na_3Au(S_2O_3)_2.2H_2O$, $Na_2S_2O_3.5H_2O$, and a benzothiazolium finish modifier and then subjecting the emulsion to a heat cycle to 65° C. This chemically sensitized emulsion was then used to prepare the experimental coating variations given in Table XIV.

For all the variations in Table XIV, the antifoggant and stabilizer tetraazaindene (TAI) was added to the emulsion melt in an amount of 1.75 gm/mole Ag before any further addenda. The fragmentable electron donors listed in Table XIV were then added to the emulsion melt. The color format coatings were then prepared and tested as described in Example 6.

The data in Table XIV demonstrate that the fragmentable electron donors Compound No. 20 and Compound No. 14 give speed gains with reasonable fog increases when added in properly chosen amounts to this optimally sensitized, green dyed tabular emulsion.

TABLE XIV

Speed and Fog Results for Compound No. 20 and Compound No. 14 in a Green Sensitized AgBrI tabular emulsion Color Format

| Compound | Amount added ($10^{-3}$ mole/mole Ag) | $S_{WR2B}$ | Fog |
|---|---|---|---|
| None | — | 100 | 0.12 |
| 20 | 1.4 | 123 | 0.36 |
| 14 | 4.4 | 120 | 0.32 |
| | 44 | — | 0.75 |

EXAMPLE 15

The AgBrI cubic silver halide emulsion C-1 as described in Example 4 was optimally chemically and spectrally sensitized by adding the red sensitizing dye combination D-II plus D-IV at a 5:1 molar ratio, $Na_3Au(S_2O_3)_2.2H_2O$, $Na_2S_2O_3.5H_2O$, and a benzothiazolium finish modifier and then subjecting the emulsion to a heat cycle to 65° C. This chemically sensitized emulsion was then used to prepare the experimental coating variations given in Table XV.

D-IV

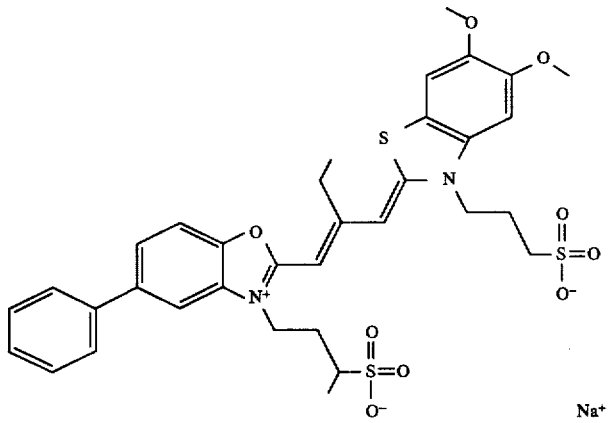

For all the variations in Table XV, the antifoggant and stabilizer tetraazaindene (TAI) was added to the emulsion melt in an amount of 1.75 gm/mole Ag before any further addenda. The fragmentable electron donor Compound No. 14 was then added to the emulsion melt. The color format coatings were then prepared and tested as described in Example 6.

The data in Table XV demonstrate that the fragmentable electron donor Compound No. 14 gives speed gains with reasonable fog increases when added in properly chosen amounts to this optimally sensitized, red dyed cubic emulsion.

TABLE XV

Speed and Fog Results for Compound No. 14 in a Red Sensitized AgBrI cubic emulsion Color Format

| Compound | Amount added ($10^{-3}$ mole/mole Ag) | $S_{WR2B}$ | Fog |
|---|---|---|---|
| None | — | 100 | 0.16 |
| 14 | 4.4 | 135 | 0.20 |
| | 44 | 145 | 0.32 |

EXAMPLE 16

The sulfur sensitized AgBrI tabular emulsion T-2 as described in Example 3 was used to prepare the experimental coating variations listed in Table XVI, comparing sensitivity increases obtained from adding Compound No. 14 and Compound No. 25, fragmentable electron donors with relatively high first oxidation potentials $E_1$, to coatings dyed with a series of sensitizing dyes varying in oxidation potential $E_{ox}$.

The dyes in the series were D-II, D-V, D-VI, D-VII, D-VIII, and D-IX.

D-V

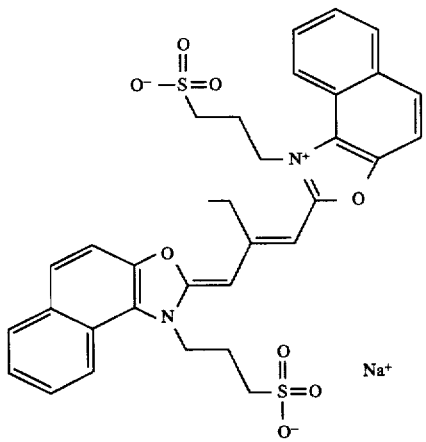

D-VI

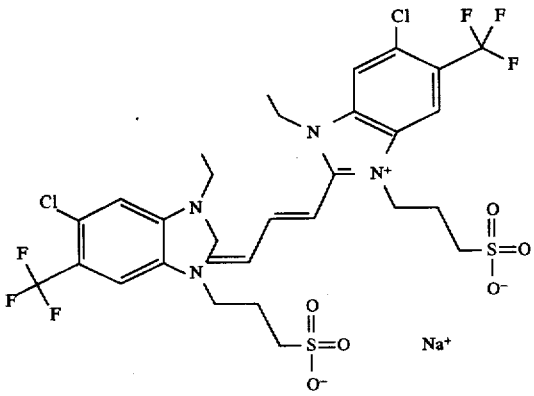

D-VII

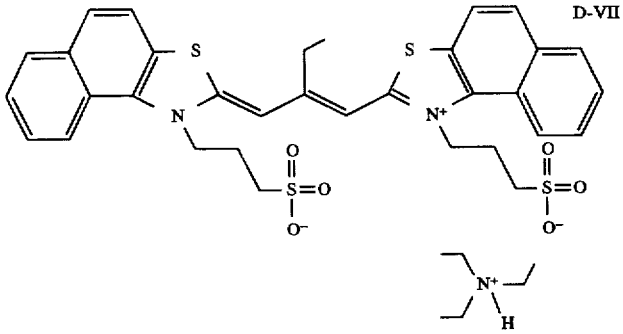

-continued

D-VIII

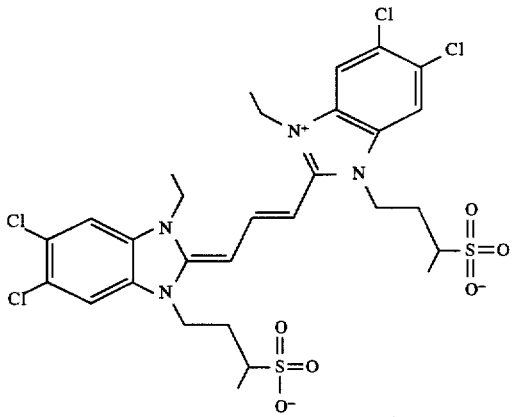

D-IX

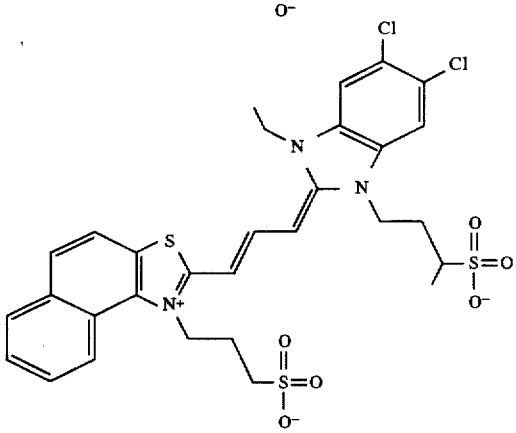

Measurement of the oxidation potential of the sensitizing dyes for use in the present invention is made by phase selective second harmonic ac voltammetry as described in Journal of Imaging Science, Vol 30, pp 27–35 (1986). The details of the measurement are as follows: Acetonitrile (spectral grade) as dried over 4A molecular sieves was used as the solvent, tetraethylammonium fluoroborate was used as the supporting electrolyte, sample solutions were prepared by dissolving ca. $10^{-3}$ mole/liter of the sensitizing dye in acetonitrile containing 0.1M of the supporting electrolyte. A platinum disk was used as the working electrode, a platinum wire was the counter electrode, and a saturated calomel electrode SCE was used as the reference electrode. Measurements were made at 22° C. at a frequency of 400 Hz and a potential scan rate of 50 mV/s.

Where present, the sensitizing dyes were added from methanol solution to the emulsion at 40° C. after the chemical sensitization. The fragmentable electron donors were then added to the emulsion and coatings prepared as described in Example 1, except that the additional gelatin used to prepare the coatings described in Table XVI was deionized gelatin. The coatings were tested for their response to a 365 nm exposure as described in Example 1.

The data in Table XVI show that for Compound No. 14, which has a first oxidation potential $E_1$ of 0.5 V, the largest gains in 365 nm sensitivity relative to the control coating with no fragmentable electron donor (2 to 2.3×) were found for the undyed coatings and the coatings with dyes with $E_{ox}$ of 0.8 V or larger. Sensitivity increases for Compound No. 14 were seen when used with the dyes with $E_{ox}$ as low as 0.55 V but these increases were smaller (1.5 to 1.6×). For Compound No. 25, which has a first oxidation potential $E_1$ of 0.62 V, the largest gains in 365 nm sensitivity were again seen for the undyed coatings and the coatings with $E_{ox}$ of 0.8 V or larger. Sensitivity increases for Compound No. 25 when used with the dyes of $E_{ox}$ as low as 0.55 V were 1.2 to 1.3×, smaller than the comparable sensitivity increases for Compound No. 14. These data illustrate that these fragmentable electron donors can provide useful sensitivity increases for emulsions spectrally sensitized with dyes having a broad range of oxidation potentials, including dyes with oxidation potentials at least as low as 0.55V.

TABLE XVI

Photographic Data for X—Y Compounds With Sensitizing Dyes on AgBrI Tabular Emulsion

| Sensitizing Dye | Sensitizing Dye $E_{OX}$ (V vs SCE) | Amount of Sensitizing Dye ($10^{-3}$ mole/mole Ag) | Electron Donor Used | Amount of Compound Used ($10^{-3}$ mole/mole Ag) | $S_{365}$ | Fog |
|---|---|---|---|---|---|---|
| none | — | 0 | none | 0 | 100 | 0.05 |
| | | 0 | 14 | 44 | 200 | 0.09 |
| | | 0 | 25 | 44 | 182 | 0.07 |
| II | 0.887 | 0.86 | none | 0 | 69 | 0.11 |
| | | 0.86 | 14 | 44 | 145 | 0.13 |
| | | 0.86 | 25 | 44 | 118 | 0.11 |
| V | 0.78 | 0.86 | none | 0 | 63 | 0.12 |
| | | 0.86 | 14 | 44 | 148 | 0.16 |
| | | 0.86 | 25 | 44 | 115 | 0.12 |
| VI | 0.632 | 0.86 | none | 0 | 87 | 0.05 |
| | | 0.86 | 14 | 44 | 162 | 0.08 |
| | | 0.86 | 25 | 44 | 118 | 0.05 |
| VII | 0.66 | 0.86 | none | 0 | 21 | 0.08 |
| | | 0.86 | 14 | 44 | 40 | 0.11 |
| | | 0.86 | 25 | 44 | 30 | 0.08 |

TABLE XVI-continued

Photographic Data for X—Y Compounds With Sensitizing Dyes on AgBrI Tabular Emulsion

| Sensitizing Dye | Sensitizing Dye $E_{ox}$ (V vs SCE) | Amount of Sensitizing Dye ($10^{-3}$ mole/mole Ag) | Electron Donor Used | Amount of Compound Used ($10^{-3}$ mole/mole Ag) | $S_{365}$ | Fog |
|---|---|---|---|---|---|---|
| VIII | 0.557 | 0.86 | none | 0 | 89 | 0.05 |
| | | 0.86 | 14 | 44 | 135 | 0.08 |
| | | 0.86 | 25 | 44 | 105 | 0.05 |
| IX | 0.545 | 0.86 | none | 0 | 62 | 0.13 |
| | | 0.86 | 14 | 44 | 97 | 0.21 |
| | | 0.86 | 25 | 44 | 80 | 0.13 |

13) using a hydroxybenzene compound at $13\times10^{-3}$ mole/mole Ag. Likewise, for the emulsions containing a red or green spectral sensitizing dye, the level of fog can be lowered by a factor of 4 or more. Furthermore, the sensitivity $S_{365}$ of the emulsion is not reduced by the presence of the hydroxybenzene compound. The coatings containing the combination of hydroxybenzene compound and fragmentable two-electron donor generally provide greater sensitivity and lower fog when compared to the control coatings (tests # 4–6). The data of Table 17 demonstrate that these fog and sensitivity benefits can be obtained for a wide variety of hydroxybenzene compounds.

TABLE XVII

Use of Hydroxybenzenes (HB) to Lower Emulsion Fog

| Test No. | HB Used | Am't of HB ($10^{-3}$ mole/mole Ag) | Type of Sensitizing Dye | Amount of Dye ($10^{-3}$ mole/mole Ag) | Amount of Cmp'd 5 Added ($10^{-3}$ mole/mole Ag) | | Fog | Result |
|---|---|---|---|---|---|---|---|---|
| 1 | none | 0 | none | 0 | 0 | 100 | 0.07 | Control |
| 2 | none | 0 | II | 0.84 | 0 | 71 | 0.12 | " |
| 3 | none | 0 | III | 0.84 | 0 | 73 | 0.09 | " |
| 4 | none | 0 | none | 0 | 0.44 | 126 | 0.33 | Control |
| 5 | none | 0 | II | 0.84 | 0.44 | — | 0.82 | " |
| 6 | none | 0 | III | 0.84 | 0.44 | — | 1.57 | " |
| 7 | HB3 | 13 | none | 0 | 0.44 | 162 | 0.08 | Invention |
| 8 | HB3 | 13 | II | 0.84 | 0.44 | 115 | 0.43 | Invention |
| 9 | HB3 | 13 | III | 0.84 | 0.44 | — | 1.31 | Invention |
| 10 | HB7 | 13 | none | 0 | 0.44 | 141 | 0.16 | Invention |
| 11 | HB7 | 13 | II | 0.84 | 0.44 | 112 | 0.38 | Invention |
| 12 | HB7 | 13 | III | 0.84 | 0.44 | — | 1.03 | Invention |
| 13 | HB4 | 13 | none | 0 | 0.44 | 155 | 0.08 | Invention |
| 14 | HB4 | 13 | II | 0.84 | 0.44 | 138 | 0.19 | Invention |
| 15 | HB4 | 13 | III | 0.84 | 0.44 | 123 | 0.53 | Invention |
| 16 | HB8 | 13 | none | 0 | 0.44 | 148 | 0.09 | Invention |
| 17 | HB8 | 13 | II | 0.84 | 0.44 | 129 | 0.24 | Invention |
| 18 | HB8 | 13 | III | 0.84 | 0.44 | — | 0.78 | Invention |
| 22 | HB5 | 13 | II | 0.84 | 0.44 | 145 | 0.17 | Invention |
| 23 | HB5 | 13 | III | 0.84 | 0.44 | 159 | 0.44 | Invention |

EXAMPLE 17

The chemically sensitized emulsion T-1 as described in Example 1 was used to prepare coatings containing a fragmentable two-electron donor and various hydroxybenzene compounds HB as described in Table XVII. The hydroxybenzene compounds used are mild reducing agents and were added to the melt at a concentration of 13 mmole/mole Ag before any further addenda. Where present, the red D-II or green D-III sensitizing dye was added from methanol solution to the emulsion at 40° C., and then the fragmentable two-electron donor Compound No. 5 was added to the emulsion. Coatings of the emulsion were prepared and tested as described in Example 1.

The data in Table XVII demonstrate that the fog increases that sometimes occur when certain fragmentable two-electron donors are added to an emulsion can be significantly lowered with the use of hydroxybenzene compounds. For the undyed emulsion containing the fragmentable two-electron donor Compound No. 5 the level of fog can be reduced from 0.33 (test #4) to as little as 0.08 (tests #7 and

EXAMPLE 18

As described in Example 1, the chemically sensitized AgBrI emulsion T-1 was used to prepare coatings with and without the red sensitizing dye D-II. Samples of each coating were exposed to a xenon flash of $10^{-3}$ sec duration filtered through a 2.0 neutral density filter, Kodak Wratten filters 35 and 38A, and a step wedge ranging in density from 0 to 3 density units in 0.15 density steps. These conditions allowed only blue light to expose the coatings. After exposure, one sample of each coating was subjected to each of the following treatments:

A. No post-exposure bath

B. Post-exposure bath for 15 min in a solution of $5.4\times10^{-4}$M NaBr at pH=6.0.

C. Post-exposure bath for 15 min in a solution of $5.4\times10^{-4}$M NaBr and $3\times10^{-4}$M Compound No. 5 at pH=6.0.

The coatings subjected to the post-exposure baths were then blotted to remove excess solution and all coatings were developed together for 6 min in Kodak Rapid X-ray Developer (KRX). Relative sensitivity to blue light, Sblue, was evaluated at a density of 0.15 units above fog.

The data in Table XVIII show that bathing the fragmentable two-electron donor Compound No. 5 into the coatings after exposure resulted in significant speed gains relative to bathing the coating in a similar solution with no Compound No. 5. These speed gains were seen for both the undyed and dyed coatings. These data demonstrate that the fragmentable two-electron donors can give beneficial photographic speed effects when added to coatings after exposure.

TABLE XVIII

Speed and Fog Results for Compound No. 5 Bathed into Coatings after Exposure

| Treatment | Amount of dye D-II in coating ($10^{-3}$ mole/mole Ag) | $S_{blue}$ | Fog |
|---|---|---|---|
| A. No bath | 0 | 100 | 0.04 |
| B. Blank bath | 0 | 110 | 0.04 |
| C. Cpd, No. 5 bath | 0 | 204 | 0.08 |
| A. No bath | 0.82 | 71 | 0.08 |
| B. Blank bath | 0.82 | 89 | 0.08 |
| C. Cpd. No. 5 bath | 0.82 | 182 | 0.35 |

EXAMPLE 19

The chemically sensitized AgBrI tabular emulsion T-2 as described in Example 3 was used to prepare the experimental coating variations listed in Table XIX, further comparing various structurally related fragmentable electron donors varying in first oxidation potential $E_1$. Where present, the sensitizing dye D-II was added from methanol solution to the emulsion at 40° C. after the chemical sensitization. The fragmentable electron donors were then added to the emulsion and coatings prepared as described in Example 1, except that the additional gelatin used to prepare the coatings described in Table XIX was deionized gelatin. The coatings were tested for their response to a 365 nm exposure as described in Example 1. For this exposure, the relative sensitivity was set equal to 100 for the coating with no dye or fragmentable electron donor. The coatings were also tested for their response to a spectral exposure using a wedge spectrographic exposure as described in Example 4. For this exposure, the relative sensitivity was set equal to 100 for the control coating with no fragmentable electron donor.

The data in Table XIX show that all of the fragmentable electron donors Compound Nos. 49, 50, 51 and 48 increased the 365 nm sensitivity of the undyed emulsion and that this sensitivity gain generally increased with increasing concentration of the fragmentable electron donors. The sensitivity increases obtained using the compounds with $E_1$>1.0 V, specifically Compound Nos. 49 and 50, are small compared to the sensitivity increases obtained with Compound Nos. 51 and 48, which have $E_1$ of ~0.8–0.9 V. Similarly, on the emulsion dyed with D-II, the 365 nm sensitivity increase for Compound Nos. 49 and 50 is significantly smaller than that obtained with Compound Nos. 51 and 48. However, these data indicate that, under optimum conditions, these fragmentable electron donors can ameliorate dye desensitization. The data in Table XIX for $S_\lambda$, the sensitivity at the wavelength of maximum spectral sensitivity, also indicate that the sensitivity increases obtained at 365 nm by the use of the fragmentable electron donors were paralleled by increases in spectral sensitivity.

Very little or no fog increase was observed for these compounds used with either the undyed T-2 emulsion or the emulsion dyed with the red sensitizing dye D-II. The data of Table XIX demonstrate that fragmentable electron donors with $E_1$ as great as 1.2 V can give sensitivity increases, but that fragmentable electron donors with $E_1$ less than about 1.0 V give larger sensitivity increases and thus are more preferred.

TABLE XIX

Speed and Fog Results for X—Y Compounds on Emulsion T-2

| Comp'd | $E_1$ | $E_2$ | Amount of Compound ($10^{-3}$ mole/mole Ag) | Type of Sensitizing Dye | Amount of Sensitizing Dye ($10^{-3}$ mole/mole Ag) | $S_{365}$ | $S_\lambda$ | Fog |
|---|---|---|---|---|---|---|---|---|
| None | — | — | 0 | none | 0 | 100 | — | 0.05 |
| 49 | ~1.2 | —0.75 | 4.4 | none | 0 | 102 | — | 0.04 |
| 49 | " | " | 44 | none | 0 | 105 | — | 0.05 |
| 50 | ~1.05 | <-0.9 | 4.4 | none | 0 | 107 | — | 0.05 |
| 50 | " | " | 44 | none | 0 | 105 | — | 0.05 |
| 51 | 0.92 | " | 4.4 | none | 0 | 112 | — | 0.05 |
| 51 | " | " | 44 | none | 0 | 186 | — | 0.06 |
| 48 | 0.70 | " | 44 | none | 0 | 166 | — | 0.04 |
| None | — | — | 0 | II | 0.86 | 60 | 100 | 0.10 |
| 49 | ~1.2 | —0.75 | 4.4 | II | " | 62 | 100 | 0.10 |
| 49 | " | " | 44 | II | " | 60 | 97 | 0.10 |
| 50 | ~1.05 | <-0.9 | 4.4 | II | " | 60 | 100 | 0.10 |
| 50 | " | " | 44 | II | " | 63 | 105 | 0.10 |
| 51 | 0.92 | " | 4.4 | II | " | 59 | 105 | 0.09 |
| 51 | " | " | 44 | II | " | 112 | 178 | 0.11 |
| 48 | 0.70 | " | 44 | II | " | 126 | 191 | 0.11 |

EXAMPLE 20

The chemically sensitized AgBrI tabular emulsion T-2 As described in Example 3 was used to prepare the experimental coating variations listed in Table XX, comparing various fragmentable one-electron donors to structurally related one-electron donors that do not fragment. The inventive and the comparison compounds were added to the emulsion, and coatings prepared and tested as described in Example 1, except that the concentrations of one-electron donor varied from $0.44\times10^{-3}$ mole per silver mole to $4.40\times10^{-3}$ mole per mole of silver. Where present, the sensitizing dye D-II was added from methanol solution to the emulsion at 40° C. after the chemical sensitization. The one-electron donors were then added to the emulsion and coatings prepared as described in Example 1, except that the additional gelatin used to prepare the coatings described in Table XX was deionized gelatin. The coatings were tested for their response to a 365 nm exposure as described in Example 1. For this exposure, the relative sensitivity was set equal to 100 for the control coating with no one-electron donor added.

acetyl derivative of Compound No. 1, do not undergo a fragmentation reaction when oxidized and give very little or no sensitivity increase to the dyed or undyed emulsions.

These data show that one-electron donors that undergo bond fragmentation when oxidized give significantly larger increases in emulsion sensitivity than simple one-electron donors that do not fragment.

TABLE XX

Comparison of fragmenting vs non-fragmenting 1 electron donors on Emulsion T-2

| Cp'd | $E_1$ | reactivity of $X-Y^{+\bullet}$ | $E_2$ | Amount of Compound ($10^{-3}$ mole/mole Ag) | Type of Sensitizing Dye | Amount of Sensitizing Dye ($10^{-3}$ mole/mole Ag) | $S_{365}$ | Fog | Remarks |
|---|---|---|---|---|---|---|---|---|---|
| None | — | | — | 0 | none | 0 | 100 | 0.05 | control |
| 1 | 0.53 | fragments | >−0.5 | 0.44 | none | 0 | 129 | 0.05 | invention |
| 1 | " | " | " | 1.4 | none | 0 | 138 | 0.05 | invention |
| 1 | " | " | " | 4.4 | none | 0 | 141 | 0.05 | invention |
| Comp-1 | 0.75 | does not fragment | — | 0.44 | none | 0 | 110 | 0.05 | comparison |
| Comp-1 | " | does not fragment | — | 1.4 | none | 0 | 112 | 0.05 | comparison |
| Comp-1 | " | does not fragment | — | 4.4 | none | 0 | 110 | 0.05 | comparison |
| Comp-3 | 0.98 | does not fragment | — | 0.44 | none | 0 | 105 | 0.05 | comparison |
| Comp-3 | " | does not fragment | — | 1.4 | none | 0 | 102 | 0.06 | comparison |
| Comp-3 | | does not fragment | — | 4.4 | none | 0 | 102 | 0.05 | comparison |
| 46 | 0.68 | fragments | −0.34 | 0.44 | none | 0 | 110 | 0.06 | invention |
| 46 | " | " | " | 1.4 | none | 0 | 115 | 0.06 | invention |
| 46 | " | " | " | 4.4 | none | 0 | 126 | 0.06 | invention |
| Comp-2 | 1.03 | does not fragment | — | 0.44 | none | 0 | 102 | 0.05 | comparison |
| Comp-2 | " | does not fragment | — | 1.4 | none | 0 | 100 | 0.05 | comparison |
| Comp-2 | " | does not fragment | — | 4.4 | none | 0 | 97 | 0.05 | comparison |
| none | — | — | — | 0 | II | 0.86 | 62 | 0.10 | control |
| 1 | 0.53 | fragments | >−0.5 | 0.44 | II | 0.86 | 80 | 0.11 | invention |
| 1 | " | " | " | 1.4 | II | 0.86 | 83 | 0.11 | invention |
| 1 | " | " | " | 4.4 | II | 0.86 | 82 | 0.11 | invention |
| Comp-1 | 0.75 | does not fragment | — | 0.44 | II | 0.86 | 69 | 0.11 | comparison |
| Comp-1 | " | does not fragment | — | 1.4 | II | 0.86 | 73 | 0.11 | comparison |
| Comp-1 | " | does not fragment | — | 4.4 | II | 0.86 | 73 | 0.11 | comparison |

The data in Table XX show that the one-electron donors Compound No. 1 and Compound No. 46, which fragment by a decarboxylation process when oxidized, increased the 365 nm sensitivity of the undyed emulsion, and that this sensitivity gain generally increased with increasing concentration of the one-electron donors. No fog increase was observed for these compounds used with the undyed T-2 emulsion. When the emulsion T-2 was dyed with the red sensitizing dye, a small (a factor of 0.6) decrease in 365 nm sensitivity was observed, indicating some dye desensitization. When the fragmentable one-electron donors were added to the dyed emulsions at optimum concentrations, the 365 nm sensitivity of the emulsions was significantly increased. These data indicate that, under optimum conditions, these fragmentable one-electron donors can enhance the inherent sensitivity of the emulsion and ameliorate dye desensitization.

In contrast, the comparison compounds, Comp-1 and Comp-2, which are derivatives of Compound No. 1 and Compound No. 46 wherein the carboxylate functional group is replaced by an ethyl ester group, and Comp-3, which is an

EXAMPLE 21

The chemically sensitized emulsion AgBrI tabular emulsion T-2 as described in Example 3 was used to prepare coating containing the fragmentable electron donor compound No. 60. The coating variations as described in Table XXI were tested for their response to a 365 nm exposure, as described in Example 1.

The data in Table XXI demonstrate that this fragmentable electron donor compound No. 60 gives speed increases with little or no fog increase in this undyed tabular emulsion.

TABLE XXI

Speed and For results for compound No. 60 with a sulfur sensitized AgBrI T-grain Emulsion T-2

| Test # | Compound No. | Amount of Cmpd added ($10^{-3}$ mol/mol Ag) | Photographic Sensitivity $S_{365}$ | Fog | Remarks |
|---|---|---|---|---|---|
| 1 | none | none | 100 | 0.04 | control |
| 2 | 60 | 1.4 | 138 | .04 | invention |
| 3 | 60 | 4.4 | 159 | 0.05 | invention |

This invention has been described in detail with particular reference to preferred embodiments thereof, but it will be understood that variations and modifications can be effected within the spirit and scope of the invention.

What is claimed is:

1. A photographic element comprising a support and at least one silver halide emulsion layer in which the silver halide is sensitized with a fragmentable electron donor of the formula X—Y, wherein X is an electron donor moiety and Y is a leaving group other than hydrogen, and wherein:

1) X—Y has an oxidation potential between 0 and about 1.4 V; and 2) the oxidized form of X—Y undergoes a bond cleavage reaction to give the radical $X^{\bullet}$ and the leaving fragment Y.

2. A photographic element comprising a support and at least one silver halide emulsion layer in which the silver halide is sensitized with a fragmentable electron donor of the formula X—Y, wherein X is an electron donor moiety and Y is a leaving group other than hydrogen, and wherein:

1) X—Y has an oxidation potential between 0 and about 1.4 V;

2) the oxidized form of X—Y undergoes a bond cleavage reaction to give the radical $X^{\bullet}$ and the leaving fragment Y; and 3) the radical $X^{\bullet}$ has an oxidation potential $\leqq -0.7$ V.

3. A photographic element according to claim 1 or claim 2, wherein X is of formula (I):

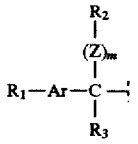

(I)

wherein:

m is 0 or 1;

z is O, S, Se or Te;

Ar is an aryl group or a heterocyclic group;

$R_1$ is R, carboxyl, amide, sulfonamide, halogen, $NR_2$, $(OH)_n$, $(OR')_n$ or $(SR)_n$; where R' is alkyl or substituted alkyl;

n is 1–3;

$R_2$ is R or Ar';

$R_3$ is R or Ar';

$R_2$ and $R_3$ together can form 5- to 8-membered ring;

$R_2$ and Ar can be linked to form 5- to 8-membered ring;

$R_3$ and Ar can be linked to form 5- to 8-membered ring;

Ar' is an aryl group or a heterocyclic group; and

R is a hydrogen atom or an unsubstituted or substituted alkyl group.

4. A photographic element according to claim 3, wherein X is selected from the group consisting of:

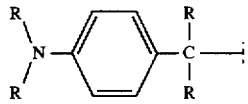

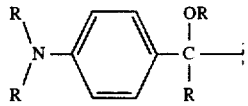

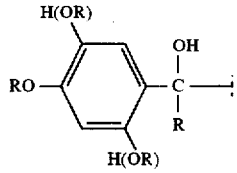

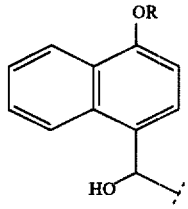

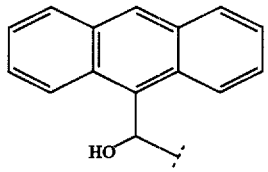

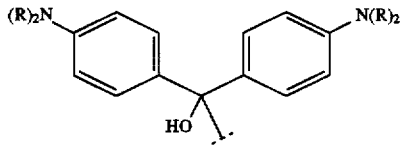

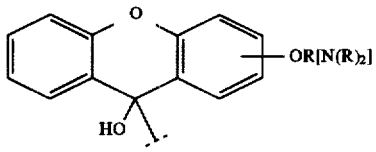

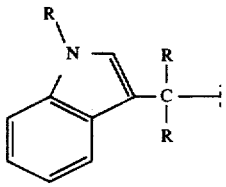

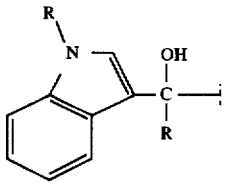

-continued

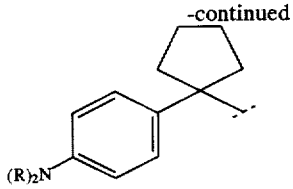

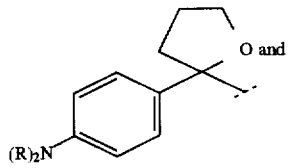

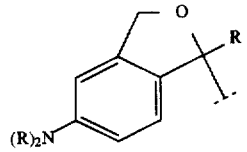

wherein R is a hydrogen atom or a substituted or unsubstituted alkyl group.

5. A photographic element according to claim 1 or claim 2, wherein X is of formula (II):

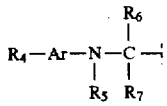

(II)

wherein:

Ar is an aryl group or a heterocyclic group;

$R_4$ is a substituent having a Hammett sigma value of −1 to +1;

$R_5$ is R or Ar';

$R_6$ is R or Ar';

$R_7$ is R or Ar';

$R_5$ and Ar can be linked to form 5- to 8-membered ring;

$R_6$ and Ar can be linked to form 5- to 8-membered ring, in which case $R_6$ can comprise a hetero atom;

$R_5$ and $R_6$ can be linked to form 5- to 8-membered ring;

$R_6$ and $R_7$ can be linked to form 5- to 8-membered ring;

Ar' is an aryl group or a heterocyclic group; and

R is a hydrogen atom or an unsubstituted or substituted alkyl group.

6. A photographic element according to claim 5, wherein X is selected from the group consisting of:

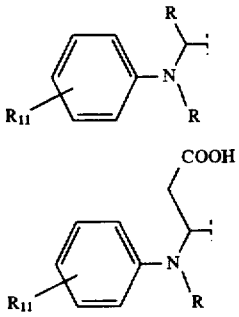

-continued

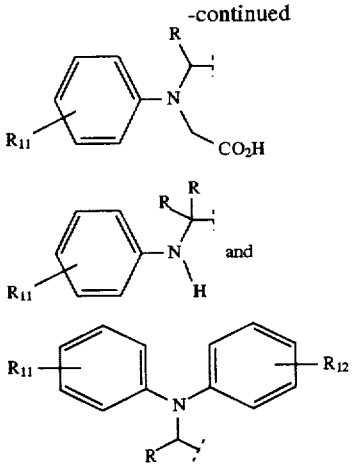

wherein $R_{11}$ and $R_{12}$ are independently H, alkyl, alkoxy, alkylthio, halo, carbamoyl, carboxyl, amido, formyl, sulfonyl, sulfonamido or nitrile and R is a hydrogen atom or an unsubstituted or substituted alkyl group.

7. A photographic element according to claim 5, wherein X is selected from the group consisting of:

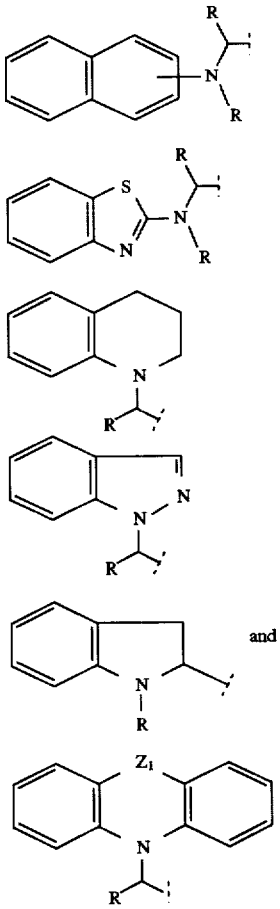

wherein $Z_1$ is covalent bond, S, O, Se, NR, $CR_2$, CR=CR or $CH_2CH_2$ and R is a hydrogen atom or a substituted or unsubstituted alkyl group.

8. A photographic element according to claim 5, wherein X has the structure:

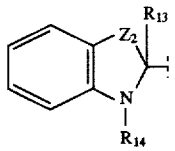

wherein $Z_2$ is S, O, Se, NR, $CR_2$ or CR=CR, and $R_{13}$ is an unsubstituted or substituted alkyl or aryl group, $R_{14}$ is hydrogen or an unsubstituted or substituted alkyl or aryl group and R is a hydrogen atom or a substituted or unsubstituted alkyl group.

9. A photographic element according to claim 1 or claim 2, wherein X is of formula (III):

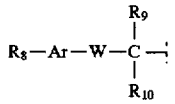

(III)

wherein:

W is O, S or Se;

Ar is an aryl group or a heterocyclic group;

$R_8$ is R, carboxyl, $N(R)_2$, $(OR)_n$, or $(SR)_n$;

n is 1–3;

$R_9$ and $R_{10}$ are independently R or Ar';

$R_9$ and Ar can be linked to form 5- to 8-membered ring;

Ar' is an aryl group or a heterocyclic group; and

R is a hydrogen atom or an unsubstituted or substituted alkyl group.

10. A photographic element according to claim 9, wherein X is selected from the group consisting of:

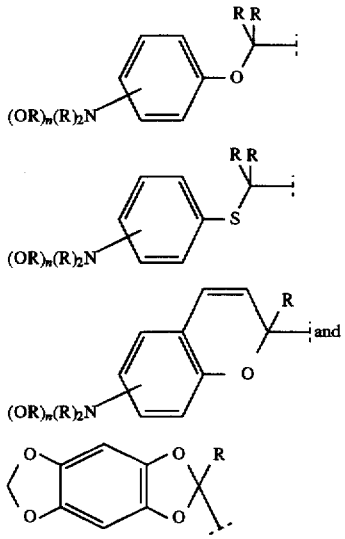

wherein n is 1–3, and R is a hydrogen atom or an unsubstituted or substituted alkyl group.

11. A photographic element according to claim 1 or claim 2, wherein X is of formula (IV):

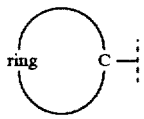

(IV)

wherein "ring" represents a substituted or unsubstituted 5-, 6- or 7-membered unsaturated ring.

12. A photographic element according to claim 11, wherein X is selected from the group consisting of

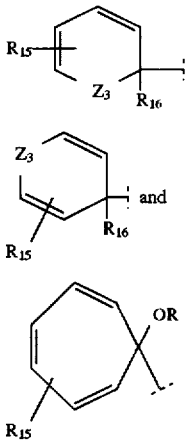

wherein $Z_3$ is O, S, Se or NR; $R_{15}$ is OR or $NR_2$; $R_{16}$ unsubstituted alkyl or substituted alkyl and R is a hydrogen atom or an unsubstituted or substituted alkyl group.

13. A photographic element according to claim 1 or claim 2, wherein Y is:

(1) X', where X' is an X group as defined in structures I–IV and may be the same as or different from the X group to which it is attached (2)

(3)

where M=Si, Sn or Ge; and R'=alkyl or substituted alkyl; or (4)

where Ar"=aryl or substituted aryl and wherein structures I–IV are:

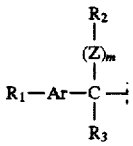

(I)

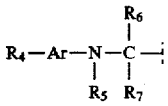

(II)

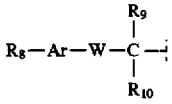

(III)

and

-continued (IV)

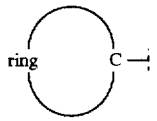

wherein in Structure I:

m is 0 or 1;

Z is O, S, Se or Te;

Ar is an aryl group or a heterocyclic group;

$R_1$ is R, carboxyl, amide, sulfonamide, halogen, $NR_2$, $(OH)_n$, $(OR')_n$ or $(SR)_n$; where R' is alkyl or substituted alkyl;

n is 1–3;

$R_2$ is R or Ar';

$R_3$ is R or Ar';

$R_2$ and $R_3$ together can form 5- to 8-membered ring;

$R_2$ and Ar can be linked to form 5- to 8-membered ring;

$R_3$ and Ar can be linked to form 5- to 8-membered ring;

Ar' is an aryl group or a heterocyclic group; and

R is a hydrogen atom or an unsubstituted or substituted alkyl group;

wherein in structure II:

Ar is an aryl group or a heterocyclic group;

$R_4$ is a substituent having a Hammett sigma value of −1 to +1;

$R_5$ is R or Ar';

$R_6$ is R or Ar';

$R_7$ is R or Ar';

$R_5$ and Ar can be linked to form 5- to 8-membered ring;

$R_6$ and Ar can be linked to form 5- to 8-membered ring, in which case $R_6$ can comprise a hetero atom;

$R_5$ and $R_6$ can be linked to form 5- to 8-membered ring;

$R_6$ and $R_7$ can be linked to form 5- to 8-membered ring;

Ar' is an aryl group or a heterocyclic group; and

R is a hydrogen atom or an unsubstituted or substituted alkyl group;

wherein in structure III:

W is O, S or Se;

Ar is an aryl group or a heterocyclic group;

$R_8$ is R, carboxyl, $NR_2$, $(OR)_n$, or $(SR)_n$;

n is 1–3;

$R_9$ and $R_{10}$ are independently R or Ar';

$R_9$ and Ar can be linked to form 5- to 8-membered ring;

Ar' is an aryl group or a heterocyclic group; and

R is a hydrogen atom or an unsubstituted or substituted alkyl group; and wherein in structure IV:

"ring" represents a substituted or unsubstituted 5-, 6- or 7-membered unsaturated ring.

14. A photographic element according to claim 13, wherein Y is $COO^-$, $Si(R')_3$ or X'.

15. A photographic element according to claim 14, wherein Y is $COO^-$ or $Si(R')_3$.

16. A photographic element according to claim 1 or claim 2, wherein X—Y is a compound of formula (V):

(V)

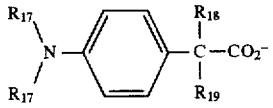

where $R_{17}$ is alkyl, $R_{18}$ is H, OH or alkoxy and $R_{19}$ is H or alkyl.

17. A photographic element according to claim 1 or claim 2, wherein X—Y is a compound of formula (VI):

(VI)

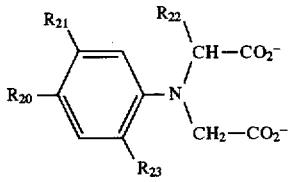

where $R_{20}$ and $R_{21}$ are each independently H, alkyl, alkoxy, alkylthio, halo, carbamoyl, carboxyl, amide, formyl, sulfonyl, sulfonamide or nitrile; $R_{22}$ is H, alkyl or $CH_2CO_2$— and $R_{23}$ is H or $OCH_2CO_2$.

18. A photographic element according to claim 1 or claim 2, wherein X—Y is a compound of formula (VII):

(VII)

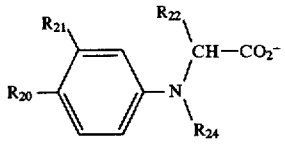

where $R_{20}$ and $R_{21}$ are each independently H, alkyl, alkoxy, alkylthio, halo, carbamoyl, carboxy, amide, formyl, sulfonyl, sulfonamide or nitrile; $R_{22}$ is H, alkyl, or $CH_2CO_2$—; $R_{24}$ is H, or alkyl.

19. A photographic element according to claim 1 or claim 2, wherein X—Y is a compound of the formula:

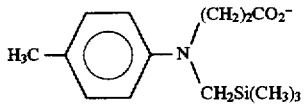

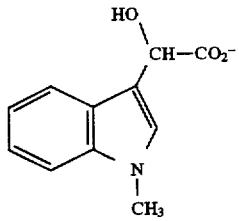

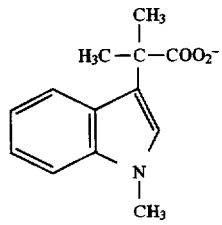

-continued

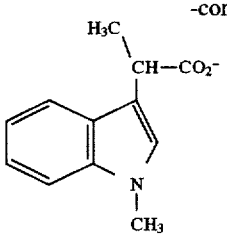

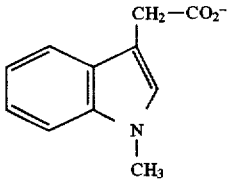

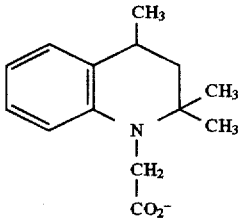

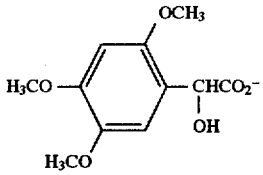

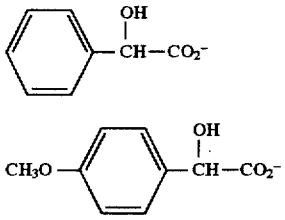

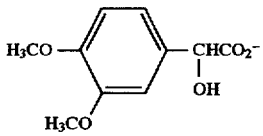

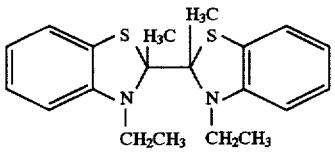

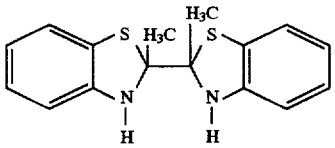

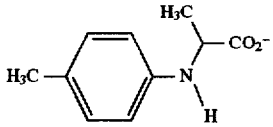

-continued

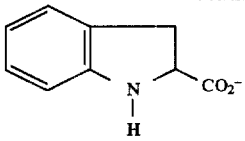

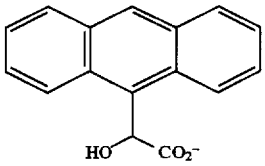

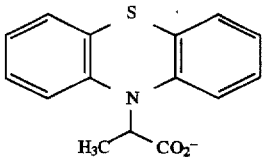

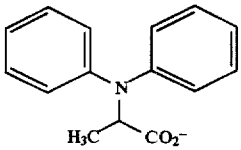

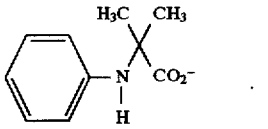

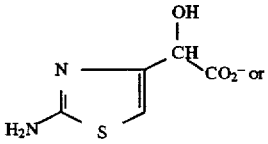

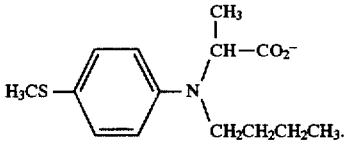

20. A photographic element according to claim 1 or claim 2, wherein the emulsion layer further contains a sensitizing dye.

21. A photographic element according to claim 20, wherein the sensitizing dye is selected from dyes of formula (VIII) through (XII):

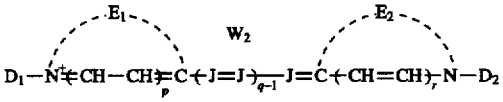

wherein:

$E_1$ and $E_2$ represent the atoms necessary to form a substituted or unsubstituted hetero ring and may be the same or different, each J independently represents a substituted or unsubstituted methine group, q is a positive integer of from 1 to 4, p and r each independently represents 0 or 1, $D_1$ and $D_2$ each independently represents substituted or unsubstituted alkyl or unsubstituted aryl, and $W_2$ is a counterion as necessary to balance the charge;

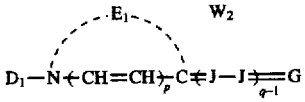

(IX)

wherein $E_1$, $D_1$, J, p, q and $W_2$ are as defined above for formula (VIII) and G represents

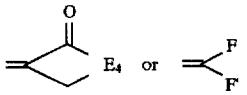

wherein $E_4$ represents the atoms necessary to complete a substituted or unsubstituted heterocyclic nucleus, and F and F' each independently represents a cyano radical, an ester radical, an acyl radical, a carbamoyl radical or an alkylsulfonyl radical;

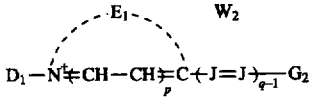

(X)

wherein $D_1$, $E_1$, J, p, q and $W_2$ are as defined above for formula (VIII), and $G_2$ represents a substituted or unsubstituted amino radical or a substituted or unsubstituted aryl radical;

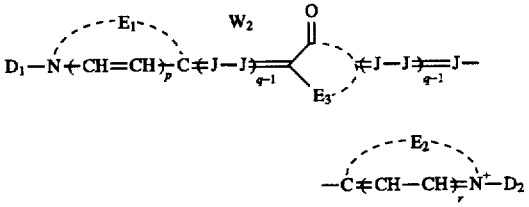

(XI)

wherein $D_1$, $E_1$, $D_2$, $E_1$, J, p, q, r and $W_2$ are as defined for formula (VIII) above, and $E_3$ is defined the same as $E_4$ for formula (IX) above;

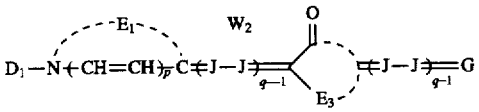

(XII)

wherein $D_1$, $E_1$, J, G, p, q, r and $W_2$ are as defined above for formula (VIII) above and $E_3$ is as defined for formula (XI) above.

22. A photographic element according to claim 1 or claim 2, comprising a plurality of layers wherein one or more of the layers of the element contains a hydroxybenzene compound.

23. A photographic element according to claim 22, wherein the hydroxybenzene compound has the formula:

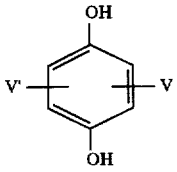

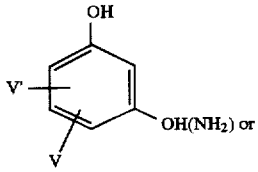

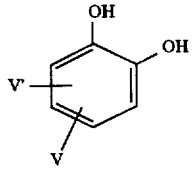

wherein V and V' each independently represent —H, —OH, a halogen atom, —OM (where M is alkali metal ion), an alkyl group, a phenyl group, an amino group, a carbonyl group, a sulfone group, a sulfonated phenyl group, a sulfonated alkyl group, a sulfonated amino group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

* * * * *